US006861188B2

(12) United States Patent
Ikegami et al.

(10) Patent No.: US 6,861,188 B2
(45) Date of Patent: Mar. 1, 2005

(54) ELECTROPHOTOGRAPHIC PHOTORECEPTOR, AND IMAGE FORMING METHOD, IMAGE FORMING APPARATUS AND PROCESS CARTRIDGE THEREFOR USING THE PHOTORECEPTOR

(75) Inventors: Takaaki Ikegami, Susono (JP); Yasuo Suzuki, Fuji (JP); Tomoyuki Shimada, Shizuoka-ken (JP); Nozomu Tamoto, Shizuoka-ken (JP); Hidetoshi Kami, Numazu (JP)

(73) Assignee: Ricoh Company Limited, Tokyo (JP)

( * ) Notice: Subject to any disclaimer, the term of this patent is extended or adjusted under 35 U.S.C. 154(b) by 162 days.

(21) Appl. No.: 10/235,961

(22) Filed: Sep. 6, 2002

(65) Prior Publication Data

US 2003/0194627 A1 Oct. 16, 2003

(30) Foreign Application Priority Data

| | | |
|---|---|---|
| Nov. 2, 2001 | (JP) | 2001-338194 |
| Nov. 30, 2001 | (JP) | 2001-367085 |
| Feb. 25, 2002 | (JP) | 2002-048616 |
| Feb. 28, 2002 | (JP) | 2002-054889 |
| Feb. 28, 2002 | (JP) | 2002-054911 |
| Jun. 4, 2002 | (JP) | 2002-163547 |
| Jun. 27, 2002 | (JP) | 2002-188643 |

(51) Int. Cl.[7] ..... G03G 5/06

(52) U.S. Cl. ..... 430/58.65; 430/56; 430/58.2; 430/58.3; 430/58.45; 430/58.7; 430/58.75; 430/58.8; 399/159

(58) Field of Search ..... 430/58.65, 56, 430/58.2, 58.3, 58.45, 58.7, 58.75, 58.8, 97; 399/159

(56) References Cited

U.S. PATENT DOCUMENTS

| | | | | |
|---|---|---|---|---|
| 3,677,752 | A | | 7/1972 | Looker et al. |
| 3,767,393 | A | | 10/1973 | Fox |
| 4,302,521 | A | | 11/1981 | Takei et al. |
| 4,304,829 | A | | 12/1981 | Limburg et al. |
| 4,397,931 | A | | 8/1983 | Limburg et al. |
| 4,740,441 | A | | 4/1988 | Otomura |
| 4,920,022 | A | | 4/1990 | Sakakibara et al. |
| 4,942,104 | A | | 7/1990 | Kitajima et al. |
| 4,971,874 | A | | 11/1990 | Ueda |
| 5,028,502 | A | | 7/1991 | Yuh et al. |
| 5,079,119 | A | | 1/1992 | Suzuki et al. |
| 5,100,453 | A | | 3/1992 | Richards |
| 5,128,228 | A | | 7/1992 | Ueda et al. |
| 5,286,588 | A | | 2/1994 | Suzuki |
| 5,339,138 | A | | 8/1994 | Mishima et al. |
| 5,393,627 | A | | 2/1995 | Nakamura et al. |
| 5,411,827 | A | | 5/1995 | Tamura et al. |
| 5,413,886 | A | | 5/1995 | Pai et al. |
| 5,496,671 | A | | 3/1996 | Tamura et al. |
| 5,561,016 | A | | 10/1996 | Suzuki et al. |
| 5,578,405 | A | | 11/1996 | Ikegami et al. |
| 5,604,064 | A | * | 2/1997 | Nukada et al. ..... 430/58.65 |
| 5,618,646 | A | | 4/1997 | Nogami et al. |
| 5,665,500 | A | | 9/1997 | Suzuki |
| 5,677,096 | A | | 10/1997 | Suzuki |
| 5,686,212 | A | | 11/1997 | Tomiuchi et al. |
| 5,702,855 | A | | 12/1997 | Ikegami et al. |
| 5,747,205 | A | * | 5/1998 | Hu et al. ..... 430/58.15 |
| 5,789,128 | A | | 8/1998 | Adachi et al. |
| 5,834,145 | A | | 11/1998 | Yoshinaga et al. |
| 5,837,411 | A | | 11/1998 | Morishita et al. |
| 5,846,680 | A | | 12/1998 | Adachi et al. |
| 5,851,712 | A | | 12/1998 | Muto et al. |
| 5,853,935 | A | | 12/1998 | Suzuki et al. |
| 5,910,561 | A | | 6/1999 | Adachi et al. |
| 5,928,828 | A | | 7/1999 | Suzuki |
| 5,942,363 | A | | 8/1999 | Tanaka et al. |
| 5,955,229 | A | | 9/1999 | Saita |
| 5,999,773 | A | | 12/1999 | Yasutomi et al. |
| 6,004,709 | A | | 12/1999 | Renfer et al. |
| 6,026,262 | A | | 2/2000 | Kinoshita et al. |
| 6,030,733 | A | | 2/2000 | Kami et al. |
| 6,030,736 | A | * | 2/2000 | Ikegami et al. ..... 430/59.6 |
| 6,069,224 | A | | 5/2000 | Adachi et al. |
| 6,132,914 | A | | 10/2000 | Shimada |
| 6,136,483 | A | | 10/2000 | Suzuki et al. |
| 6,151,468 | A | | 11/2000 | Kami et al. |
| 6,172,264 | B1 | | 1/2001 | Kobayashi et al. |
| 6,187,491 | B1 | | 2/2001 | Ferrar et al. |
| 6,191,249 | B1 | | 2/2001 | Tanaka et al. |
| 6,200,717 | B1 | | 3/2001 | Takeuchi et al. |
| 6,249,304 | B1 | | 6/2001 | Sawayama et al. |
| 6,313,288 | B1 | | 11/2001 | Shimada et al. |
| 6,319,878 | B1 | | 11/2001 | Ina et al. |
| 6,322,940 | B1 | | 11/2001 | Nishigaki et al. |
| 6,326,112 | B1 | | 12/2001 | Tamura et al. |
| 6,333,439 | B1 | | 12/2001 | Shimada |
| 6,366,751 | B1 | | 4/2002 | Shakuto et al. |
| 6,432,596 | B2 | | 8/2002 | Ikuno et al. |
| 6,444,387 | B2 | | 9/2002 | Ri et al. |

FOREIGN PATENT DOCUMENTS

| | | |
|---|---|---|
| EP | 0 349 034 | 1/1990 |
| EP | 0 506 492 | 9/1992 |
| EP | 0 552 740 | 7/1993 |
| EP | 0 767 411 | 4/1997 |
| EP | 0 812 820 | 12/1997 |
| EP | 0 984 334 | 3/2000 |
| EP | 1 014 205 | 6/2000 |
| EP | 1 018 670 | 7/2000 |
| EP | 1 205 808 | 5/2002 |
| JP | 57-102660 | 6/1982 |
| JP | 60-196768 | 10/1985 |
| JP | 62-195667 | 8/1987 |
| JP | 63-210938 | 9/1988 |
| JP | 1-219838 | 9/1989 |
| JP | 03-096961 | 4/1991 |
| JP | 2000-231204 | 8/2000 |

* cited by examiner

*Primary Examiner*—John L. Goodrow
(74) *Attorney, Agent, or Firm*—Oblon, Spivak, McClelland, Maier & Neustadt, P.C.

(57) ABSTRACT

Electrophotographic photoreceptor having a photosensitive layer containing an amino compound selected from formulae 1 to 22 in the specification.

50 Claims, 6 Drawing Sheets

ELECTROPHOTOGRAPHIC PHOTORECEPTOR, AND IMAGE FORMING METHOD, IMAGE FORMING APPARATUS AND PROCESS CARTRIDGE THEREFOR USING THE PHOTORECEPTOR

BACKGROUND OF THE INVENTION

1. Field of the Invention

The present invention relates to an electrophotographic photoreceptor, and an image forming method, an image forming apparatus and a process cartridge therefor using the photoreceptor.

2. Discussion of the Background

Recently, data processing systems using an electrophotographic method make a remarkable progress. In particular, laser printers and digital copiers which record data with light by changing the data into digital signals make remarkable improvements in their printing qualities and reliabilities. Further, technologies used in these printers and copiers are applied to laser printers and digital copiers capable of printing full-color images with high-speed printing technologies. Because of these reasons, photoreceptors are required both to produce high-quality images and to have high durability.

Photoreceptors using organic photosensitive materials are widely used for these laser printers and digital copiers due to their cost, productivity and non-polluting properties. The organic photoreceptors are generally classified to a single-layered type and a functionally-separated type. The first practical organic photoreceptor, i.e., PVK-TNF charge transfer complex photoreceptor was the former single-layered type.

In 1968, Mr. Hayashi and Mr. Regensburger independently invented PVK/a-Se multi-layered photoreceptor. In 1977, Mr. Melz, and in 1978, Mr. Schlosser disclosed a multi-layered photoreceptor whose photosensitive layers are all formed from organic materials, i.e., an organic-pigment dispersed layer and an organic low-molecular-weight material dispersed polymer layer. These are called as functionally-separated photoreceptors because of having a charge generation layer (CGL) generating a charge by absorbing light and a charge transport layer (CTL) transporting the charge and neutralizing the charge on a surface of the photoreceptor.

The multi-layered photoreceptor has much more improved sensitivity and durability than the single-layered photoreceptor. In addition, since materials can be separately selected for a charge generation material (CGM) and a charge transport material (CTM), a choice range of the materials is largely expanded. Because of these reasons, the multi-layered photoreceptor is now prevailing in the market.

A mechanism to form an electrostatic latent image in the multi-layered photoreceptor is as follows:

the photoreceptor is charged and irradiated with light; the light passes through the CTL and is absorbed by the CGM in the CGL to generate a charge; the charge is injected into the CTL at an interface of the CGL and the CTL; and the charge moves in the CTL by an electric field and neutralizes the charge on the surface of the photoreceptor to form an electrostatic latent image.

However, the photosensitive layers of the organic photoreceptor are easily abraded due to a repeated use, and therefore potential and photosensitivity of the photoreceptor tend to deteriorate, resulting in background fouling due to a scratch on the surface thereof and deterioration of density and quality of the resultant images. Therefore, abrasion resistance of the organic photoreceptor has been an important subject. Further, recently, in accordance with speeding up of the printing speed and downsizing of an image forming apparatus, the photoreceptor has to have a smaller diameter, and durability thereof becomes a more important subject.

As a method of improving the abrasion resistance of the photoreceptor, methods of imparting lubricity to the photosensitive layer, hardening the photosensitive layer, including a filler therein and using a high-molecular-weight CTM instead of a low-molecular-weight CTM are widely known. However, another problem occurs when these methods are used to prevent the abrasion of the photoreceptor. Namely, an oxidized gas such as ozone and NOx arising due to use conditions or environment, adheres to the surface of the photosensitive layer and decreases the surface resistance thereof, resulting in a problem such as blurring of the resultant images.

So far, such a problem has been avoided to some extent because the material causing the blurred images are gradually scraped off in accordance with the abrasion of the photosensitive layer. However, in order to comply with the above-mentioned recent demand for higher sensitivity and durability of the photoreceptor, a new technique has to be imparted thereto. In order to decrease an influence of the material causing the blurred images, there is a method of equipping the photoreceptor with a heater, which is a large drawback for downsizing the apparatus and decreasing the electric power consumption. In addition, a method of including an additive such as an antioxidant in the photosensitive layer is effective, but since a simple additive does not have photoconductivity, including much amount thereof in the photosensitive layer causes problems such as deterioration of the sensitivity and increase of residual potential of the resultant photoreceptor.

In addition, Japanese Laid-Open Patent Publication No. 2000-231204 discloses an aromatic compound having a dialkylamino group. The compound is effective for quality of the resultant images after a repeated use of the photoreceptor, but it is difficult to comply with the demand for higher sensitivity and printing speed due to its low charge transportability, and an addition quantity thereof has a limit.

As mentioned above, the electrophotographic photoreceptor having less abrasion by being imparted with abrasion resistance or a process design around thereof inevitably produces blurred and low-resolution images, and it is difficult to have both of high durability and high quality of the resultant images. This is because high surface resistance of the photosensitive layer is preferable to prevent the blurred images and low surface resistance thereof is preferable to prevent the increase of residual potential.

Because of these reasons, a need exists for an electrophotographic photoreceptor having high durability against a repeated use for a long time, preventing deterioration of image density and blurred images and stably producing quality images.

SUMMARY OF THE INVENTION

Accordingly, an object of the present invention is to provide an electrophotographic photoreceptor having high durability against a repeated use for a long time, preventing deterioration of image density and blurred images and stably producing high quality images.

Another object of the present invention is to provide an image forming method, an image forming apparatus and a process cartridge using the photoreceptor, in which the photoreceptor need not be exchanged, which enables downsizing the apparatus in accordance with the high-speed printing or smaller diameter of the photoreceptor, and which stably produce high quality images even after a repeated use for a long time.

Briefly these objects and other objects of the present invention as hereinafter will become more readily apparent can be attained by an electrophotographic photoreceptor including at least one of amino compounds having the following formulae (1) to (22) in the photosensitive layer.

(1)

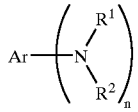

wherein $R^1$ and $R^2$ independently represent an alkyl group having 1 to 4 carbon atoms and may be combined with each other to form a heterocyclic group including the nitrogen atom to which they are attached; n represents an integer of from 1 to 4; and Ar represents a substituted or unsubstituted aromatic ring group;

(2)

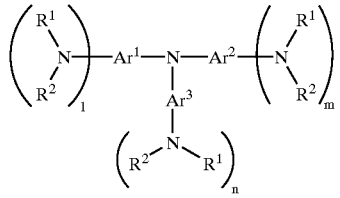

wherein $R^1$ and $R^2$ independently represent an alkyl group having 1 to 4 carbon atoms and may be combined with each other to form a heterocyclic group including the nitrogen atom to which they are attached; l, m and n independently represent 0 or an integer of from 1 to 3, provided l, m and n are not 0 at the same time; $Ar^1$, $Ar^2$ and $Ar^3$ independently represent a substituted or unsubstituted aromatic ring group; and $Ar^1$ and $Ar^2$, $Ar^2$ and $Ar^3$ or $Ar^3$ and $Ar^1$ may independently form a heterocyclic group including the nitrogen atom to which they are attached together;

(3)

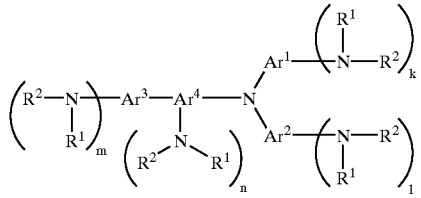

wherein $R^1$ and $R^2$ independently represent an alkyl group having 1 to 4 carbon atoms and may be combined with each other to form a heterocyclic group including the nitrogen atom to which they are attached; k, l, m and n independently represent 0 or an integer of from 1 to 3, provided k, l, m and n are not 0 at the same time; $Ar^1$, $Ar^2$, $Ar^3$and $Ar^4$ independently represent a substituted or unsubstituted aromatic ring group; and $Ar^1$ and $Ar^2$, $Ar^1$ and $Ar^4$ or $Ar^3$ and $Ar^4$ may independently form a ring together;

(4)

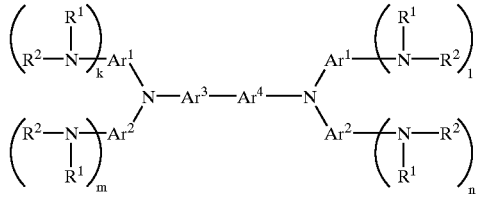

wherein $R^1$ and $R^2$ independently represent an alkyl group having 1 to 4 carbon atoms and may be combined with each other to form a heterocyclic group including the nitrogen atom to which they are attached; k, l, m and n independently represent 0 or an integer of from 1 to 3, provided k, l, m and n are not 0 at the same time; $Ar^1$, $Ar^2$, $Ar^3$ and $Ar^4$ independently represent a substituted or unsubstituted aromatic ring group; and $Ar^1$ and $Ar^2$, $Ar^1$ and $Ar^3$ or $Ar^3$ and $Ar^4$ may independently form a ring together;

(5)

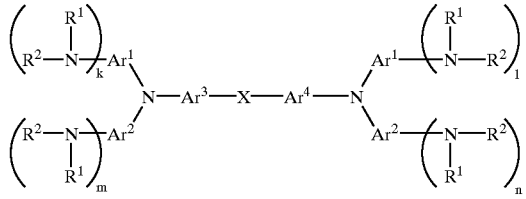

wherein $R^1$ and $R^2$ independently represent an alkyl group having 1 to 4 carbon atoms and may be combined with each other to form a heterocyclic group including the nitrogen atom to which they are attached; k, l, m and n independently represent 0 or an integer of from 1 to 3, provided k, l, m and n are not 0 at the same time; $Ar^1$, $Ar^2$, $Ar^3$ and $Ar^4$ independently represent a substituted or unsubstituted aromatic ring group; $Ar^1$ and $Ar^2$, $Ar^1$ and $Ar^3$ or $Ar^1$ and $Ar^4$ may independently form a ring together; and X represents a methylene group, a cyclohexylidine group, an oxy atom or a sulfur atom;

(6)

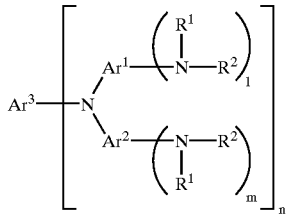

wherein $R^1$ and $R^2$ independently represent an alkyl group having 1 to 4 carbon atoms and may be combined with each other to form a heterocyclic group including the nitrogen atom to which they are attached; l and m independently represent 0 or an integer of from 1 to 3, provided l and m are not 0 at the same time; $Ar^1$, $Ar^2$ and $Ar^3$ independently represent a substituted or unsubstituted aromatic ring group; $Ar^1$ and $Ar^2$ or $Ar^1$ and $Ar^3$ may independently form a ring together; and n represents an integer of from 1 to 4;

(7)

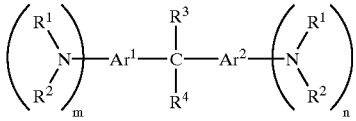

wherein $R^1$ and $R^2$ independently represent an alkyl group having 1 to 4 carbon atoms and may be combined with each other to form a heterocyclic group including the nitrogen atom to which they are attached; m and n independently represent 0 or an integer of from 1 to 3, provided m and n are not 0 at the same time; $R^3$ and $R^4$ independently represent a hydrogen atom, a substituted or unsubstituted alkyl group having 1 to 11 carbon atoms and a substituted or unsubstituted aromatic ring group; and $Ar^1$ and $Ar^2$ independently represent a substituted or unsubstituted aromatic ring group, provided one of $Ar^1$, $Ar^2$, $R^3$ and $R^4$ is an aromatic heterocyclic group;

(8)

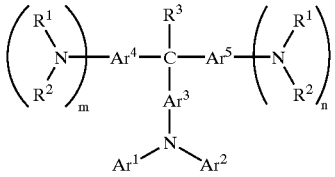

wherein $R^1$ and $R^2$ independently represent an alkyl group having 1 to 4 carbon atoms and may be combined with each other to form a heterocyclic group including the nitrogen atom to which they are attached; m and n independently represent 0 or an integer of from 1 to 3, provided m and n are not 0 at the same time; $R^3$ represents a hydrogen atom, a substituted or unsubstituted alkyl group having 1 to 11 carbon atoms and a substituted or unsubstituted aromatic ring group; $Ar^1$, $Ar^2$, $Ar^3$, $Ar^4$ and $Ar^5$ independently represent a substituted or unsubstituted aromatic ring group; and $Ar^1$ and $Ar^2$ or $Ar^1$ and $Ar^3$ may form a heterocyclic group including the nitrogen atom to which they are attached together;

(9)

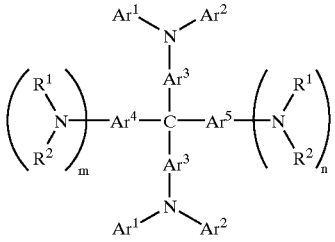

wherein $R^1$ and $R^2$ independently represent an alkyl group having 1 to 4 carbon atoms and may be combined with each other to form a heterocyclic group including the nitrogen atom to which they are attached; m and n independently represent 0 or an integer of from 1 to 3, provided m and n are not 0 at the same time; $Ar^1$, $Ar^2$, $Ar^3$, $Ar^4$ and $Ar^5$ independently represent a substituted or unsubstituted aromatic ring group; and $Ar^1$and $Ar^2$ or $Ar^1$ and $Ar^3$ may form a heterocyclic group including the nitrogen atom to which they are attached together;

(10)

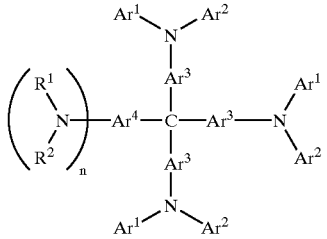

wherein $R^1$ and $R^2$ independently represent an alkyl group having 1 to 4 carbon atoms and may be combined with each other to form a heterocyclic group including the nitrogen atom to which they are attached; n represents an integer of from 1 to 3; $Ar^1$, $Ar^2$, $Ar^3$ and $Ar^4$ independently represent a substituted or unsubstituted aromatic ring group; and $Ar^1$ and $Ar^2$ or $Ar^1$ and $Ar^3$ may form a heterocyclic group including the nitrogen atom to which they are attached together;

(11)

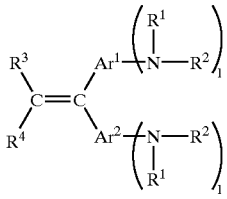

wherein $R^1$ and $R^2$ independently represent an alkyl group having 1 to 4 carbon atoms and may be combined with each other to form a heterocyclic group including the nitrogen atom to which they are attached; 1 represents an integer of from 1 to 3; $Ar^1$ and $Ar^2$ independently represent a substituted or unsubstituted aromatic ring group; $R^3$ and $R^4$ independently represent a hydrogen atom, a substituted or unsubstituted alkyl group having 1 to 4 carbon atoms, a substituted or unsubstituted aromatic ring group or a group having the following formula:

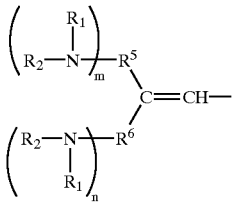

wherein $R^1$ and $R^2$ independently represent an alkyl group having 1 to 4 carbon atoms and may be combined with each other to form a heterocyclic group including the nitrogen atom to which they are attached; m and n independently represent 0 or an integer of from 1 to 3; and $R^5$ and $R^6$ independently represent a hydrogen atom, a substituted or unsubstituted alkyl group having 1 to 4 carbon atoms or a substituted or unsubstituted aromatic ring group, and wherein $R^3$ and $R^4$, $R^5$ and $R^6$ or $Ar^1$ and $Ar^2$ may independently form a ring together;

(12)

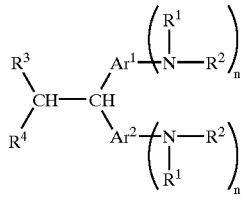

wherein $R^1$ and $R^2$ independently represent an alkyl group having 1 to 4 carbon atoms and may be combined with each other to form a heterocyclic group including the nitrogen atom to which they are attached; n represents an integer of from 1 to 3; $Ar^1$ and $Ar^2$ independently represent a substituted or unsubstituted aromatic ring group; $R^3$ and $R^4$ independently represent a hydrogen atom, a substituted or unsubstituted alkyl group having 1 to 4 carbon atoms, a substituted or unsubstituted aromatic ring group or a group having the following formula, provided $R^3$ and $R^4$ are not hydrogen atoms at the same time:

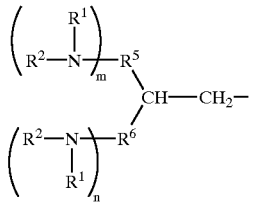

wherein $R^1$ and $R^2$ independently represent an alkyl group having 1 to 4 carbon atoms and may be combined with each other to form a heterocyclic group including the nitrogen atom to which they are attached; m and n independently represent 0 or an integer of from 1 to 3; and $R^5$ and $R^6$ independently represent a hydrogen atom, a substituted or unsubstituted alkyl group having 1 to 4 carbon atoms or a substituted or unsubstituted aromatic ring group, and wherein $R^3$ and $R^4$, $R^5$ and $R^6$ or $Ar^1$ and $Ar^2$ may independently form a ring together;

(13)

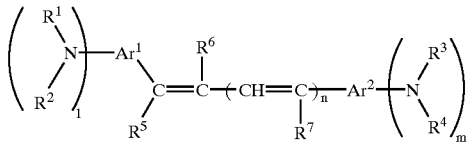

wherein $R^1$ and $R^2$ independently represent an alkyl group having 1 to 4 carbon atoms and may be combined with each other to form a heterocyclic group including the nitrogen atom to which they are attached; $R^3$ and $R^4$ independently represent a substituted or unsubstituted alkyl group having 1 to 4 carbon atoms or a substituted or unsubstituted aromatic ring group; $R^5$, $R^6$ and $R^7$ independently represent a hydrogen atom, a substituted or unsubstituted alkyl group having 1 to 4 carbon atoms or a substituted or unsubstituted aromatic ring group; $Ar^1$ and $Ar^2$ independently represent a substituted or unsubstituted aromatic ring group; $R^3$ and $R^4$ or $Ar^2$ and $R^4$ may form a heterocyclic group including the nitrogen atom to which they are attached together; $Ar^1$ and $R^5$ may form a ring together; l represents an integer of from 1 to 3; m represents 0 or an integer of from 1 to 3; and n represents 0 or 1;

(14)

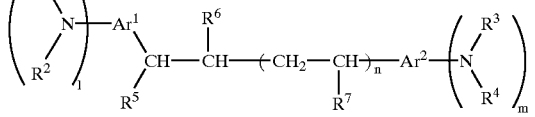

wherein $R^1$ and $R^2$ independently represent an alkyl group having 1 to 4 carbon atoms and may be combined with each other to form a heterocyclic group including the nitrogen atom to which they are attached; $R^3$ and $R^4$ independently represent a substituted or unsubstituted alkyl group having 1 to 4 carbon atoms or a substituted or unsubstituted aromatic ring group; $R^5$, $R^6$ and $R^7$ independently represent a hydrogen atom, a substituted or unsubstituted alkyl group having 1 to 4 carbon atoms or a substituted or unsubstituted aromatic ring group; $Ar^1$ and $Ar^2$ independently represent a substituted or unsubstituted aromatic ring group; $R^3$ and $R^4$ or $Ar^2$ and $R^4$ may form a heterocyclic group including the nitrogen atom to which they are attached together; $Ar^1$ and $R^5$ may form a ring together; l represents an integer of from 1 to 3; m represents 0 or an integer of from 1 to 3; and n represents 0 or 1;

(15)

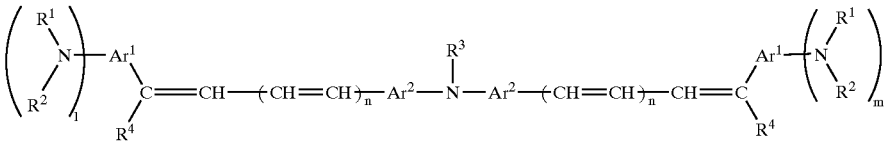

wherein $R^1$ and $R^2$ independently represent an alkyl group having 1 to 4 carbon atoms and may be combined with each other to form a heterocyclic group including the nitrogen atom to which they are attached; l and m independently represent 0 or an integer of from 1 to 3, provided l and m are not 0 at the same time; $R^3$ represents a substituted or unsubstituted alkyl group having 1 to 4 carbon atoms or a substituted or unsubstituted aromatic ring group; $R^4$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(16)

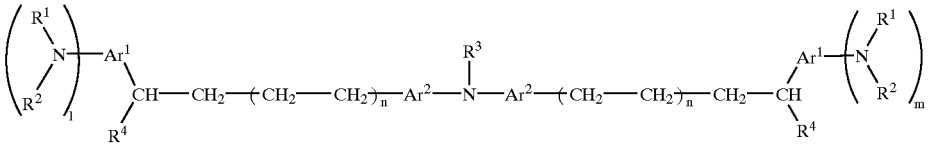

wherein $R^1$ and $R^2$ independently represent an alkyl group having 1 to 4 carbon atoms and may be combined with each other to form a heterocyclic group including the nitrogen atom to which they are attached; l and m independently represent 0 or an integer of from 1 to 3, provided l and m are not 0 at the same time; $R^3$ represents a substituted or unsubstituted alkyl group having 1 to 4 carbon atoms or a substituted or unsubstituted aromatic ring group; $R^4$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(17)

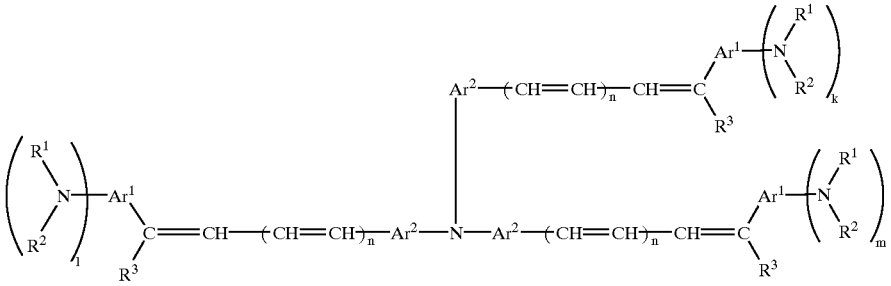

wherein $R^1$ and $R^2$ independently represent an alkyl group having 1 to 4 carbon atoms and may be combined with each other to form a heterocyclic group including the nitrogen atom to which they are attached; k, l and m independently represent 0 or an integer of from 1 to 3, provided k, l and m are not 0 at the same time; $R^3$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(18)

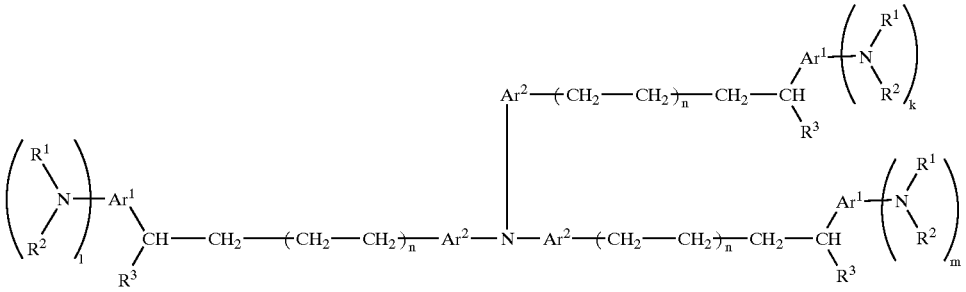

wherein $R^1$ and $R^2$ independently represent an alkyl group having 1 to 4 carbon atoms and may be combined with each other to form a heterocyclic group including the nitrogen atom to which they are attached; k, l and m independently represent 0 or an integer of from 1 to 3, provided k, l and m are not 0 at the same time; $R^3$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $Ar^1$ and $R^4$, $Ar^2$ and $R^3$ or $Ar^2$ and another $Ar^2$ may form a ring together; and n represents 0 or 1;

(19)

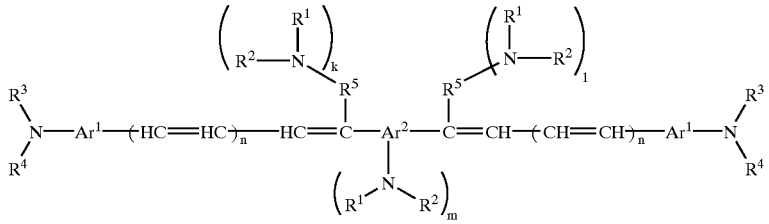

wherein $R^1$ and $R^2$ independently represent an alkyl group having 1 to 4 carbon atoms and may be combined with each other to form a heterocyclic group including the nitrogen atom to which they are attached; $R^3$ and $R^4$ independently represent a substituted or unsubstituted alkyl group having 1 to 4 carbon atoms or a substituted or unsubstituted aromatic ring group; $R^5$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $R^3$ and $R^4$ or $Ar^1$ and $R^4$ may form a heterocyclic group including the nitrogen atom to which they are attached together; k, l and m independently represent 0 or an integer of from 1 to 3; n represents 1 or 2; and $R^3$ and $R^4$ independently represent an alkyl group having 1 to 4 carbon atoms and may be combined with each other to form a heterocyclic group including the nitrogen atom to which they are attached when k, l and m are 0 at the same time;

(20)

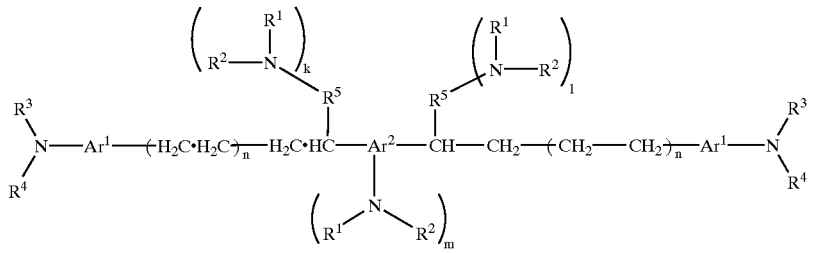

wherein $R^1$ and $R^2$ independently represent an alkyl group having 1 to 4 carbon atoms and may be combined with each other to form a heterocyclic group including the nitrogen atom to which they are attached; $R^3$ and $R^4$ independently represent a substituted or unsubstituted alkyl group having 1 to 4 carbon atoms or a substituted or unsubstituted aromatic ring group; $R^5$ represents a hydrogen atom, a substituted or unsubstituted alkyl group having 1 to 4 carbon atoms or a substituted or unsubstituted aromatic ring group; $Ar^1$ and $Ar^2$ represent a substituted or unsubstituted aromatic ring group; $R^3$ and $R^4$ or $Ar^1$ and $R^4$ may form a heterocyclic group including the nitrogen atom to which they are attached together; m represents 0 or an integer of from 1 to 4; n represents 1 or 2; and $R^3$ and $R^4$ independently represent an alkyl group having 1 to 4 carbon atoms and may be combined with each other to form a heterocyclic group including the nitrogen atom to which they are attached when m is 0;

(21)

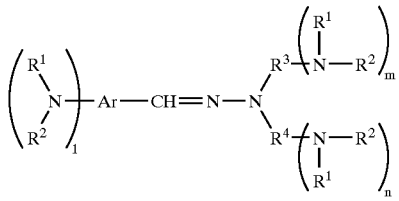

wherein $R^1$ and $R^2$ independently represent an alkyl group having 1 to 4 carbon atoms and may be combined with each other to form a heterocyclic group including the nitrogen atom to which they are attached; Ar represents a substituted or unsubstituted aromatic ring group; $R^3$ and $R^4$ represent a hydrogen atom, a substituted or unsubstituted alkyl group having 1 to 4 carbon atoms or a substituted or unsubstituted aromatic ring group; and l, m and n independently represent 0 or an integer of from 1 to 3, and are not 0 at the same time;

(22)

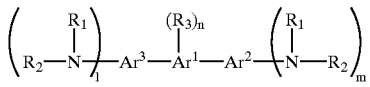

wherein $R^1$ and $R^2$ independently represent an alkyl group having 1 to 4 carbon atoms and may be combined with each other to form a heterocyclic group including the nitrogen atom to which they are attached; $Ar^1$, $Ar^2$ and $Ar^3$ represent a substituted or unsubstituted aromatic ring group; $R^3$ represents a hydrogen atom, a substituted or unsubstituted alkyl group having 1 to 4 carbon atoms or a substituted or unsubstituted aromatic ring group; l and m independently represent 0 or an integer of from 1 to 3, and are not 0 at the same time; and n represents an integer of from 1 to 3.

The reason why these compounds are effective for maintaining quality of the resultant images after a repeated use is not clarified at this time. However, it is supposed that substituted amino (dialkylamino) groups in the structure, i.e., $R^1$ and $R^2$ effectively prevent the oxidized gas which is thought to cause the blurred images. In addition, it is also found that combination of the compound and other CTMs further increases the sensitivity and stability to produce high quality images of the resultant photoreceptor after a repeated use.

In addition, Japanese Laid-Open Patent Publication No. 60-196768 and Japanese Patent No. 2884353 disclose a stilbene compound as a compound having such a dialkylamino group. However, since the compound has a substituted dialkylamino group having a strong mesomeric effect (+M effect) at a resonance portion in its triarylamine structure, which is a charge transport site, total ionizing potential is extremely small. Therefore, the compound has a critical defect of being quite difficult to practically use because charge retainability of a photosensitive layer in which the compound is used alone as a CTM largely deteriorates from the beginning or after a repeated use. In addition, even when the above-mentioned stilbene compound is used together with other CTMs as it is in the present invention, the compound has a considerably smaller ionizing potential than the other CTMs and becomes a trap site against a charge transport, and therefore, the resultant photoreceptor has quite a low sensitivity and a large residual potential.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
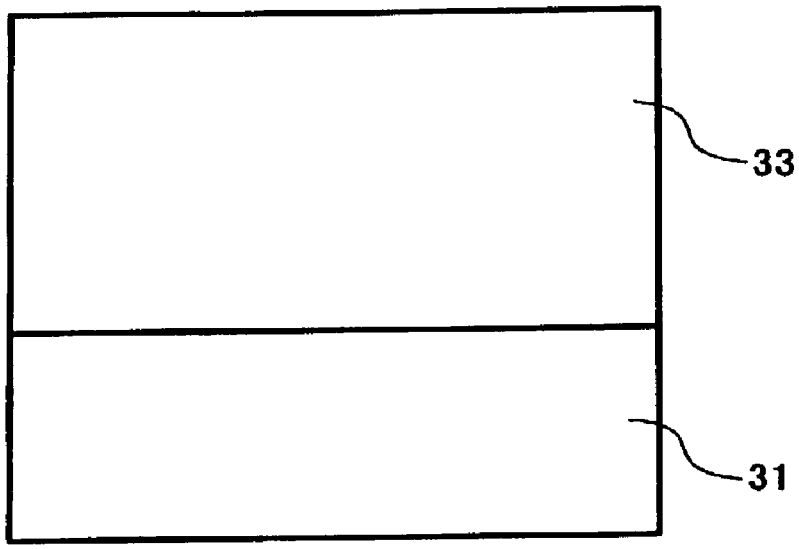
FIG. 1 is a schematic view illustrating a cross section of a surface of an embodiment of the photoreceptor of the present invention, having a photosensitive layer on an electroconductive substrate.

Generally, the present invention provides an electrophotographic photoreceptor having high durability and producing high quality images, and stably producing high quality images even after a repeated use.

In addition, the present invention provides an image forming method, an image forming apparatus and a process cartridge for an image forming apparatus using the photoreceptor.

Hereinafter, details of the electrophotographic photoreceptor, image forming method, image forming apparatus and process cartridge for an image forming apparatus of the present invention will be explained.

First, details of the above-mentioned compounds having the formulae (1) to (22), which are included in the photosensitive layer of the present invention will be explained.

Specific examples of the alkyl group mentioned in the explanations of these formulae (1) to (22) include a methyl group, an ethyl group, a propyl group, a butyl group, a hexyl group, an undecanyl group, etc. Specific examples of the aromatic ring group include an aromatic hydrocarbon ring group having 1 to 6 valences such as benzene, naphthalene, anthracene and pyrene; and an aromatic heterocyclic ring group having 1 to 6 valences such as pyridine, quinoline, thiophene, furan, oxazole, oxadiazole and carbazole. In addition, specific examples of their substituents include the above-mentioned specific examples of the alkyl group; an alkoxy group such as a methoxy group, an ethoxy group, a propoxy group and a butoxy group; a halogen atoms such as a fluorine atom, a chlorine atom, a bromine atom and an iodine atom; and an aromatic ring group.

Further, specific examples of the heterocyclic ring group including the nitrogen atom to which they are attached, formed by a combination of $R^1$ and $R^2$ include a pyrrolidinyl group, a piperidinyl group, a pyrrolinyl group, etc. Specific example of the heterocyclic group including the nitrogen atom to which they are attached, formed by the two groups together include an aromatic heterocyclic ring group such as N-methylcarbazole, N-ethylcarbazole, N-phenylcarbazole, indole and quinoline.

Hereinafter, preferred embodiments of the compounds having the formulae (1) to (22) will be respectively shown in Tables 1 to 22, but they are not limited thereto.

TABLE 1

| No. | Compound Examples |
|---|---|
| 1–1 | 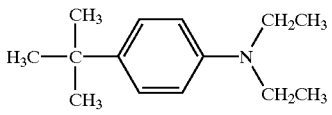 |

TABLE 1-continued
| No. | Compound Examples |
|---|---|
| 1–2 | 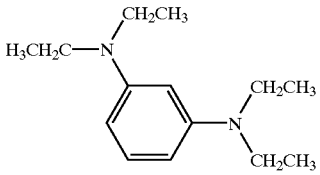 |
| 1–3 | 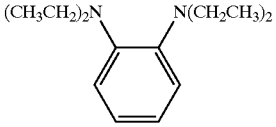 |
| 1–4 | 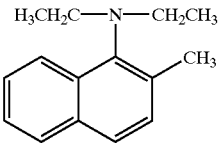 |
| 1–5 | 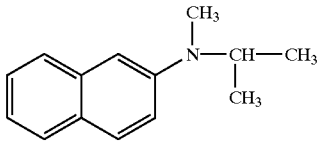 |
| 1–6 | 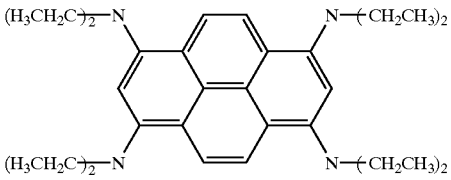 |
| 1–7 | 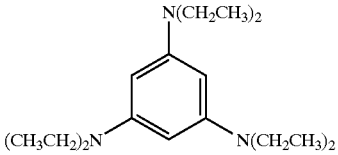 |
TABLE 2
| No. | Compound Examples |
|---|---|
| 2–1 | 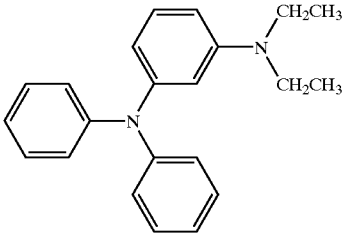 |
TABLE 2-continued
| No. | Compound Examples |
|---|---|
| 2–2 | 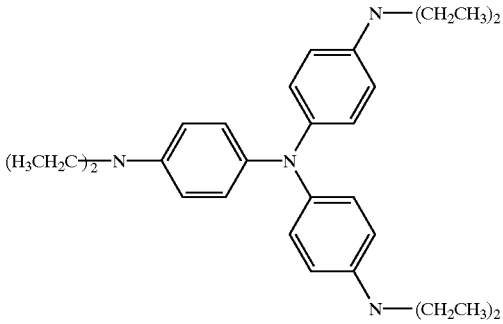 |
| 2–3 | 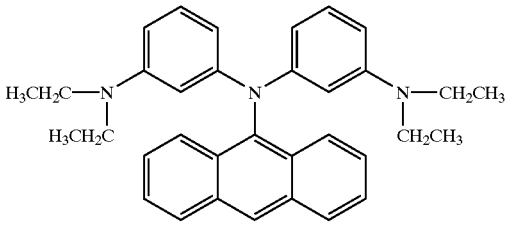 |
| 2–4 | 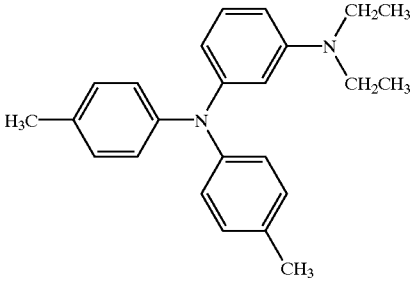 |
| 2–5 | 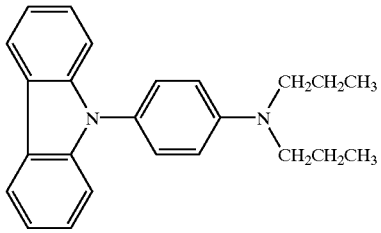 |

TABLE 3
| No. | Compound Examples |
|---|---|
| 3-1 | 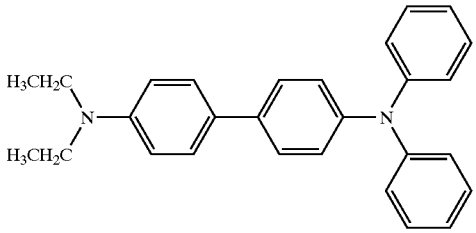 |
| 3-2 | 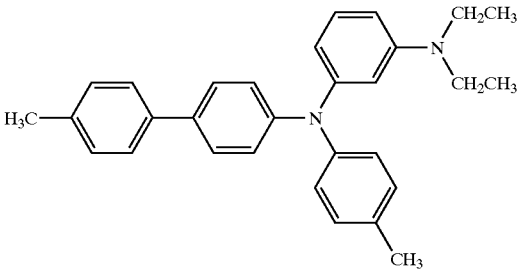 |
| 3-3 | 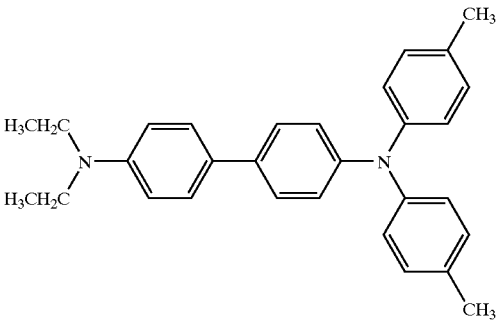 |
| 3-4 | 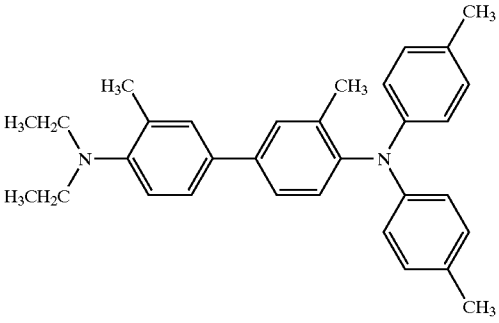 |
TABLE 3-continued
| No. | Compound Examples |
|---|---|
| 3-5 | 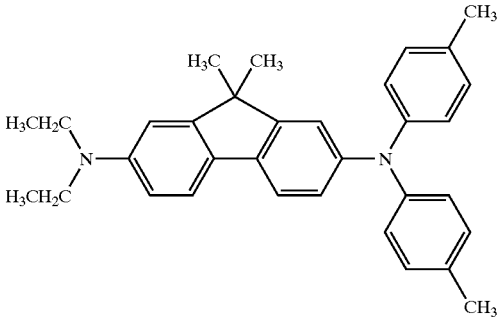 |
| 3-6 | 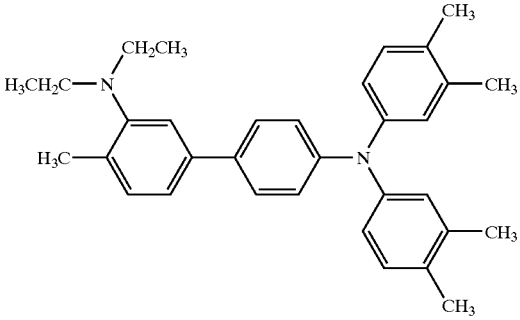 |
| 3-7 | 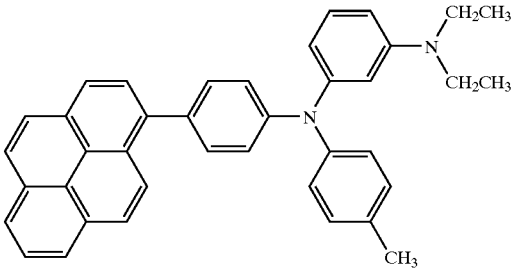 |

TABLE 4
| No. | Compound Examples |
|---|---|
| 4-1 | 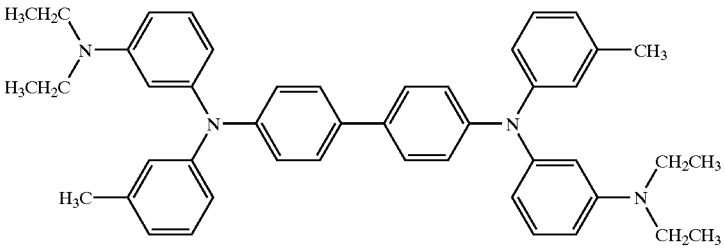 |
| 4-2 | 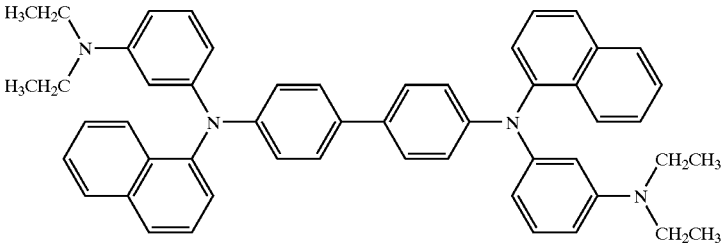 |
| 4-3 | 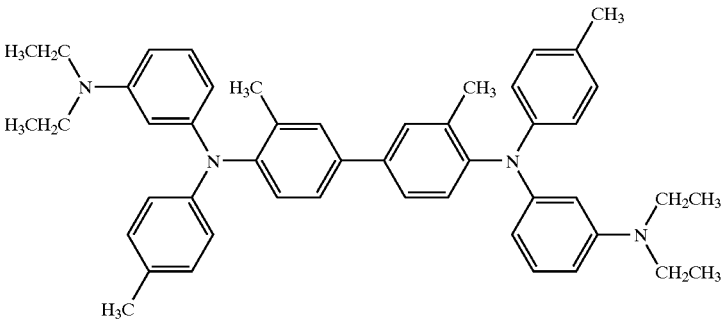 |
| 4-4 | 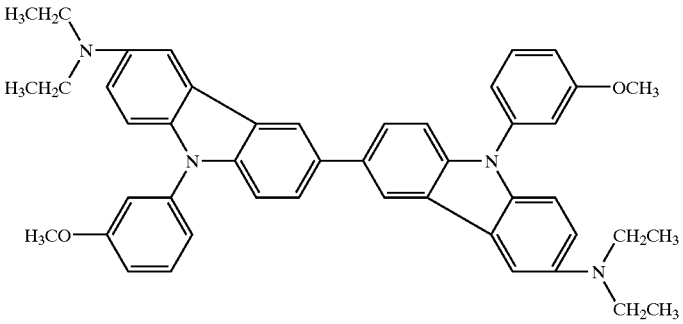 |
| 4-5 | 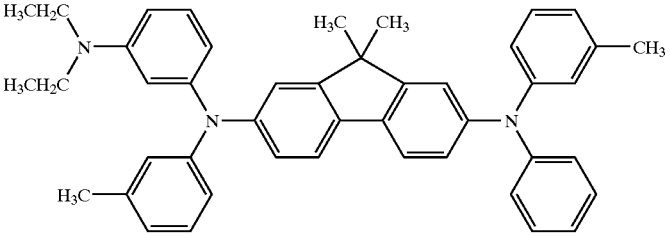 |

TABLE 4-continued
| No. | Compound Examples |
|---|---|
| 4-6 | 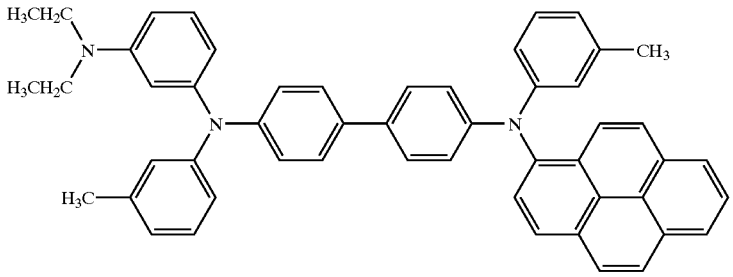 |
TABLE 5
| No. | Compound Examples |
|---|---|
| 5-1 | 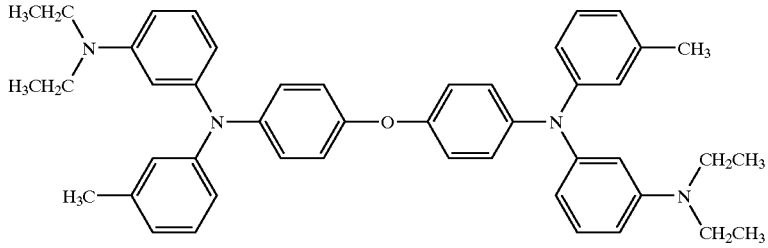 |
| 5-2 | 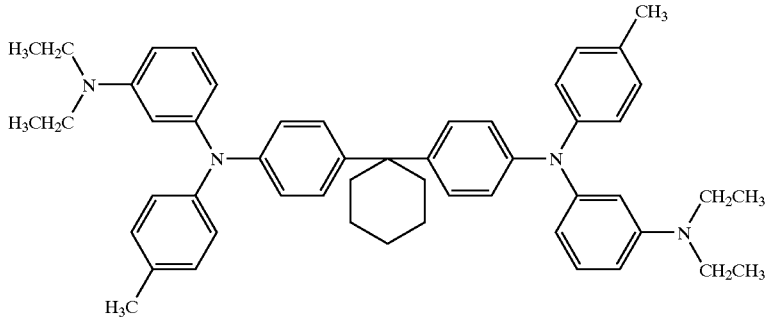 |
| 5-3 | 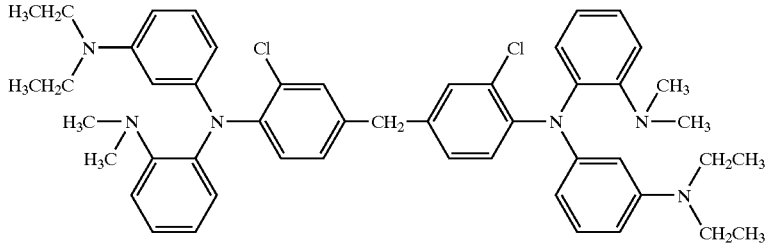 |

TABLE 6
| No. | Compound Examples |
|---|---|
| 6-1 | 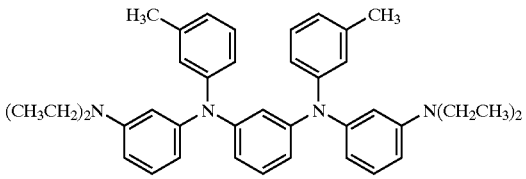 |
| 6-2 | 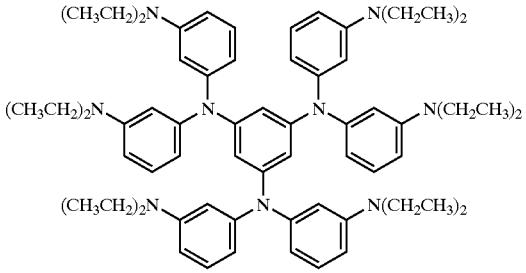 |
| 6-3 | 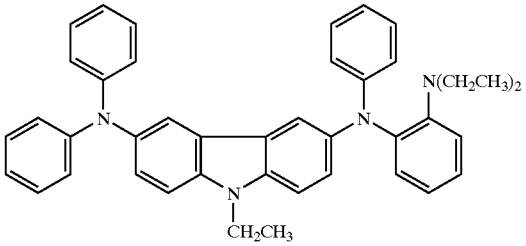 |
TABLE 7
| No. | Compound Examples |
|---|---|
| 7-1 | 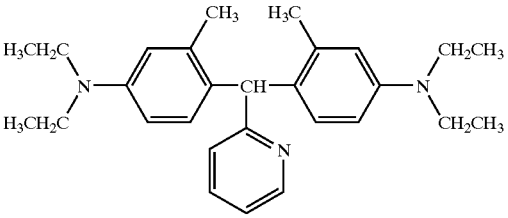 |
| 7-2 | 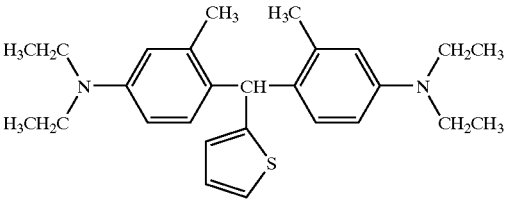 |
| 7-3 | 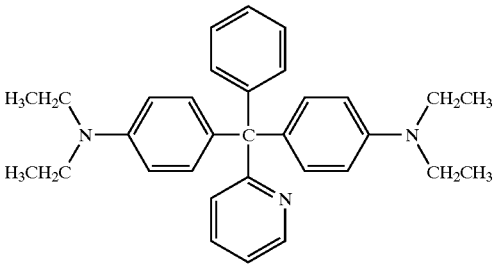 |
TABLE 7-continued
| No. | Compound Examples |
|---|---|
| 7-4 | 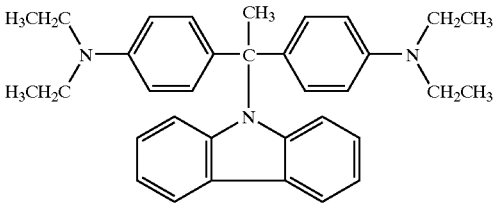 |
TABLE 8
| No. | Compound Examples |
|---|---|
| 8-1 | 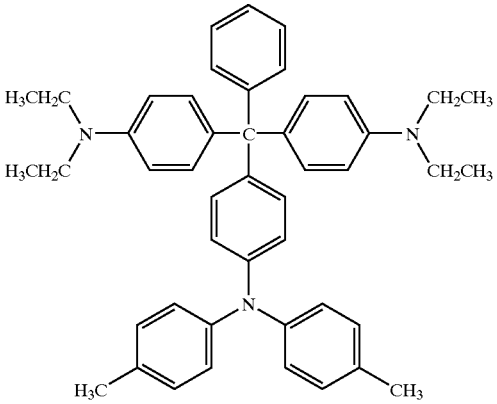 |
| 8-2 | 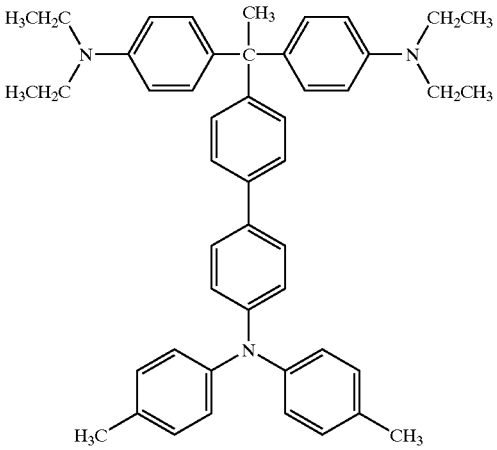 |

TABLE 8-continued
| No. | Compound Examples |
|---|---|
| 8-3 | 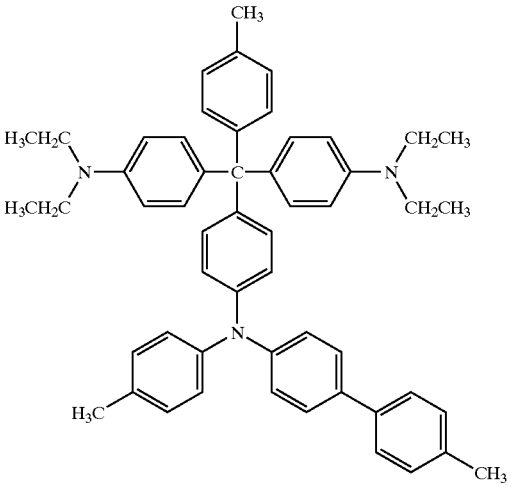 |
| 8-4 | 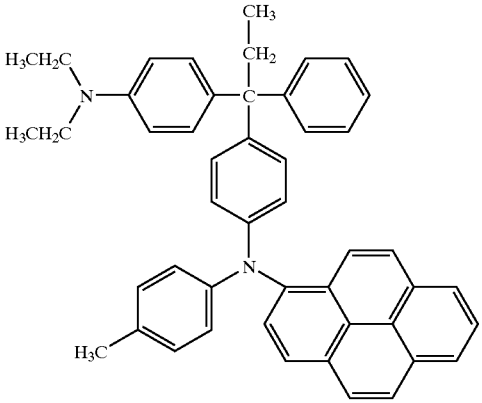 |
TABLE 8-continued
| No. | Compound Examples |
|---|---|
| 8-5 | 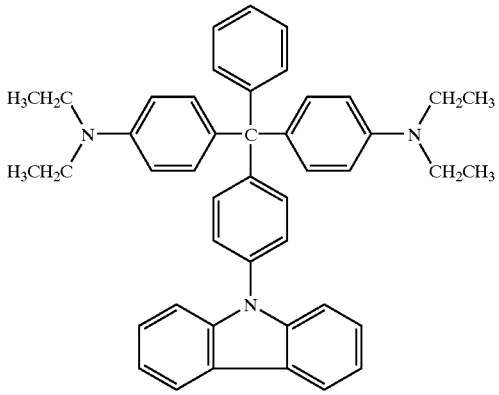 |
| 8-6 | 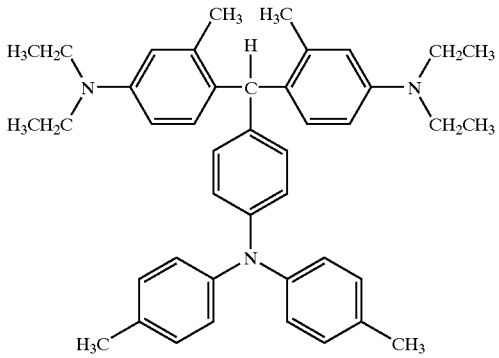 |
TABLE 9
| No. | Compound Examples |
|---|---|
| 9-1 | 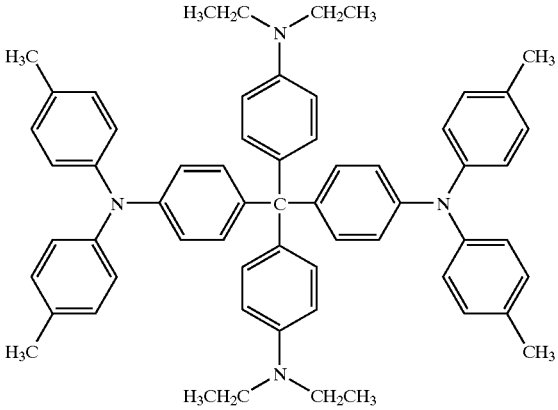 |

TABLE 9-continued
| No. | Compound Examples |
|---|---|
| 9-2 | 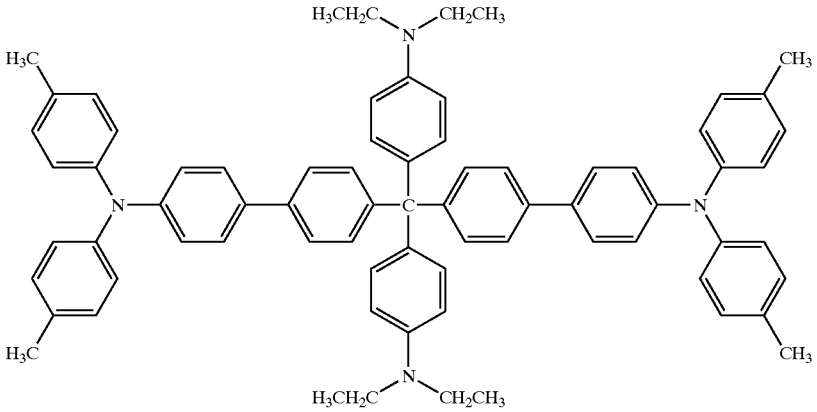 |
| 9-3 | 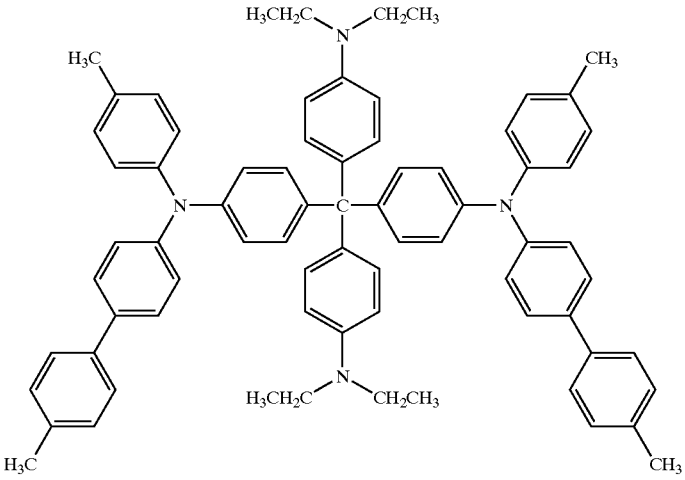 |
| 9-4 | 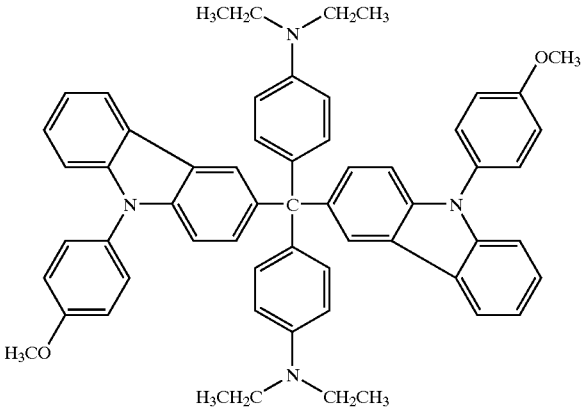 |

TABLE 10
| No. | Compound Examples |
|---|---|
| 10-1 | 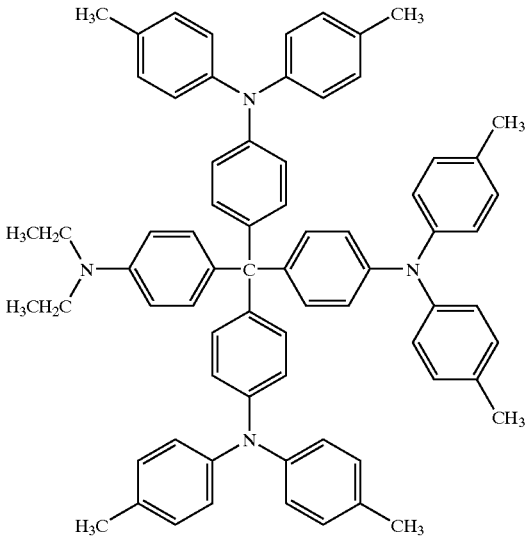 |
| 10-2 | 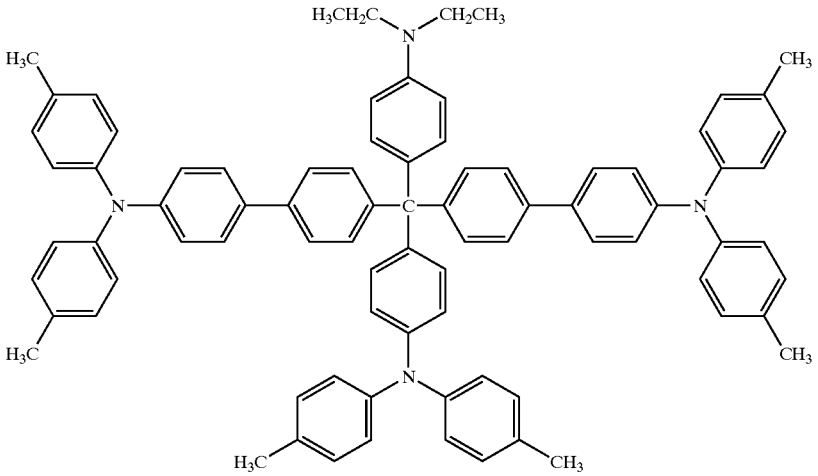 |

TABLE 10-continued
| No. | Compound Examples |
|---|---|
| 10-3 | 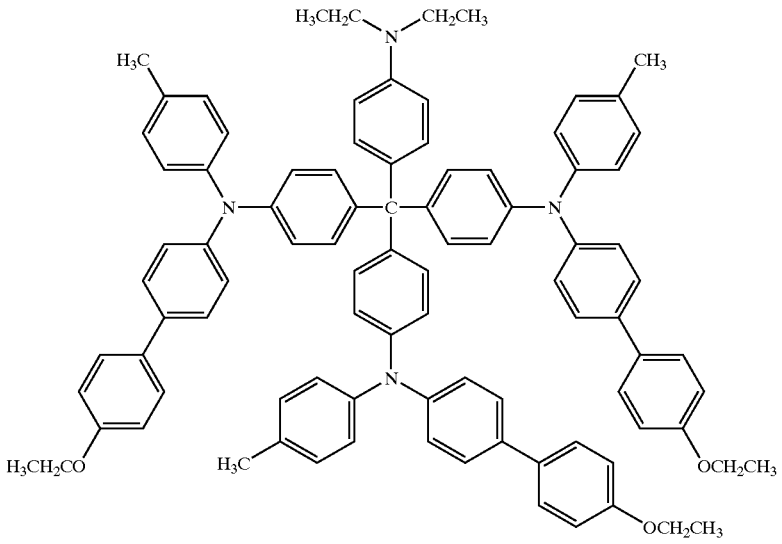 |
| 10-4 | 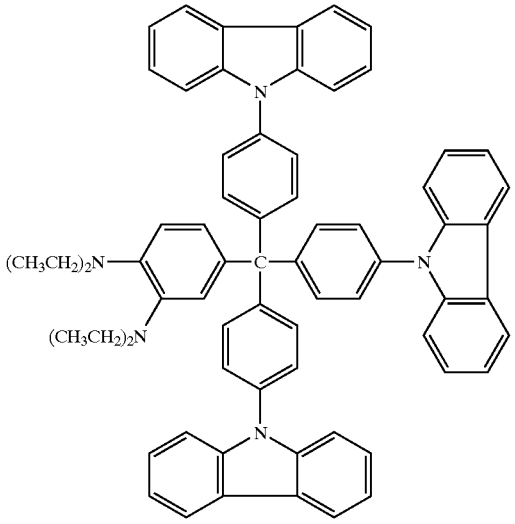 |

TABLE 11
| No. | Compound Examples |
|---|---|
| 11-1 | 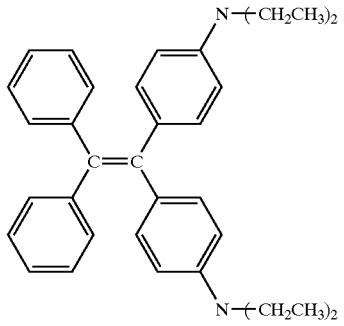 |
| 11-2 | 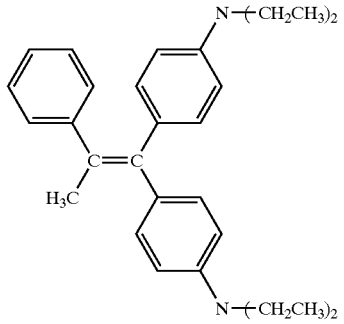 |
| 11-3 | 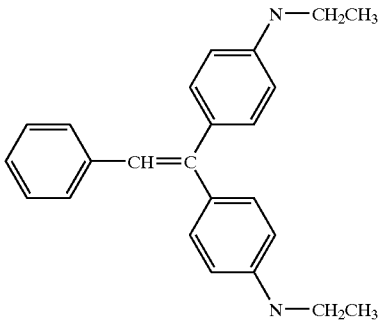 |
| 11-4 | 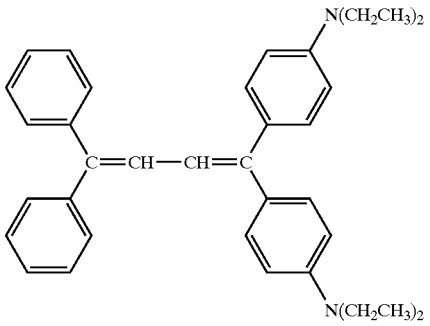 |
TABLE 11-continued
| No. | Compound Examples |
|---|---|
| 11-5 | 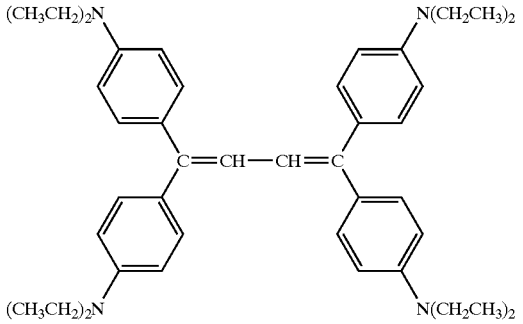 |
TABLE 12
| No. | Compound Examples |
|---|---|
| 12-1 | 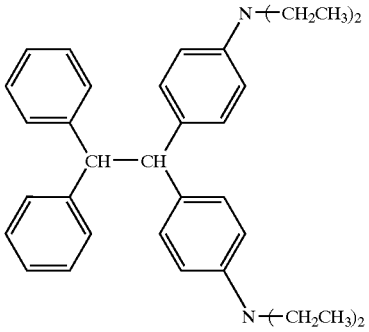 |
| 12-2 | 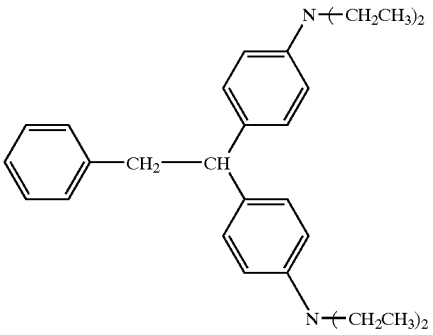 |
| 12-3 | 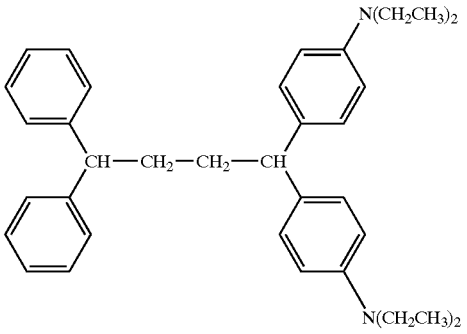 |

TABLE 12-continued
| No. | Compound Examples |
|---|---|
| 12-4 | 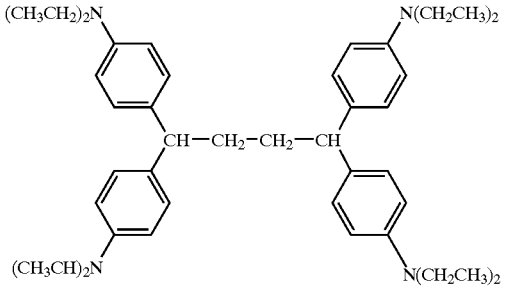 |
TABLE 13
| No. | Compound Examples |
|---|---|
| 13-1 | 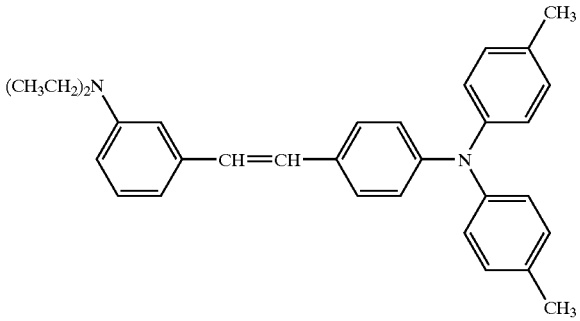 |
| 13-2 | 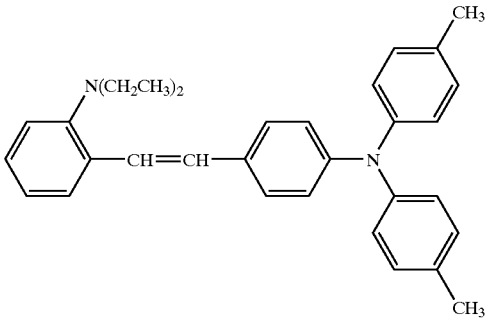 |
| 13-3 | 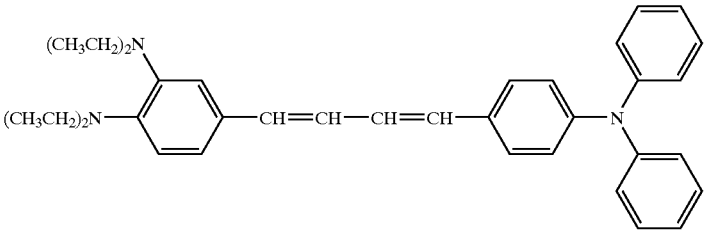 |

TABLE 13-continued
| No. | Compound Examples |
|---|---|
| 13-4 | 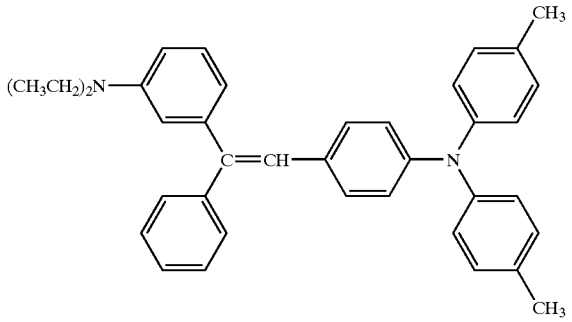 |
| 13-5 | 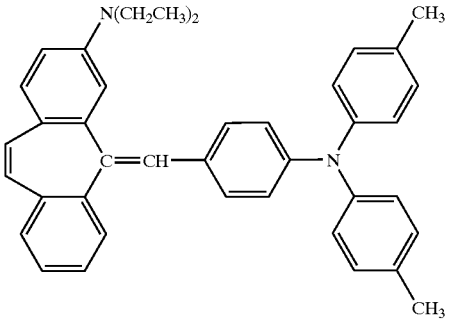 |
| 13-6 | 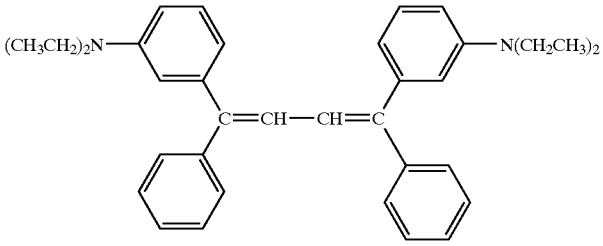 |
TABLE 14
| No. | Compound Examples |
|---|---|
| 14-1 | 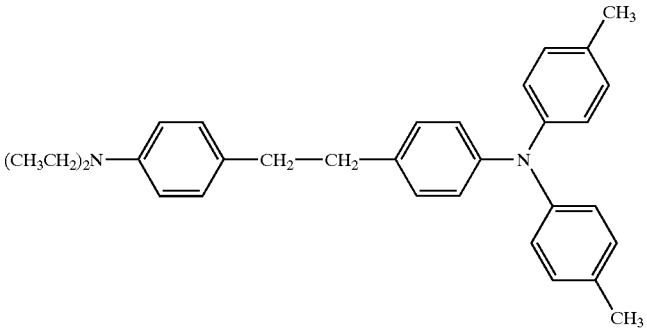 |

TABLE 14-continued
| No. | Compound Examples |
|---|---|
| 14-2 | 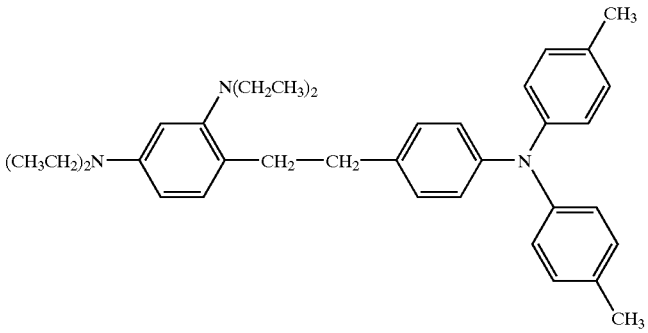 |
| 14-3 | 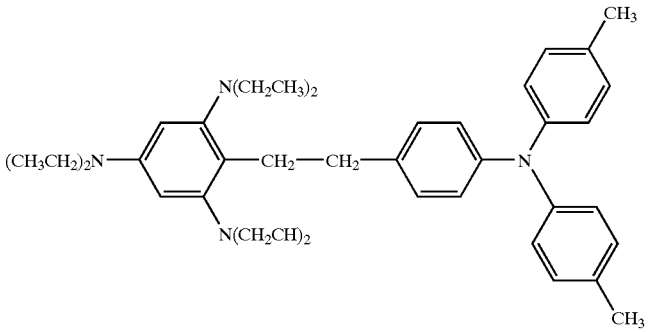 |
| 14-4 | 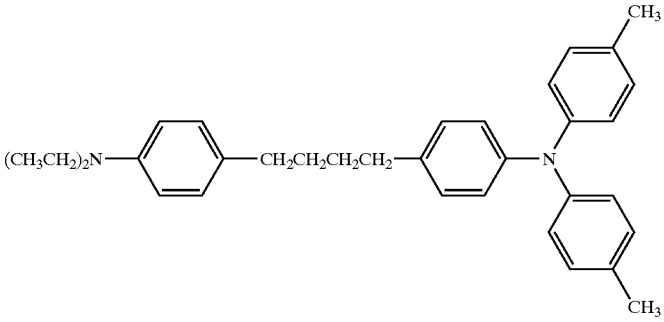 |
| 14-5 | 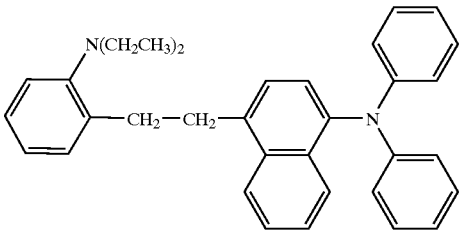 |
| 14-6 | 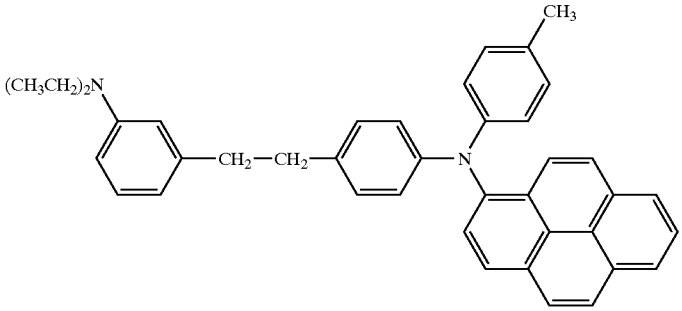 |

TABLE 14-continued
| No. | Compound Examples |
|---|---|
| 14-7 | 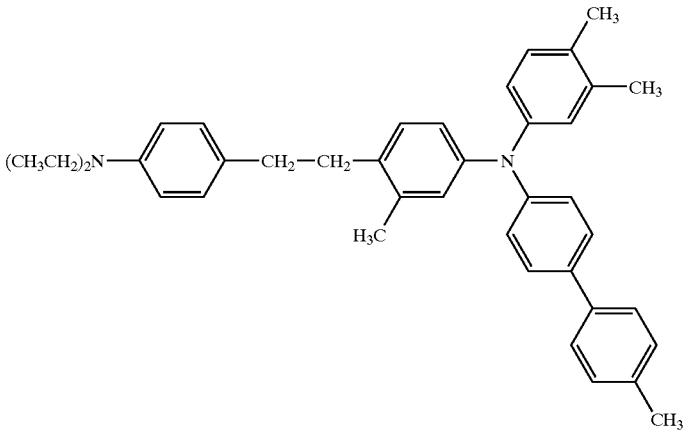 |
| 14-8 | 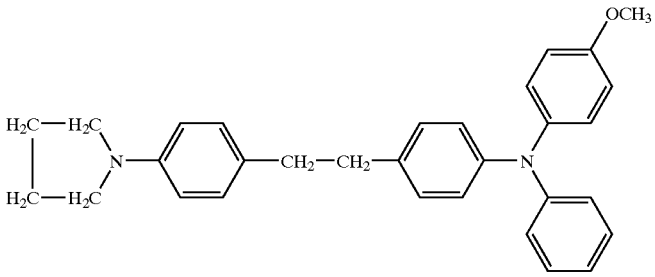 |
| 14-9 | 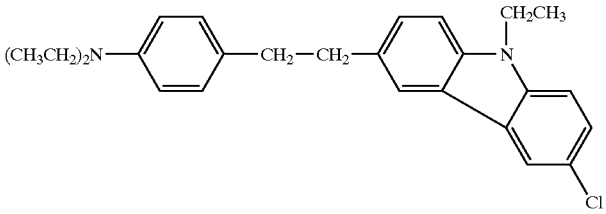 |
| 14-10 | 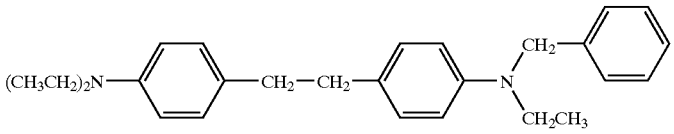 |
| 14-11 | 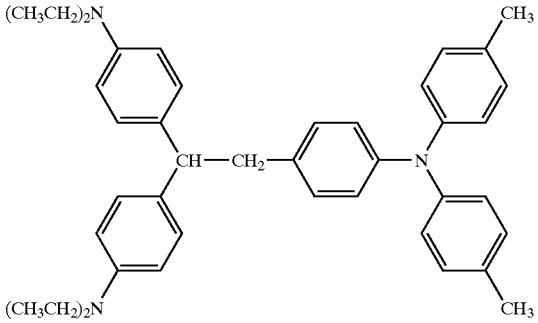 |

TABLE 14-continued
| No. | Compound Examples |
|---|---|
| 14-12 | 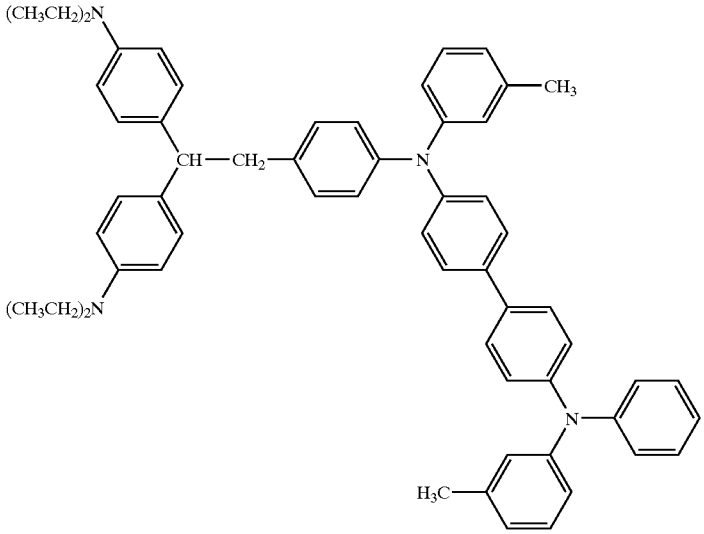 |
| 14-13 | 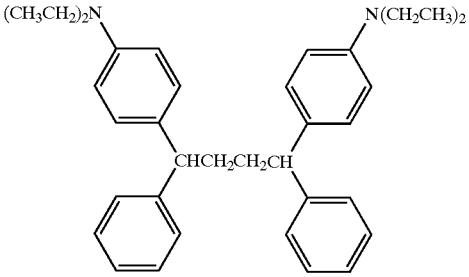 |
TABLE 15
| No. | Compound Examples |
|---|---|
| 15-1 | 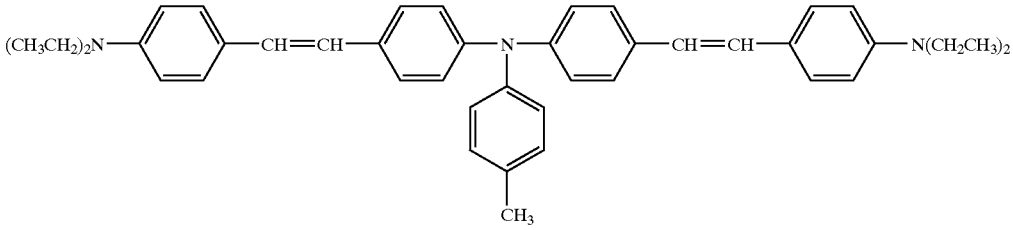 |
| 15-2 | 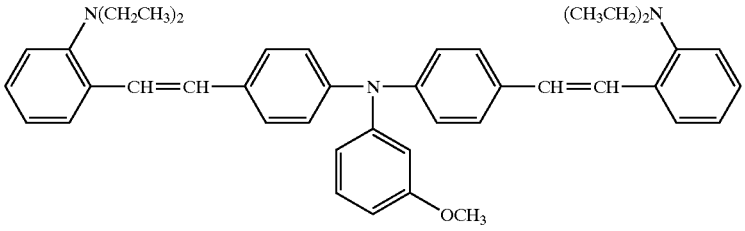 |

TABLE 15-continued
| No. | Compound Examples |
|---|---|
| 15-3 | 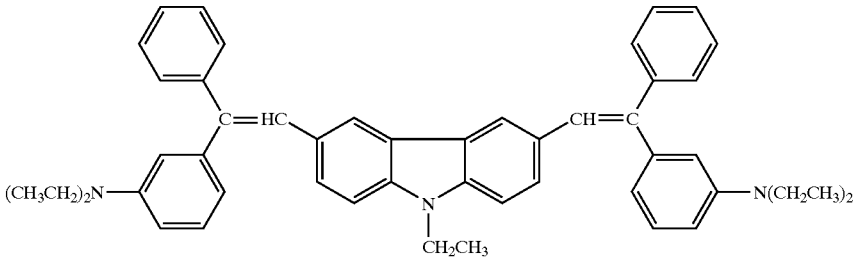 |
| 15-4 | 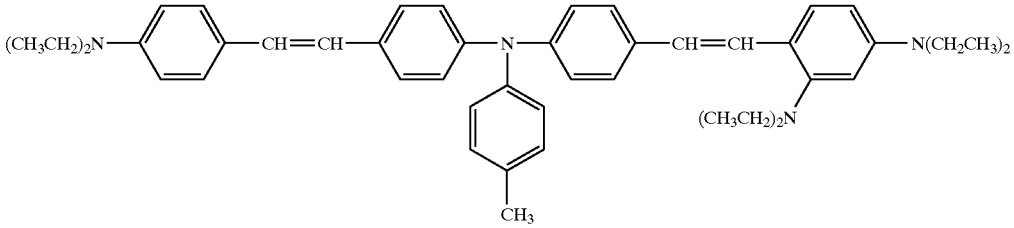 |
| 15-5 | 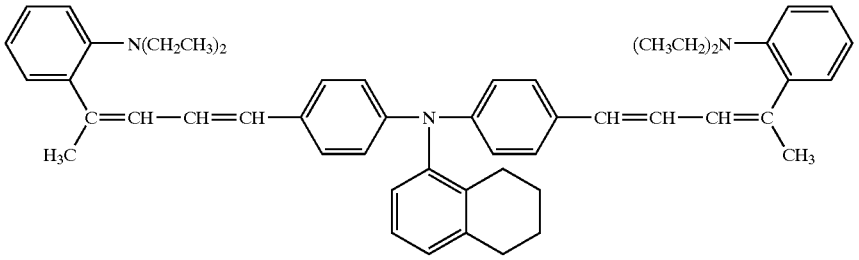 |
| 15-6 | 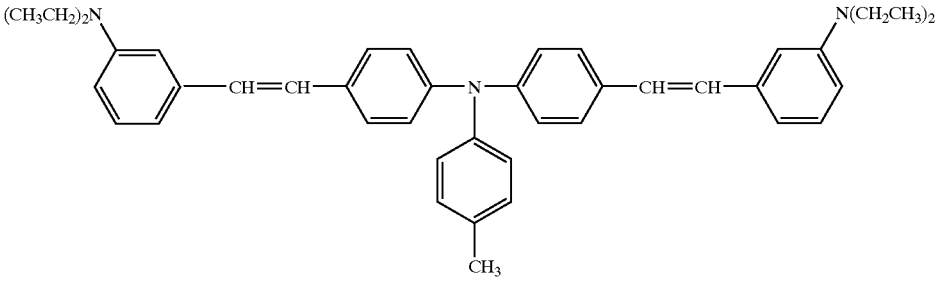 |
TABLE 16
| No. | Compound Examples |
|---|---|
| 16-1 | 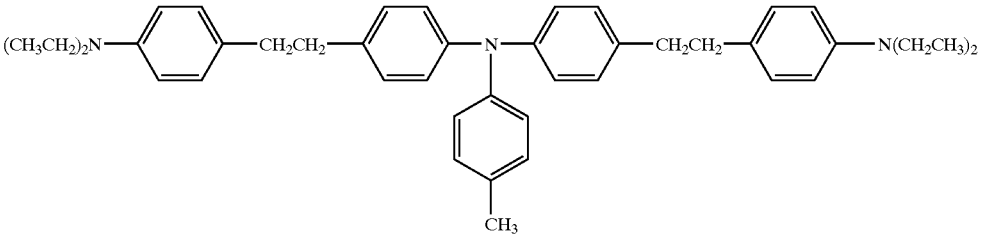 |

TABLE 16-continued
| No. | Compound Examples |
|---|---|
| 16-2 | 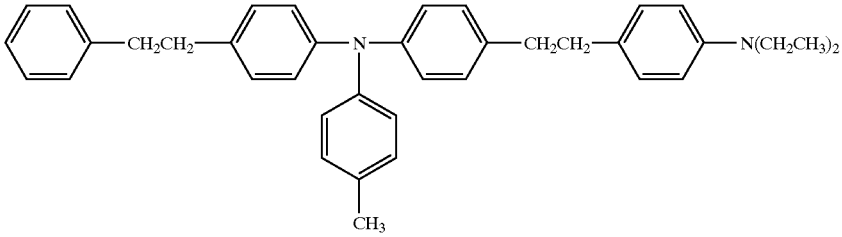 |
| 16-3 | 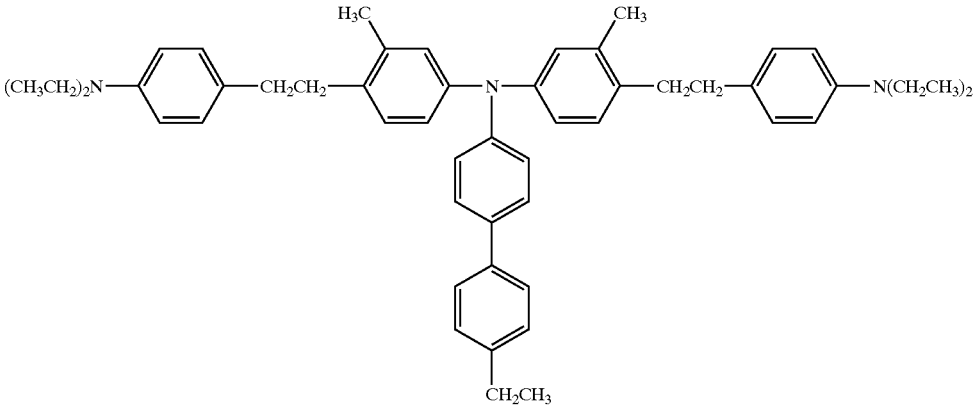 |
| 16-4 | 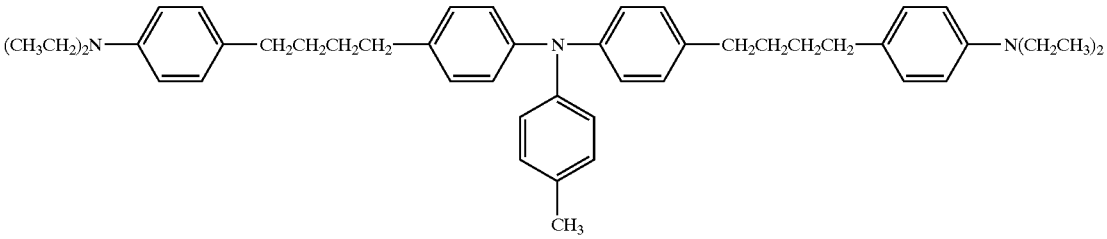 |
| 16-5 | 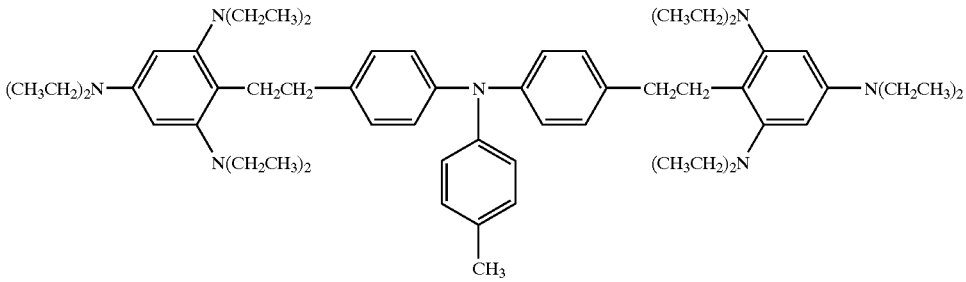 |
| 16-6 | 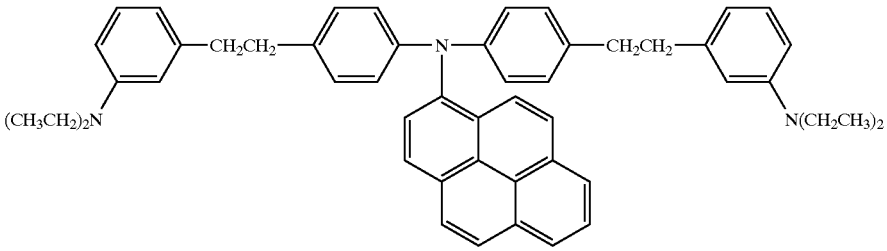 |

TABLE 16-continued
| No. | Compound Examples |
|---|---|
| 16-7 | 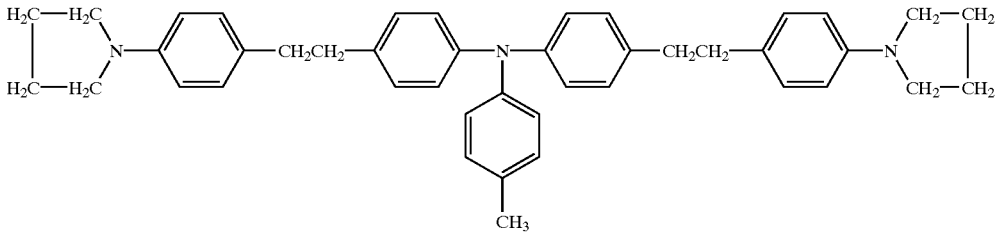 |
| 16-8 | 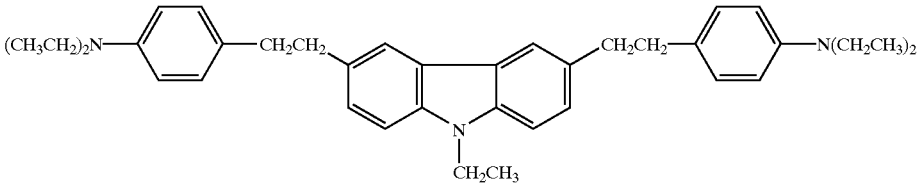 |
| 16-9 | 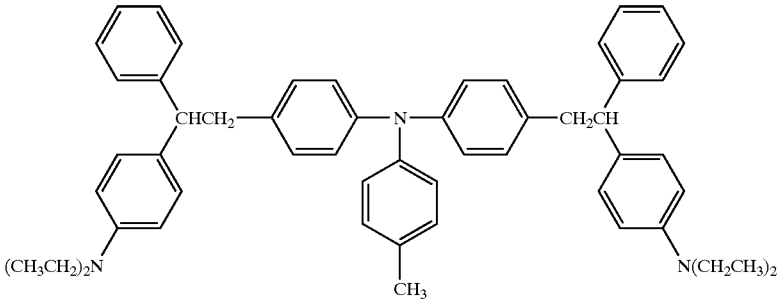 |
| 16-10 | 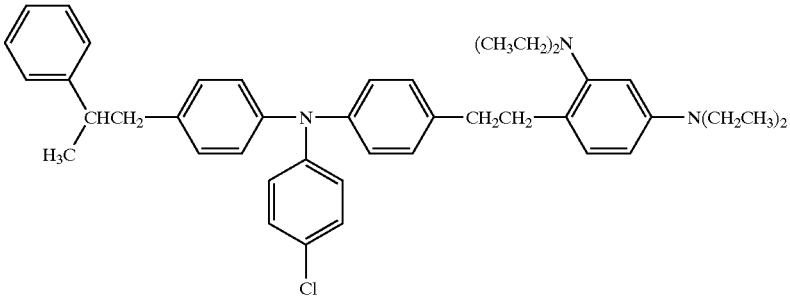 |
| 16-11 | 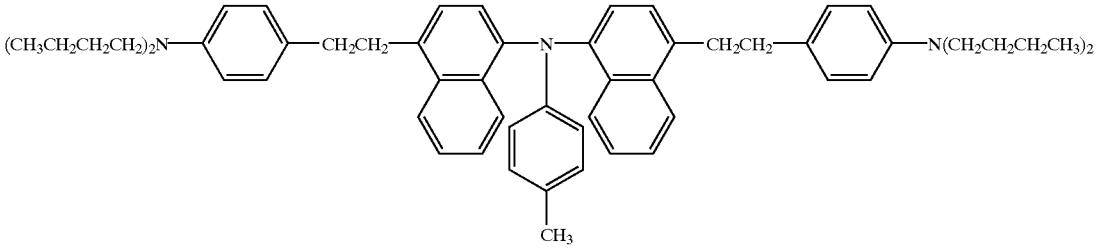 |

TABLE 16-continued
| No. | Compound Examples |
|---|---|
| 16-12 | 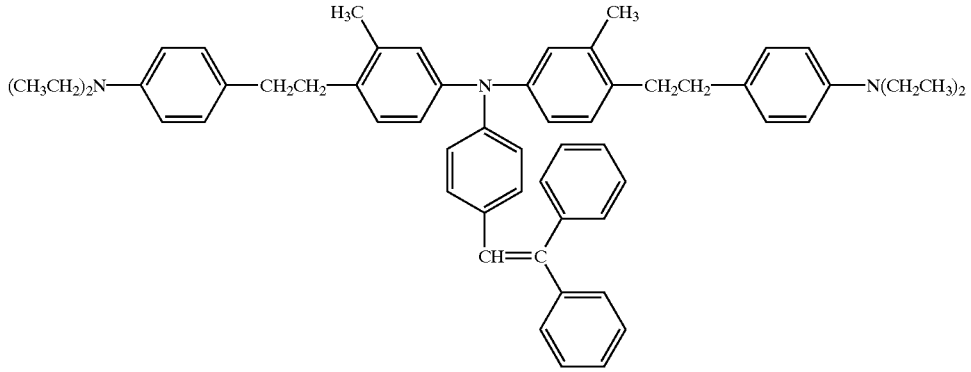 |
TABLE 17
| No. | Compound Examples |
|---|---|
| 17-1 | 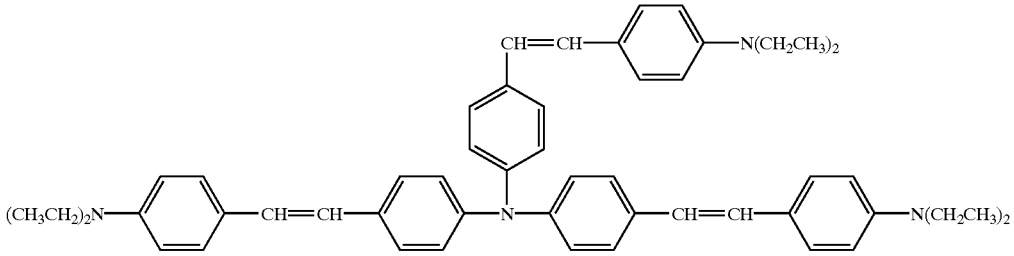 |
| 17-2 | 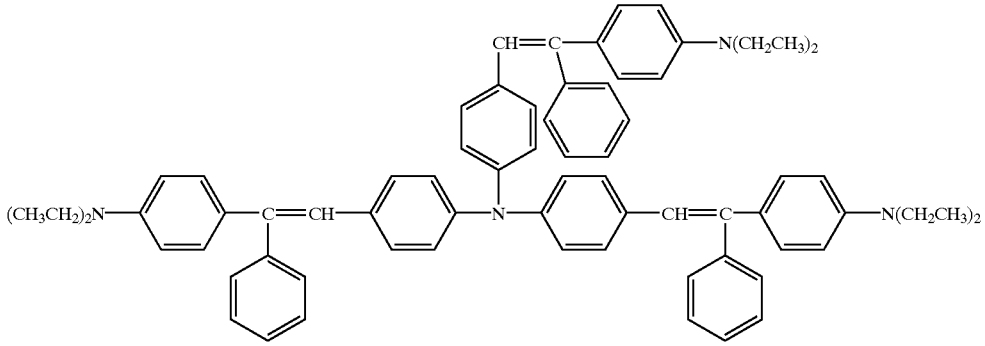 |
| 17-3 | 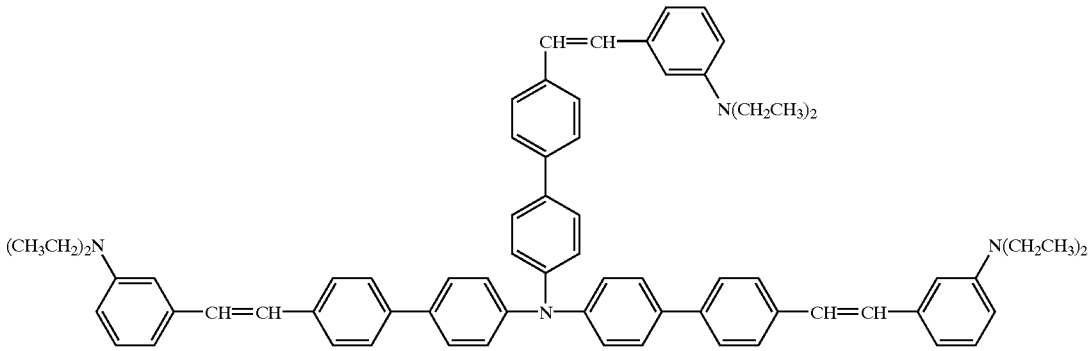 |

TABLE 18
| No. | Compound Examples |
|---|---|
| 18-1 | 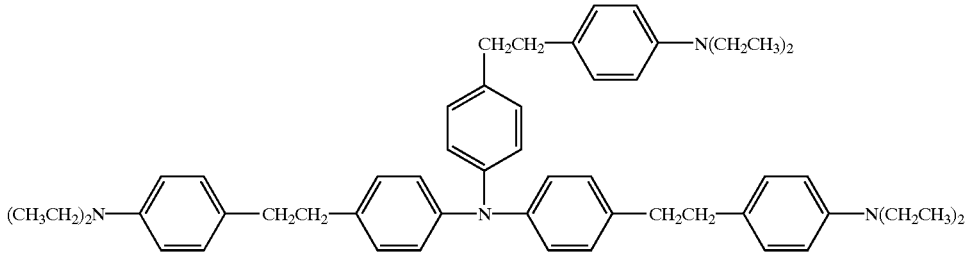 |
| 18-2 | 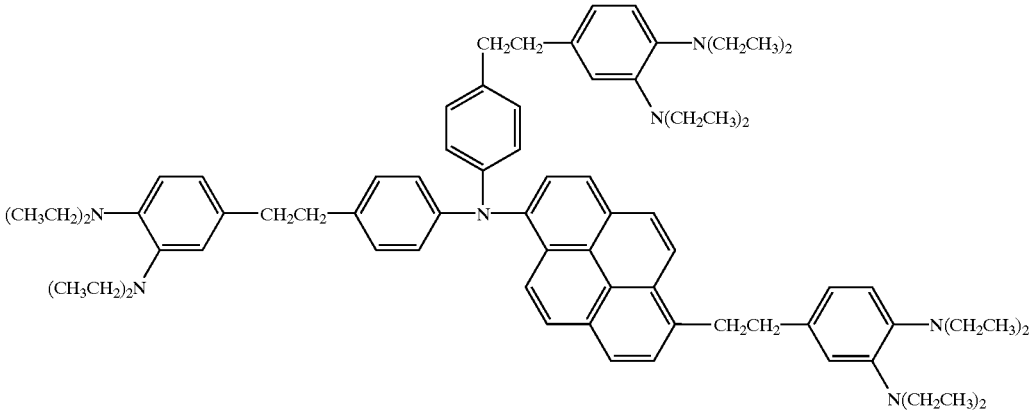 |
| 18-3 | 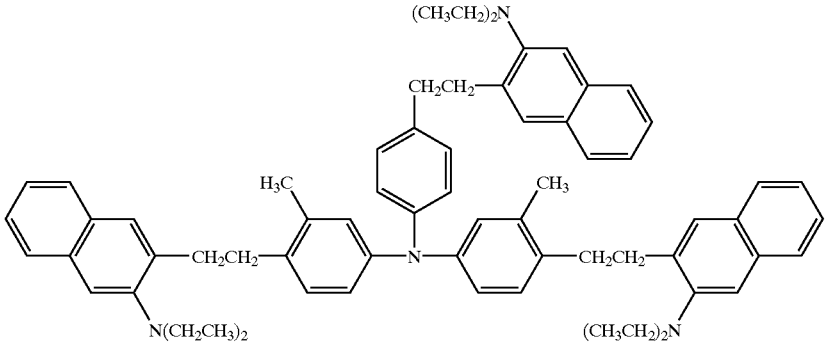 |
| 18-4 | 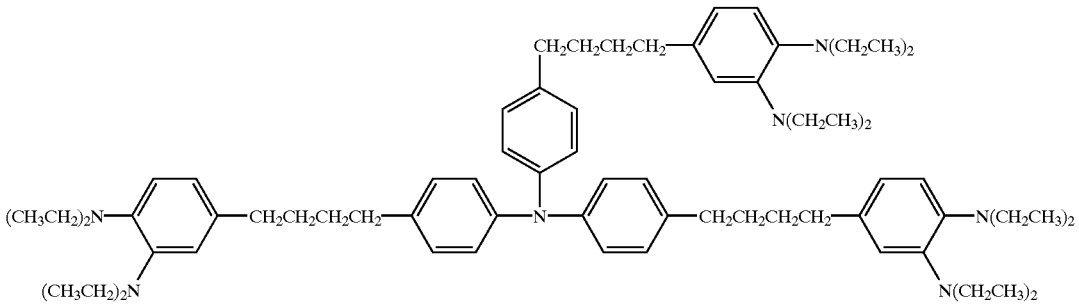 |

TABLE 19
| No. | Compound Examples |
|---|---|
| 19-1 | 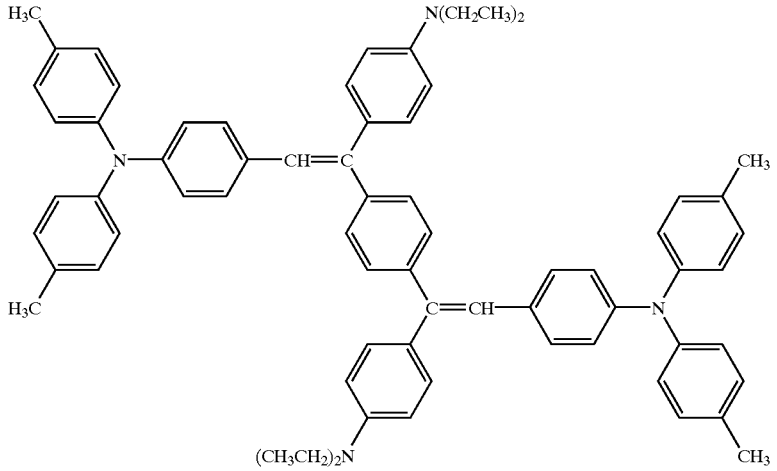 |
| 19-2 | 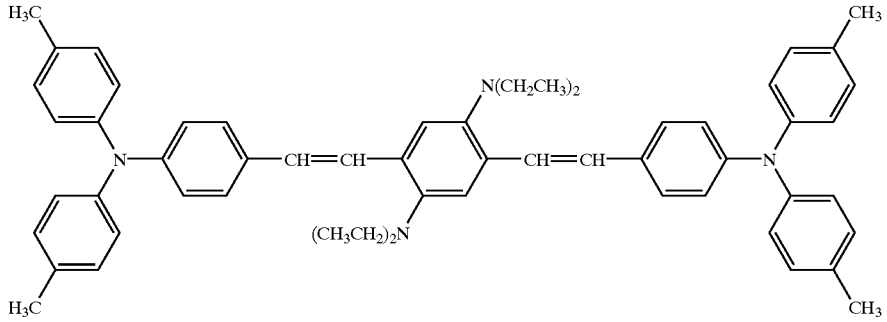 |
| 19-3 | 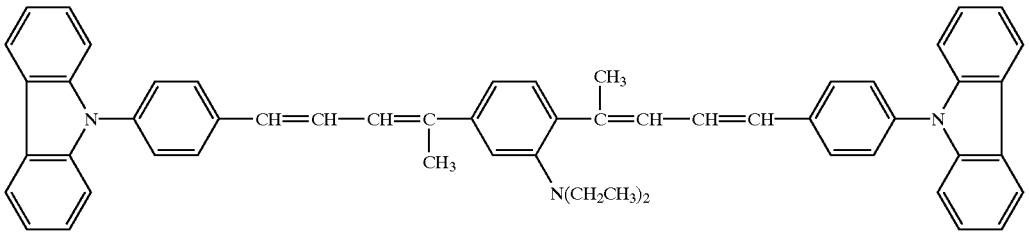 |
TABLE 20
| No. | Compound Examples |
|---|---|
| 20-1 | 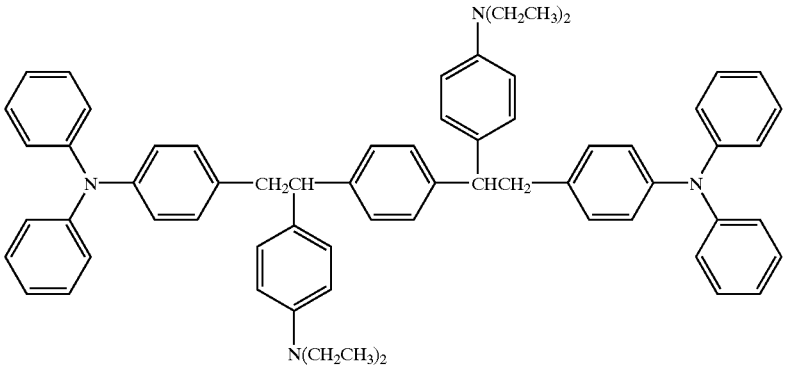 |

TABLE 20-continued
| No. | Compound Examples |
|---|---|
| 20-2 | 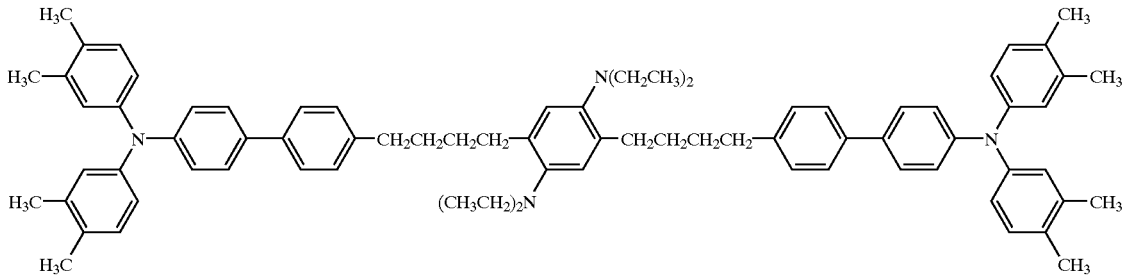 |
TABLE 21
| No. | Compound Examples |
|---|---|
| 21-1 | 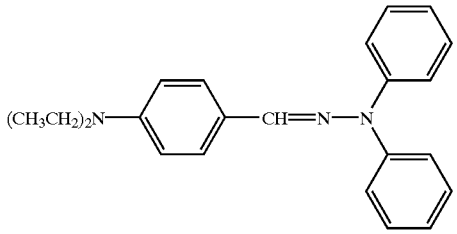 |
| 21-2 | 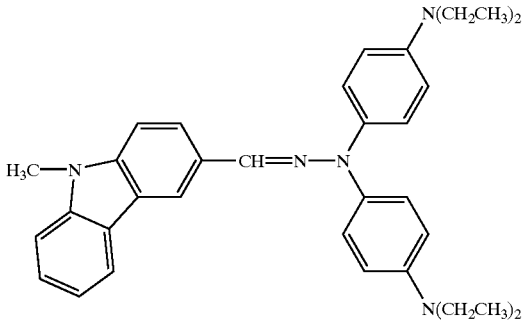 |
| 21-3 | 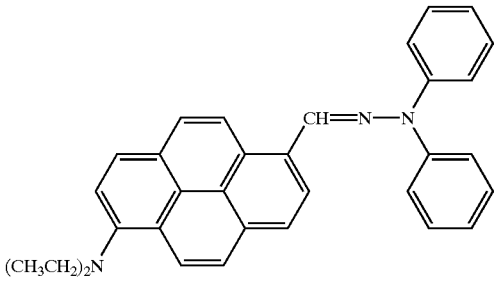 |
| 21-4 | 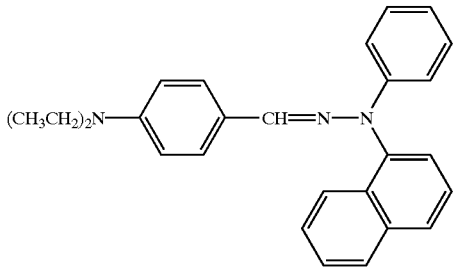 |

TABLE 21-continued

| No. | Compound Examples |
|---|---|
| 21-5 | 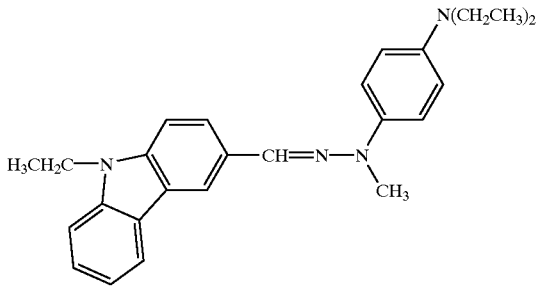 |
| 21-6 | 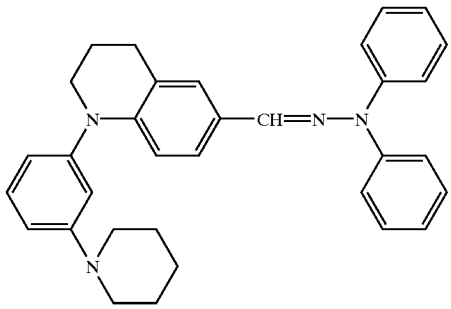 |

TABLE 22

| No. | Compound Examples |
|---|---|
| 22-1 | 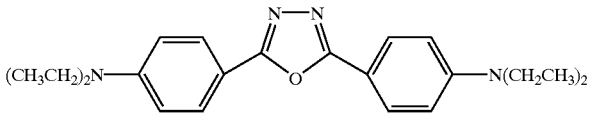 |
| 22-2 | 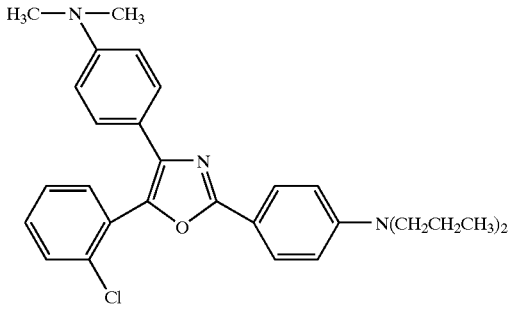 |
| 22-3 | 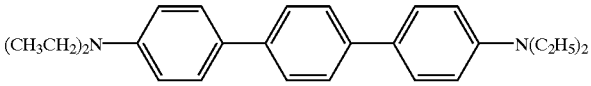 |

Next, layer composition of the photoreceptor of the present invention will be explained.

FIG. 1 is a schematic view illustrating a cross section of a surface of an embodiment of the photoreceptor of the present invention, in which a photosensitive layer 33 including a CGM and a CTM as the main components is formed on an electroconductive substrate 31.

Figure 2:
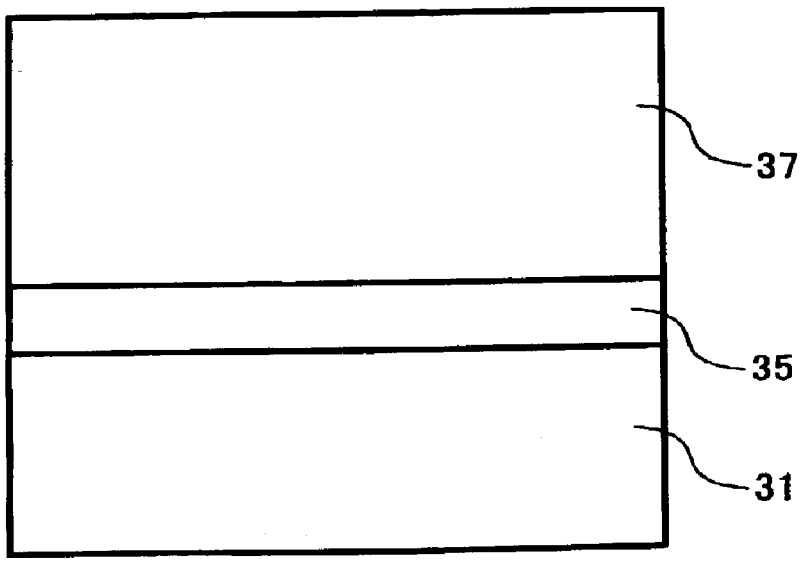
FIG. 2 is a schematic view illustrating a cross section of a surface of another embodiment of the photoreceptor of the present invention, having a CGL and a CTL overlying the CGL on an electroconductive substrate.

In FIG. 2, a CGL 35 including a CGM as the main component overlies a CTL 37 including a CTM as the main component on an electroconductive substrate 31.

Figure 3:
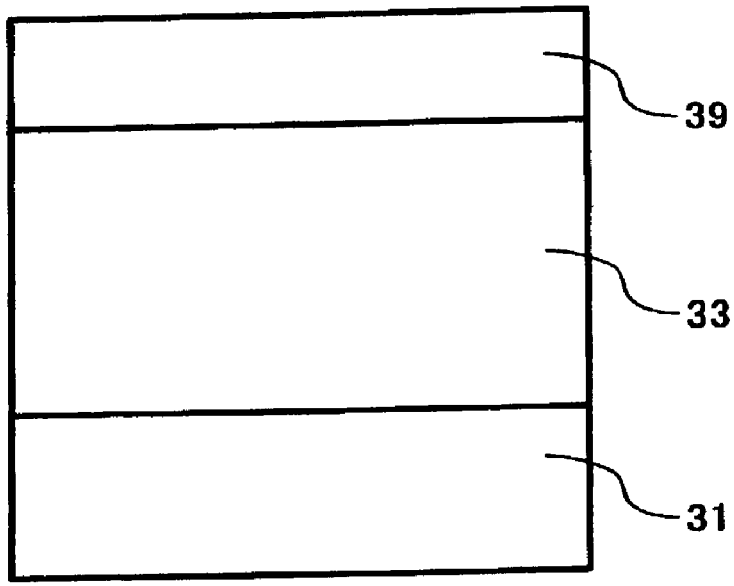
FIG. 3 is a schematic view illustrating a cross section of a surface of another embodiment of the photoreceptor of the present invention, having a surface protection layer overlying a photosensitive layer on an electroconductive substrate.

In FIG. 3, a photosensitive layer 33 including a CGM and a CTM as the main components is formed on an electroconductive substrate 31, and further a protection layer 39 is formed on a surface of the photosensitive layer. In this case, the protection layer 39 may include an amine compound of the present invention.

Figure 4:
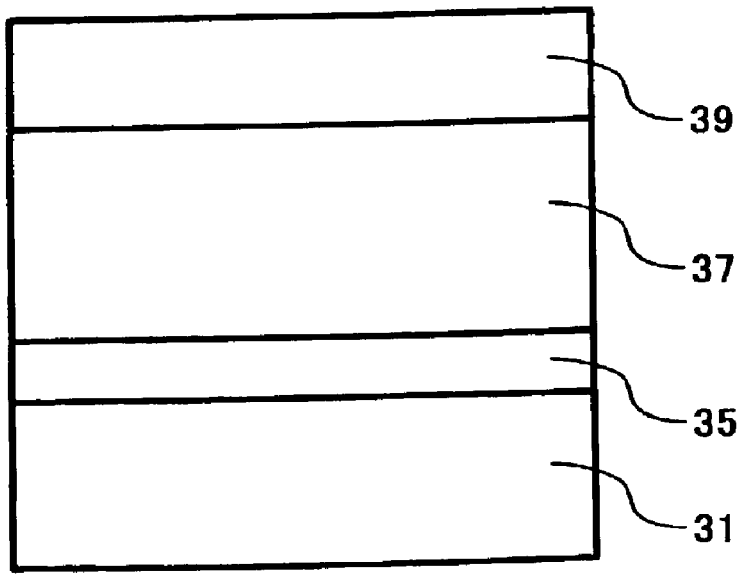
FIG. 4 is a schematic view illustrating a cross section of a surface of another embodiment of the photoreceptor of the present invention, having a CGL, a CTL overlying the CGL and a surface protection layer overlying the CTL on an electroconductive substrate.

In FIG. 4, a CGL 35 including a CGM as the main component, a CTL 37 including a CTM as the main component overlying the CGL, and further a protection layer 39 overlying the CTL are formed on an electroconductive substrate 31. In this case, the protection layer 39 may include an amine compound of the present invention.

Figure 5:
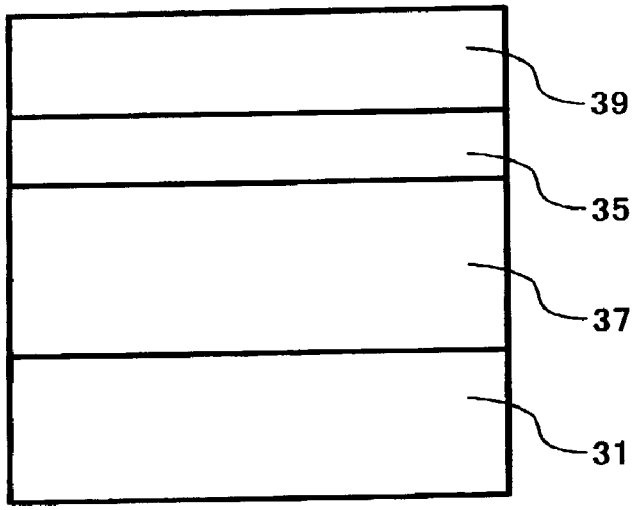
FIG. 5 is a schematic view illustrating a cross section of a surface of another embodiment of the photoreceptor of the present invention, having a CTL, a CGL overlying the CTL and a surface protection layer overlying the CGL on an electroconductive substrate.

In FIG. 5, a CTL 37 including a CTM as the main component, a CGL 35 including a CGM as the main component overlying the CTL, and further a protection layer 39 overlying the CGL are formed on an electroconductive substrate 31. In this case, the protection layer 39 may include an amine compound of the present invention.

Suitable materials for use as the electroconductive substrate 31 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can be also used as the substrate. Further, endless belts of a metal such as nickel and stainless steel, which have been disclosed in Japanese Laid-Open Patent Publication No. 52-36016, can be also used as the electroconductive substrate 31.

Furthermore, substrates, in which a coating liquid including a binder resin and an electroconductive powder is coated on the supporters mentioned above, can be used as the substrate 31. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxyresins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can be also used as the substrate 31.

Next, the photosensitive layer of the present invention will be explained. In the present invention, the photosensitive layer may be single-layered or a multi-layered. At first, the multi-layered photosensitive layer including the CGL 35 and the CTL 37 will be explained for explanation convenience.

The CGL 35 is a layer including a CGM as the main component. Known CGMs can be used in the CGL 35. Specific examples of the CGM include azo pigments such as CI Pigment Blue 25 (color index CI 21180), CI Pigment Red 41 (CI 21200), CI Acid Red 52 (CI 45100), CI Basic Red 3 (CI 45210), an azo pigment having a carbazole skeleton disclosed in Japanese Laid-Open Patent Publication (JLPP) No. 53-95033, an azo pigment having a distyrylbenzene skeleton disclosed in JLPP No. 53-133445, an azo pigment having a triphenylamine skeleton disclosed in JLPP No. 53-132347, an azo pigment having a dibenzothiophene skeleton disclosed in JLPP No. 54-21728, an azo pigment having an oxadiazole skeleton disclosed in JLPP No. 54-12742, an azo pigment having a fluorenone skeleton disclosed in JLPP No. 54-22834, an azo pigment having a bisstilbene skeleton disclosed in JLPP No. 54-17733, an azo pigment having a distyryloxadiazole skeleton disclosed in JLPP No. 54-2129, an azo pigment having a distyrylcarbazole skeleton disclosed in JLPP No. 54-14967 and an azo pigment having a benzanthrone skeleton; phthalocyanine pigments such as CI Pigment Blue 16 (CI 74100), Y-type oxotitaniumphthalocyanine disclosed in JLPP No. 64-17066, A(β)-type oxotitaniumphthalocyanine, B(α)-type -type oxotitaniumphthalocyanine, I-type oxotitaniumphthalocyanine disclosed in JLPP No. 11-21466, II-type chlorogalliumphthalocyanine disclosed by Mr. Iijima and others in the $67^{th}$ spring edition 1B4, 04 published by Chemical Society of Japan in 1994, V-type hydroxygalliumphthalocyanine disclosed Mr. Daimon and others in the $67^{th}$ spring edition 1B4, 05 published by Chemical Society of Japan in 1994 and X-type metal-free phthalocyanine disclosed in U.S. Pat. No. 3,816,118; indigo pigments such as CI Vat Brown 5 (CI 73410) and CI Vat Dye (CI 73030); and perylene pigments such as Algo Scarlet B from Bayer AG and Indanthrene Scarlet R from Bayer AG. These materials can be used alone or in combination.

The CGL 35 can be prepared by dispersing a CGM in a proper solvent optionally together with a binder resin using a ball mill, an attritor, a sand mill or a supersonic dispersing machine, coating the coating liquid on an electroconductive substrate and then drying the coated liquid.

Specific example of the binder resins optionally used in the CGL 35, include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the CGL 35 is preferably from 0 to 500 parts by weight, and preferably from 10 to 300 parts by weight, per 100 parts by weight of the CGM. The binder resin can be included either before or after dispersion of the CGM in the solvent.

Specific examples of the solvent include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. These can be used alone or in combination.

The CGL 35 includes a CGM, a solvent and a binder rein as the main components. Any additives such as a sensitizer, a disperser, a detergent and a silicone oil can be included therein.

The coating liquid can be coated by a coating method such as dip coating, spray coating, bead coating, nozzle coating, spinner coating and ring coating. The thickness of the CGL 35 is preferably from 0.01 to 5 μm, and more preferably from 0.1 to 2 μm.

The CTL 37 is a layer including a CTM as the main component. The CTM is classified into a positive-hole transport material, an electron transport material and a polymer CTM, and will be explained below.

Specific examples of the positive-hole transport materials include poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives and compounds having the following formulae (23) to (40):

(23)

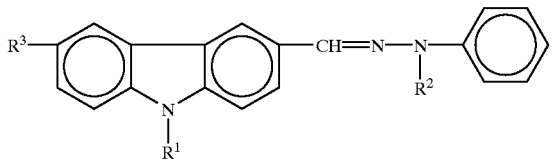

wherein $R^1$ represents a methyl group, an ethyl group, a 2-hydroxyethyl group or a 2-chlorethyl group; and $R^2$ represents a methyl group, an ethyl group, a benzyl group or a phenyl group; and $R^3$ represents a hydrogen atom, a chlorine atom, a bromine atom, an alkyl group having 1 to 4 carbon atoms, an alkoxy group having 1 to 4 carbon atoms, a dialkylamino group or a nitro group;

(24)

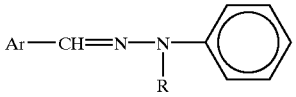

wherein Ar represents a naphthalene ring, an anthracene ring, a pyrene ring and their substituents, a pyridine ring, a furan ring or thiophene ring; and R represents an alkyl group, a phenyl group or a benzyl group;

(25)

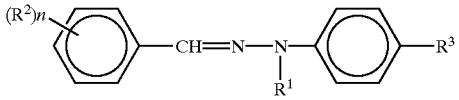

wherein $R^1$ represents an alkyl group, a benzyl group, a phenyl group or a naphtyl group; $R^2$ represents a hydrogen atom, an alkyl group having 1 to 3 carbon atoms, an alkoxy group having 1 to 3 carbon atoms, a dialkylamino group, diaralkylamino group or a diarylamino group; n represents an integer of from 1 to 4 and $R^2$ may be the same or different from each other when n is not less than 2; and $R^3$ represents a hydrogen atom or a methoxy group;

(26)

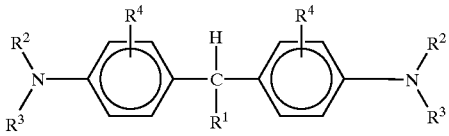

wherein $R^1$ represents an alkyl group having 1 to 11 carbon atoms, a substituted or unsubstituted phenyl group or a heterocyclic ring group; $R^2$ and $R^3$ independently represent a hydrogen atom, an alkyl group having 1 to 4 carbon atoms, a hydroxyalkyl group, a chloralkyl group or a substituted or unsubstituted aralkyl group, and may be combined each other to form a heterocyclic ring group including the nitrogen atom to which they are attached; and $R^4$ independently represent a hydrogen atom, an alkyl group having 1 to 4 carbon atoms, an alkoxy group or a halogen atom;

(27)

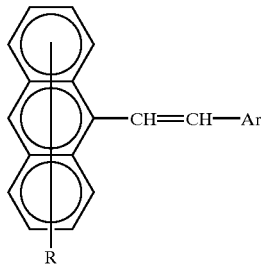

wherein R represents a hydrogen atom or a halogen atom; and Ar represents a substituted or unsubstituted phenyl group, a naphtyl group, an anthryl group or a carbazolyl group;

(28)

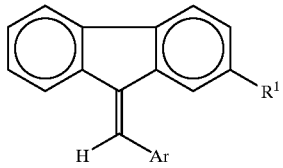

wherein $R^1$ represents a hydrogen atom, a cyano group, an alkoxy group having 1 to 4 carbon atoms or a alkyl group having 1 to 4 carbon atoms; and Ar represents a group having the following formulae:

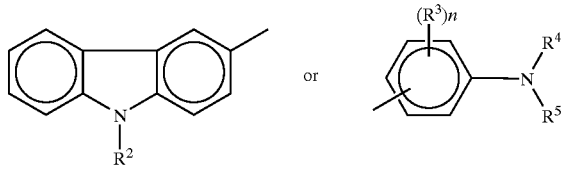

wherein $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms or a dialkylamino group; n is 1 or 2, and $R^3$ may be the same or different from each other when n is 2; and $R^4$ and $R^5$ represent a hydrogen atom, a substituted or unsubstituted alkyl group having 1 to 4 carbon atoms or a substituted or unsubstituted benzyl group;

(29)

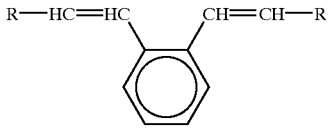

wherein R represents a carbazolyl group, a pyridyl group, a thienyl group, an indolyl group, a furyl group, a substituted or unsubstituted phenyl, styryl, naphtyl group or an anthryl group, and their substituents are selected from the group consisting of a dialkylamino group, an alkyl group, an alkoxy group, a carboxyl group or its ester, a halogen atom, a cyano group, an aralkylamino group, N-alkyl-N-aralkylamino group, an amino group, a nitro group and an acethylamino group;

(30)

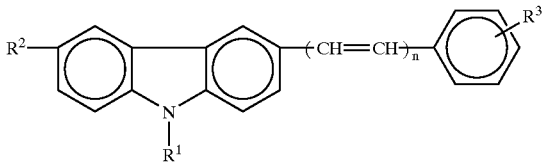

wherein $R^1$ represents a lower alkyl group, a substituted or unsubstituted phenyl group or a benzyl group; $R^2$ and $R^3$ represent a hydrogen atom, a lower alkyl group, a lower alkoxy group, a halogen atom, a nitro group, an amino group or an amino group substituted by a lower alkyl group or a benzyl group; and n is 1 or 2;

(31)

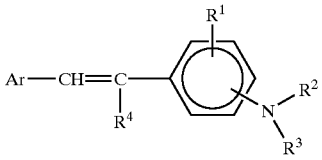

wherein $R^1$ represents a hydrogen atom, an alkyl group, an alkoxy group or a halogen atom; $R^2$ and $R^3$ represent a substituted or unsubstituted aryl group; $R^4$ represents a hydrogen atom, a lower alkyl group or a substituted or unsubstituted phenyl group; and Ar represents a substituted or unsubstituted phenyl group or a naphtyl group;

(32)

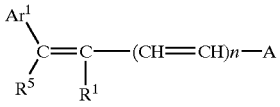

wherein n is 0 or 1; $R^1$ represents a hydrogen atom, an alkyl group or an unsubstituted phenyl group; $Ar^1$ represents a substituted or unsubstituted aryl group; $R^5$ represents an alkyl group including a substituted alkyl group or a substituted or unsubstituted aryl group; and A represents 9-anthryl group, a substituted or unsubstituted carbazolyl group or a group having the following formulae:

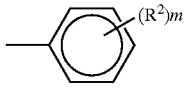

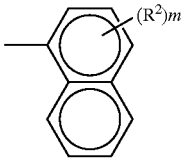

wherein $R^2$ represents a hydrogen atom, an alkyl group, an alkoxy group, a halogen atom or a group having the following formula; and m is an integer of from 1 to 5;

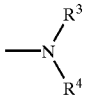

wherein $R^3$ and $R^4$ independently represent a substituted or unsubstituted aryl group, and $R^4$ may form a ring, and wherein $R^2$ may be the same or different from each other when m is not less than 2, and A and $R^1$ may form a ring together when n is 0;

(33)

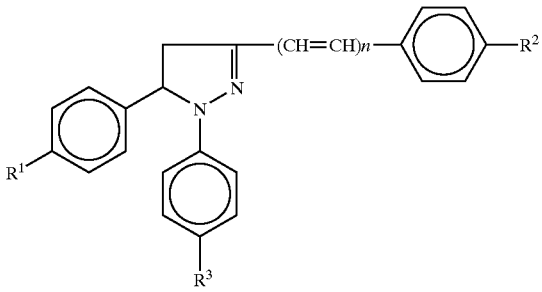

wherein $R^1$, $R^2$ and $R^3$ represent a hydrogen atom, a lower alkyl group, a lower alkoxy group, a halogen atom or a dialkylamino group; and n is 0 or 1;

(34)

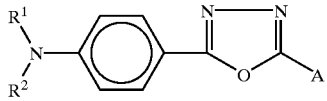

wherein $R^1$ and $R^2$ represent an alkyl group including a substituted alkyl group or a substituted or unsubstituted aryl group; and A represents a substituted amino group, a substituted or unsubstituted aryl group or an aryl group;

(35)

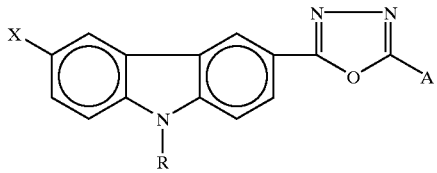

wherein X represents a hydrogen atom, a lower alkyl group or a halogen atom; R represents an alkyl group including a substituted alkyl group or a substituted or unsubstituted aryl group; and A represents a substituted amino group, a substituted or unsubstituted aryl group or an aryl group;

(36)

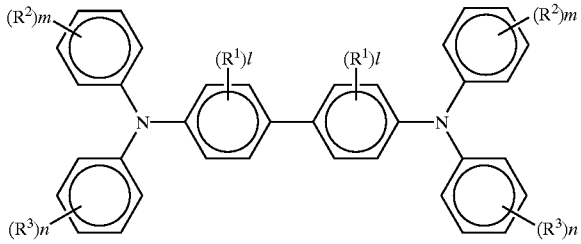

wherein $R^1$ represents a lower alkyl group, a lower alkoxy group or a halogen atom; $R^2$ and $R^3$ independently represent a hydrogen atom, a lower alkyl group, a lower alkoxy group or a halogen atom; and l, m and n independently represent 0 or an integer of from 1 to 4;

(37)

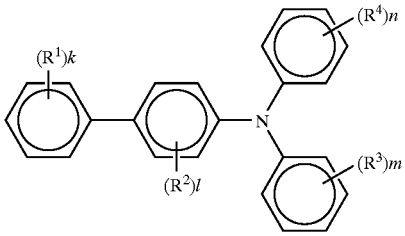

wherein $R^1$ $R^3$ and $R^4$ represent a hydrogen atom, an amino group, an alkoxy group, a thioalkoxy group, an aryloxy group, a methylenedioxy group, a substituted or unsubstituted alkyl group, a halogen atom or a substituted or unsubstituted aryl group; $R^2$ represents a hydrogen atom, an alkoxy group, a substituted or unsubstituted alkyl group or a halogen atom, but a case in which $R^1$, $R^2$, $R^3$ and $R^4$ are all hydrogen atoms is excluded; and k, l, m, and n are independently an integer of from 1 to 4, and $R^1$, $R^2$, $R^3$ and $R^4$ may be the same or different from the others when k, l, m, and n are an integer of from 2 to 4;

(38)

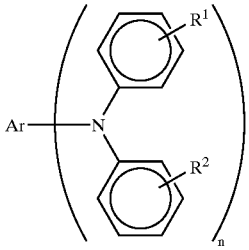

wherein Ar represents a condensation polycyclic hydrocarbon group having 18 or less carbon atoms which can have a substituent; and $R^1$ and $R^2$ independently represent a hydrogen atom, a halogen atom, a substituted or unsubstituted alkyl group, an alkoxy group, or a substituted or unsubstituted phenyl group and n is 1 or 2;

A-CH═CH—Ar—CH═CH-A (39)

wherein Ar represents a substituted or unsubstituted aromatic hydrocarbon group; and A represents

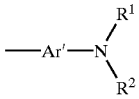

wherein Ar' represents a substituted or unsubstituted aromatic hydrocarbon group; and $R^1$ and $R^2$ represent substituted or unsubstituted alkyl group or a substituted or unsubstituted aryl group;

(40)

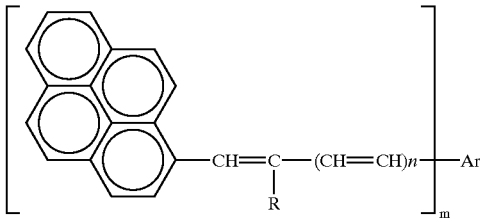

wherein Ar represents a substituted or unsubstituted aromatic hydrocarbon group; R represents a hydrogen atom, a substituted or unsubstituted alkyl group or a substituted or unsubstituted aryl group; n is 0 or 1; m is 1 or 2; and Ar and R may form a ring when n is 0 and m is 1.

Specific examples of the compound having the formula (23) include 9-ethylcalbazole-3-aldehyde-1-methyl-1-phenylhydrazone, 9-ethylcalbazole-3-aldehyde-1-benzyl-1-phenylhydrazone, 9-ethylcalbazole-3-aldehyde-1,1-diphenylhydrazone, etc.

Specific examples of the compound having the formula (24) include 4-diethylaminostyryl-β-aldehhyde-1-methyl-1-phenylhydrazone, 4-methoxynaphthalene-1-aldehyde-1-benzyl-1-phenylhydrazone, etc.

Specific examples of the compound having the formula (25) include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, 4-dibenzylaminobenzaldehyde-1,1-diphenylhydrazone, etc.

Specific examples of the compound having the formula (26) include 1,1-bis(4-dibenzylaminophenyl)propane, tris(4-diethylaminophenyl)methane, 1,1-bis(4-dibenzylaminophenyl)propane, 2,2'-dimethyl-4,4'-bis(diethylamino)-triphenylmethane, etc.

Specific examples of the compound having the formula (27) include 9-(4-diethylaminostyryl)anthracene, 9-bromo-10-(4-diethylaminostyryl)anthracene, etc.

Specific examples of the compound having the formula (28) include 9-(4-dimethylaminobenzylidene)fluorene, 3-(9-fluorenylidene)-9-ethylcarbazole, etc.

Specific examples of the compound having the formula (29) include 1,2-bis-(4-diethylaminostyryl)benzene, 1,2-bis(2-,4-dimethoxystyryl)benzene, etc.

Specific examples of the compound having the formula (30) include 3-styryl-9-ethylcarbazole, 3-(4-methoxystyryl)-9-ethylcarbazole, etc.

Specific examples of the compound having the formula (31) include 4-diphenylaminostilbene, 4-dibenzylaminostilbene, 4-ditolylaminostilbene, 1-(4-iphenylaminostyryl)naphthalene, 1-(4-diethylaminostyryl)naphthalene, etc.

Specific examples of the compound having the formula (32) include 4'-diphenylamino-α-phenylstilbene, 4'-bis(4-methylphenyl)amino-α-phenylstilbene, etc.

Specific examples of the compound having the formula (33) include 1-phenyl-3-(4-diethylaminostyryl)-5-(4-diethylaminophenyl)pyrazoline, etc.

Specific examples of the compound having the formula (34) include 2,5-bis(4-diethylaminophenyl)-1,3,4-oxadiazole, 2-N,N-diphenylamino-5-(4-diethylaminophenyl)-1,3,4-oxadiazole, 2-(4-dimethylaminophenyl)-5-(4-diethylaminophenyl)-1,3,4-oxadiazole, etc.

Specific examples of the compound having the formula (35) include 2-N,N-diphenylamino-5-(N-ethylcarbazole-3-yl)-1,3,4-oxadiazole, 2-(4-diethylaminophenyl)-5-(N-ethylcarbazole-3-yl)-1,3,4-oxadiazole, etc.

Specific examples of the benzidine compound having the formula (36) include N,N'-diphenyl-N,N'-bis(3-methylphenyl)-[1,1'-biphenyl]-4,4'-diamine, 3,3'-dimethyl-N,N,N',N'-tetrakis(4-methylphenyl)-[1,1'-biphenyl]-4,4'-diamine, etc.

Specific examples of the biphenylamine compound having the formula (37) include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, N,N-bis(3,4-dimethylphenyl)-[1,1'-biphenyl]-4-amine, etc.

Specific examples of the triarylamine compound having the formula (38) include N,N-diphenyl-pyrene-1-amine, N,N-di-p-tolyl-pyrne-1-amine, N,N-di-p-tolyl-1-naphthylamine, N,N-di(p-tolyl)-1-phenanthorylamine, 9,9-dimethyl-2-(di-p-tolylamino)fluorene, N,N,N',N'-tetrakis(4-methylphenyl)-phenanthrene-9,10-diamine, N,N,N',N'-tetrakis(3-methylphenyl)-m-phenylenediamine, etc.

Specific examples of the diolefin aromatic compound having the formula (39) include 1,4-bis(4-diphenylaminostyryl)benzene, 1,4-bis[4-di(p-tolyl)aminostyryl]benzene, etc.

Specific examples of the styrylpyrene compound having the formula (40) include 1-(4-diphenylaminostyryl)pyrene, 1-[4-di(p-tolyl)aminostyryl]pyrene, etc.

Specific examples of the electron transport materials include chloranil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno [1,2-b] thiophene-4-one, and 1,3,7-trinitrodibenzothiophene-5,5-dioxide, etc. In addition, electron transport materials having the following formulae (41), (42) and (43) are preferably used.

(41)

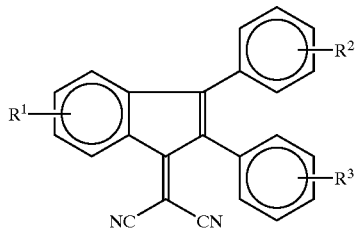

wherein $R^1$, $R^2$ and $R^3$ independently represent a hydrogen atom, a halogen atom, a substituted or unsubstituted alkyl group, an alkoxy group or a substituted or unsubstituted phenyl group;

(42)

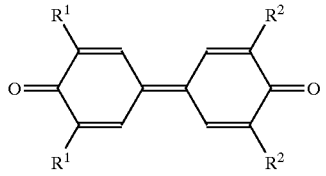

wherein $R^1$ and $R^2$ independently represent a hydrogen atom, a substituted or unsubstituted alkyl group, or a substituted or unsubstituted phenyl group;

(43)

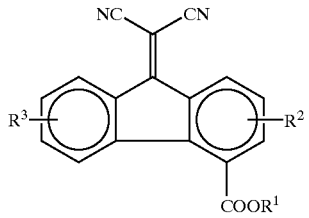

wherein $R^1$, $R^2$ and $R^3$ independently represent a hydrogen atom, a halogen atom, a substituted or unsubstituted alkyl group, an alkoxy group or a substituted or unsubstituted phenyl group.

These CTMs can be used alone or in combination.

Specific examples of the binder resin include thermoplastic resins, thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the CTM and the amine compound of the present invention when included by mixture is preferably from 20 to 300 parts by weight, and more preferably from 40 to 150 parts by weight, per 100 parts by weight of the binder resin. The thickness of the CTL is preferably not greater than 25 $\mu$m in view of resolution of the resultant images and response. The lower limit of the thickness is preferably not less than 5 $\mu$m, although it depends on the image forming system (particularly on the electric potential).

In addition, the content of the amine compound of the present invention is preferably from 0.01 to 150% by weight based on total weight of the CTM. When less than 0.01% by weight, the durability against the oxidized gas of the resultant photoreceptor deteriorates. When greater than 150% by weight, the residual potential thereof increases.

Specific examples of a solvent for use in forming the CTL include tetrahydrofuran, dioxane, toluene, dichloromethane, monochlorobenzene, dichloroethane, cyclohexanone, methyl ethyl ketone, acetone and the like solvents. The CTM can be used alone or in combination in the solvent.

As an antioxidant for use in the present invention, the after-mentioned conventional antioxidants can be used, and (c) hydroquinone compounds and (f) hindered amine compounds are effectively used in particular.

However, the antioxidant for use in the CTL has a different purpose from the after-mentioned purpose, and are used to prevent quality alteration of the amine compound of the present invention.

Therefore, the antioxidant is preferably included in a CTL coating liquid before the amine compound of the present invention is included therein. The content of the antioxidant is from 0.1 to 200% by weight based on total weight of the amine compound.

The CTL preferably includes a polymer CTM, which has both a binder resin function and a charge transport function, because the resultant CTL has good abrasion resistance. Suitable charge transport polymer materials include known polymer CTMs. Among these materials, polycarbonate resins having a triarylamine structure in their main chain and/or side chain are preferably used. In particular, polymer CTMs having the following formulae (I) to (XI) are preferably used:

(I)

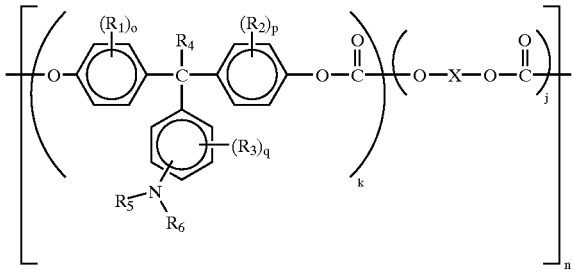

wherein, $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; o, p and q independently represent 0 or an integer of from 1 to 4; k is a number of from 0.1 to 1.0 and j is a number of from 0 to 0.9; n represents a repeating number and is an integer of from 5 to 5000; and X represents a divalent aliphatic group, a divalent alicyclic group or a divalent group having the following formula:

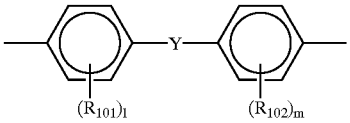

wherein, $R_{101}$ and $R_{102}$ independently represent a substituted or unsubstituted alkyl group, an aromatic ring group or a halogen atom; l and m represent 0 or an integer of from 1 to 4; and Y represents a direct bonding, a linear alkylene group, a branched alkylene group, a cyclic alkylene group, —O—, —S—, —SO—, —SO2—, —CO—, —CO—O-Z-O—CO— (Z represents a divalent aliphatic group), or a group having the following formula:

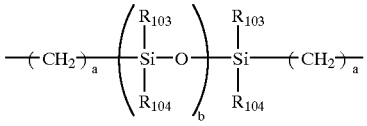

wherein, a is an integer of from 1 to 20; b is an integer of from 1 to 2000; and $R_{103}$ and $R_{104}$ independently represent a substituted or unsubstituted alkyl group, or a substituted or unsubstituted aryl group, and wherein $R_{101}$, $R_{102}$, $R_{103}$ and $R_{104}$ may be the same or different from the others;

(II)

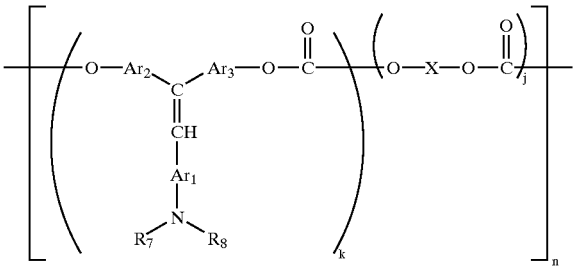

wherein, $R_7$ and $R_8$ represent a substituted or unsubstituted aryl group; $Ar_1$, $Ar_2$ and $Ar_3$ independently represent an arylene group; and X, k, j and n are same in formula (I);

(III)

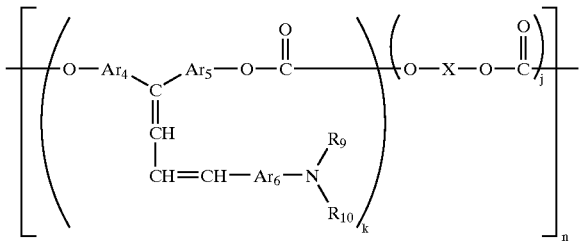

wherein, $R_9$ and $R_{10}$ represent a substituted or unsubstituted aryl group; $Ar_4$, $Ar_5$ and $Ar_6$ independently represent an arylene group; and X, k, j and n are same in formula (I);

(IV)

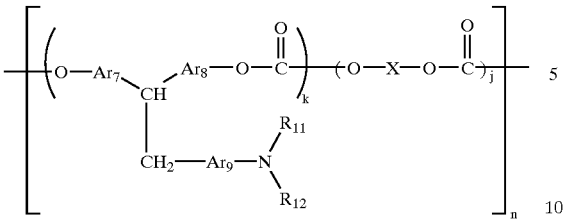

wherein, $R_{11}$ and $R_{12}$ represent a substituted or unsubstituted aryl group; $Ar_7$, $Ar_8$ and $Ar_9$ independently represent an arylene group; p is an integer of from 1 to 5; and X, k, j and n are same in formula (I);

(V)

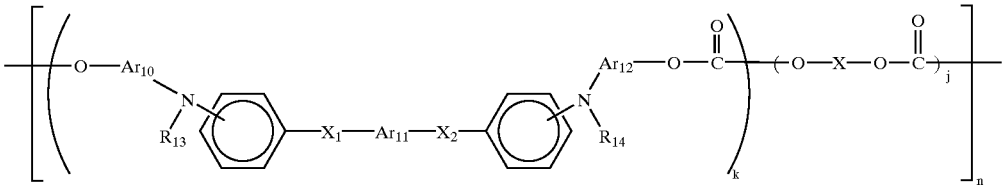

wherein, $R_{13}$ and $R_{14}$ represent a substituted or unsubstituted aryl group; $Ar_{10}$, $Ar_{11}$ and $Ar_{12}$ independently represent an arylene group; $X_1$ and $X_2$ represent a substituted or unsubstituted ethylene group, or a substituted or unsubstituted vinylene group; and X, k, j and n are same in formula (I);

(VI)

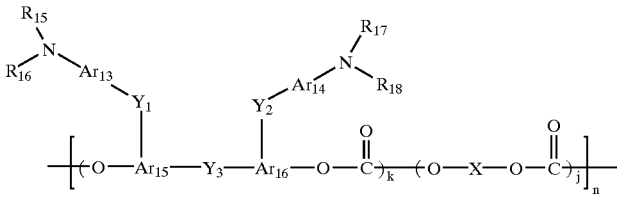

wherein, $R_{15}$, $R_{16}$, $R_{17}$ and $R_{18}$ represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a direct bonding, a substituted or unsubstituted alkylene group, a substituted or unsubstituted cycloalkylene group, a substituted or unsubstituted alkyleneether group, an oxygen atom, a sulfur atom, or a vinylene group; and X, k, j and n are same in formula (I);

(VII)

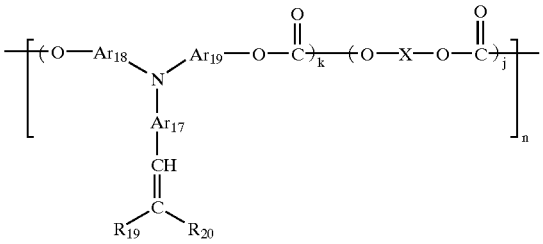

wherein, $R_{19}$ and $R_{20}$ represent a hydrogen atom, or substituted or unsubstituted aryl group, and $R_{19}$ and $R_{20}$ may form a ring; $Ar_{17}$, $Ar_{18}$ and $Ar_{19}$ independently represent an arylene group; and X, k, j and n are same in formula (I);

(VIII)

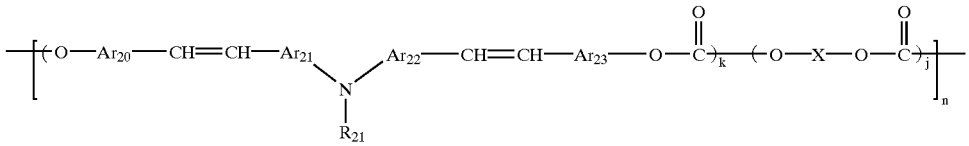

wherein, $R_{21}$ represents a substituted or unsubstituted aryl group; $Ar_{20}$, $Ar_{21}$, $Ar_{22}$ and $Ar_{23}$ independently represent an arylene group; and X, k, j and n are same in formula (I);

(IX)

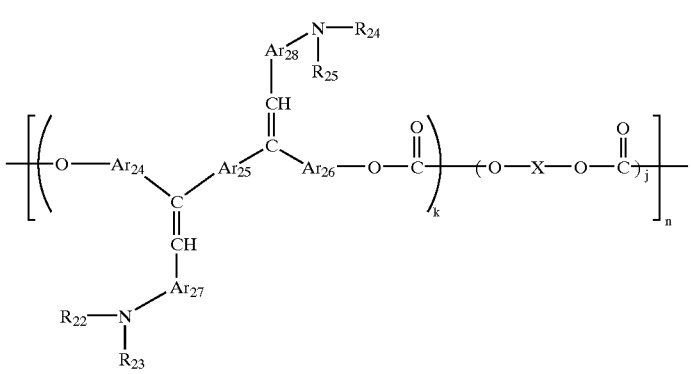

wherein, $R_{22}$, $R_{23}$, $R_{24}$ and $R_{25}$ represent a substituted or unsubstituted aryl group; $Ar_{24}$, $Ar_{25}$, $Ar_{26}$, $Ar_{27}$ and $Ar_{28}$ independently represent an arylene group; and X, k, j and n are same in formula (I);

(X)

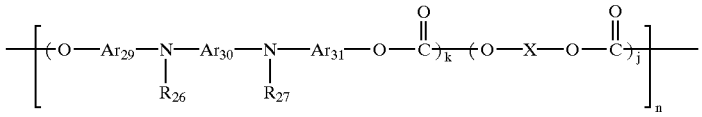

wherein, $R_{26}$ and $R_{27}$ independently represent a substituted or unsubstituted aryl group; $Ar_{29}$, $Ar_{30}$ and $Ar_{31}$ independently represent an arylene group; and X, k, j and n are same in formula (I);

(XI)

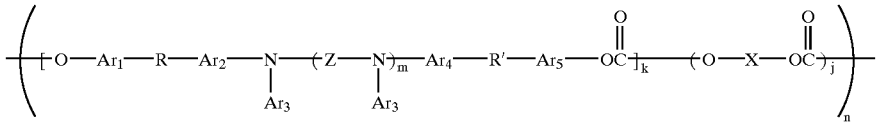

wherein $Ar_1$, $Ar_2$ $Ar_3$, $Ar_4$ and $Ar_5$ represent a substituted or unsubstituted aromatic ring group; Z represents an aromatic ring group or —$Ar_6$-Za—$Ar_6$—; $Ar_6$ represents a substituted or unsubstituted aromatic ring group; Za represents O,S or an alkylene group; R and R' represent a linear alkylene group or a branched alkylene group; m is 0 or 1; and X, k, j and n are same in formula (I).

The CTL 37 can be formed by coating a coating liquid in which the CTM alone or the CTM and a binder resin are dissolved or dispersed in a proper solvent on the CGL, and drying the liquid. In addition, the CTL may optionally include two or more of additives such as plasticizers, leveling agents and antioxidants.

As a method of coating the thus prepared coating liquid, a conventional coating method such as a dip coating method, a spray coating method, a bead coating method, a nozzle coating method, a spinner coating method and a ring coating method can be used.

Next, the single-layered photosensitive layer 33 will be explained. A photoreceptor in which the above-mentioned CGM is dispersed in the binder resin can be used. The photosensitive layer can be formed by coating a coating liquid in which a CGM, a CTM and a binder resin are dissolved or dispersed in a proper solvent, and then drying the coated liquid. In addition, the photosensitive layer may optionally include additives such as plasticizers, leveling agents and antioxidants.

Suitable binder resins include the resins mentioned above in the CTL 37. The resins mentioned above in the CGL can be added as a binder resin. In addition, the polymer CTLs mentioned above can be also used as a binder resin preferably. The content of the CGM is preferably from 5 to 40 parts by weight per 100 parts by weight of the binder resin. The content of the CTM is preferably from 0 to 190 parts by weight, and more preferably from 50 to 150 parts by weight per 100 parts by weight of the binder resin. The photosensitive layer can be formed by coating a coating liquid in which a CGM, a binder resin and a CTM are dissolved or dispersed in a solvent such as tetrahydrofuran, dioxane, dichloroethane, cyclohexane, etc. by a coating method such as a dip coating method, spray coating method, a bead coating method and a ring coating method. The thickness of the photosensitive layer is preferably from 5 to 25 $\mu$m.

In the photoreceptor of the present invention, an undercoat layer may be formed between the substrate 31 and the photosensitive layer. The undercoat layer includes a resin as a main component. Since a photosensitive layer is typically formed on the undercoat layer by coating a liquid including an organic solvent, the resin in the undercoat layer preferably has good resistance against general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. The thickness of the undercoat layer is preferably 0 to 5 $\mu$m.

In the photoreceptor of the present invention, the protection layer 39 is optionally formed overlying the photosensitive layer. Suitable materials for use in the protection layer 39 include organic compounds having an acid value of from 10 to 400 mgKOH/g such as ABS resins, ACS resins, olefin-vinyl monomer copolymers, chlorinated polyethers, aryl resins, phenolic resins, polyacetal, polyamides, polyester resins, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like, because of preventing an increase of residual potential of the resultant photoreceptor. Among these materials, the polycarbonate resin and the polyarylate resin are preferably and effectively used in terms of dispersibility of a filler, decrease of residual potential and coating defect of the resultant photoreceptor. These materials can be used alone or in combination. In addition, an organic fatty acid is optionally mixed with these materials to improve dispersibility of the filler and prevention of the increase of residual potential of the resultant photoreceptor.

The protection layer of the photoreceptor of the present invention may include a filler material for the purpose of improving abrasion resistance thereof. Suitable materials of the filler include inorganic metallic powders such as copper, tin, aluminium and indium; metal oxides such as silica, tin oxide, zinc oxide, titanium oxide, alumina, zirconium oxide, indium oxide, antimony oxide, bismuth oxide, calcium oxide, tin oxide doped with antimony and indium oxide doped with tin; metal fluorides such as tin fluoride, calcium fluoride and aluminium fluoride; kalium titanate and boron nitride in terms of hardness of the filler to improve abrasion resistance of the resultant photoreceptor.

The filler having a high electric insulation is preferably used to prevent blurred images, and particularly the filler having a pH not less than 5 or a dielectric constant not less than 5 is effectively used, such as the titanium oxide, alumina, zinc oxide and zirconium oxide.

In addition, the filler preferably has an average primary particle diameter of from 0.01 to 0.5 $\mu$m because in terms of optical transmittance and abrasion resistance of the protection layer. When less than 0.01 $\mu$m, the abrasion resistance of the protection layer and dispersibility of the filler deteriorate. When greater than 0.5 $\mu$m, sedimentation of the filler is accelerated and toner filming over the photoreceptor occurs.

Further, the protection layer may include the amine compound of the present invention. Further, the low-molecular-weight CTM or the polymer CTM mentioned above in CTL 37 can be preferably and effectively used to decrease residual potential of the resultant photoreceptor and to improve quality of the resultant images.

As a solvent for use in forming the protection layer, tetrahydrofuran, dioxane, toluene, dichloromethane, monochlorobenzene, dichloroethane, cyclohexanone, methyl ethyl ketone, acetone and the like solvents which are all used in the CTL 37 can be used. However, a high-viscosity solvent is preferably used in dispersion, and a high-volatile solvent is preferably used in coating.

When such a solvent as satisfies the conditions is not available, a mixture of two or more of solvents having each property can be used, which occasionally improves dispersibility of the filler and decreases residual potential of the resultant photoreceptor.

As a method of forming the protection layer, a conventional coating method such as a dip coating method, a spray coating method, a bead coating method, a nozzle coating method, a spinner coating method and ring coating method can be used. In particular, the spray coating method is preferably used in terms of coated film uniformity.

In the photoreceptor of the present invention, an intermediate layer may be formed between the photosensitive layer and the protection layer. The intermediate layer includes a resin as a main component. Specific examples of the resin include polyamides, alcohol soluble nylons, water-soluble polyvinyl butyral, polyvinyl butyral, polyvinyl alcohol, and the like. The intermediate layer can be formed by one of the above-mentioned known coating methods. The thickness of the intermediate layer is preferably from 0.05 to 2 $\mu$m.

In the photoreceptor of the present invention, antioxidants, plasticizers, lubricants, ultraviolet absorbents and leveling agents can be included in each layer such as the CGL, CTL, undercoat layer, protection layer and intermediate layer for environmental improvement, above all for the purpose of preventing decrease of photosensitivity and increase of residual potential. Such compounds will be shown as follows.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-containing Compounds

Dilauryl-3,3'-thiodipropionate, distearyl-3,3'-thiodipropionate, ditetradecyl-3,3'-thiodipropionate, and the like.

(e) Organic Phosphorus-Containing Compounds

Triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters Plasticizers

Triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters Plasticizers

Trioctyl trimellitate, tri-n-octyl trimellitate, octyl oxybenzoate, and the like.

(d) Dibasic Fatty Acid Esters Plasticizers

Dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives

Butyl oleate, glycerin monooleate, methyl acetylricinolate, pentaerythritol esters, dipentaerythritol hexaesters, triacetin, tributyrin, and the like.

(f) Oxyacid Esters Plasticizers

Methyl acetylricinolate, butyl acetylricinolate, butylphthalylbutyl glycolate, tributyl acetylcitrate, and the like.

(g) Epoxy Plasticizers

Epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters Plasticizers

Diethylene glycol dibenzoate, triethylene glycol di-2-ethylbutyrate, and the like.

(i) Chlorine-containing Plasticizers

Chlorinated paraffin, chlorinated diphenyl, methyl esters of chlorinated fatty acids, methyl esters of methoxychlorinated fatty acids, and the like.

(j) Polyester Plasticizers

Polypropylene adipate, polypropylene sebacate, acetylated polyesters, and the like.

(k) Sulfonic Acid Derivatives

P-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives

Triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds

Terphenyl, partially hydrated terphenyl, camphor, 2-nitrodiphenyl, dinonylnaphthalene, methyl abietate, and the like.

Suitable lubricants for use in the layers of the photoreceptor include the following compounds but are not limited thereto.

(a) Hydrocarbon Compounds

Liquid paraffins, paraffin waxes, micro waxes, low molecular weight polyethylenes, and the like.

(b) Fatty Acid Compounds

Lauric acid, myristic acid, palmitic acid, stearic acid, arachidic acid, behenic acid, and the like.

(c) Fatty Acid Amide Compounds

Stearic acid amide, palmitic acid amide, oleic acid amide, methylenebisstearamide, ethylenebisstearamide, and the like.

(d) Ester Compounds

Lower alcohol esters of fatty acids, polyhydric alcohol esters of fatty acids, polyglycol esters of fatty acids, and the like.

(e) Alcohol Compounds

Cetyl alcohol, stearyl alcohol, ethylene glycol, polyethylene glycol, polyglycerol, and the like.

(f) Metallic Soaps

Lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds

Silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds

Phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole and (2'-hydroxy-3'-t-butyl-5'-methylphenyl)-5-chlorobenzotriazole.

(d) Cyano Acrylate Compounds

Ethyl-2-cyano-3,3-diphenyl acrylate, methyl-2-carbomethoxy-3-(paramethoxy) acrylate, and the like.

(e) Quenchers (Metal Complexes)

Nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

Bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Next, the electrophotographic method and apparatus of the present invention will be explained referring to drawings.

Figure 6:
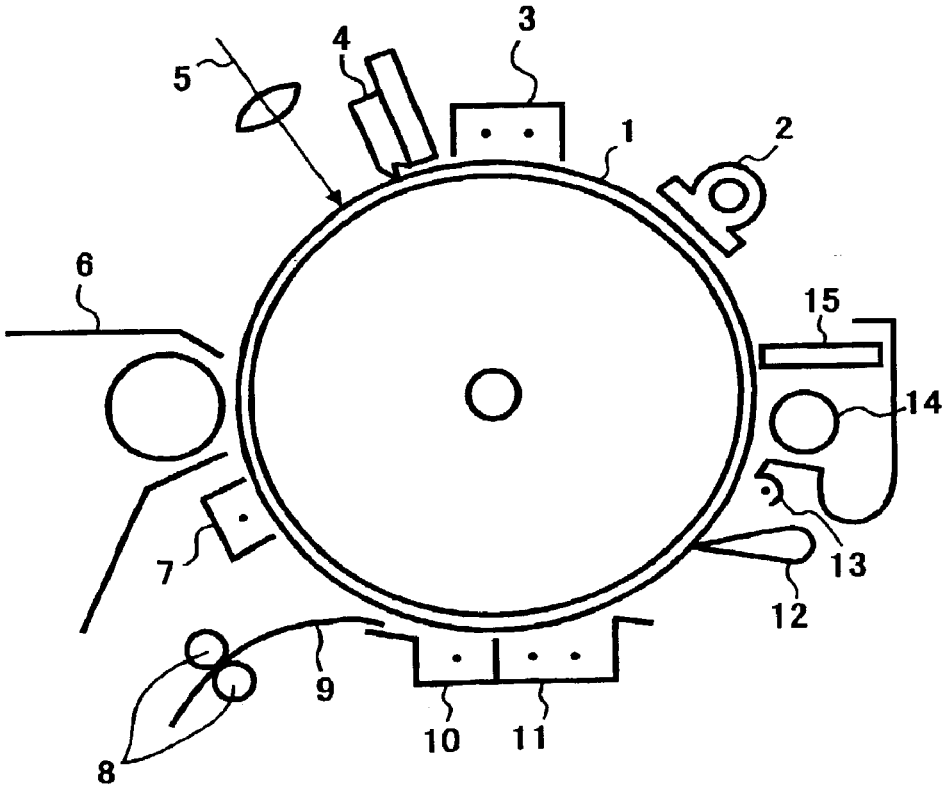
FIG. 6 is a schematic view illustrating an embodiment of the electrophotographic image forming method and apparatus of the present invention.

FIG. 6 is a schematic view for explaining the electrophotographic method and apparatus of the present invention, and a modified embodiment as mentioned below belongs to the present invention.

In FIG. 6, a photoreceptor 1 includes at least a photosensitive layer and the most surface layer includes a filler. The photoreceptor 1 is drum-shaped, and may be sheet-shaped or endless-belt shaped. Any known chargers such as a corotron, a scorotron, a solid state charger and a charging roller can be used for a charger 3, a pre-transfer charger 7, a transfer charge 10, a separation charger 11 and a pre-cleaning charger 13.

The above-mentioned chargers can be used as transfer means, and typically a combination of the transfer charger and the separation charger is effectively used.

Suitable light sources for use in the imagewise light irradiating device 5 and the discharging lamp 2 include fluorescent lamps, tungsten lamps, halogen lamps, mercury lamps, sodium lamps, light emitting diodes (LEDs), laser diodes (LDs), light sources using electroluminescence (EL) and the like. In addition, in order to obtain light having a desired wave length range, filters such as sharp-cut filters, band pass filters, near-infrared cutting filters, dichroic filters, interference filters, color temperature converting filters and the like can be used.

The above-mentioned light sources can be used for not only the processes mentioned above and illustrated in FIG. 6, but also other processes, such as a transfer process, a discharging process, a cleaning process, a pre-exposure process, which include light irradiation to the photoreceptor.

When the toner image formed on the photoreceptor 1 by a developing unit 6 is transferred onto a transfer sheet 9, all of the toner image are not transferred thereon, and residual toner particles remain on the surface of the photoreceptor 1. The residual toner is removed from the photoreceptor by a fur blush 14 and a blade 15. The residual toner remaining on the photoreceptor 1 can be removed by only a cleaning brush. Suitable cleaning blushes include known cleaning blushes such as fur blushes and mag-fur blushes.

When the photoreceptor which is previously charged positively is exposed to image wise light, an electrostatic latent image having a positive or negative charge is formed on the photoreceptor.

When the latent image having a positive charge is developed with a toner having a negative charge, a positive image can be obtained. In contrast, when the latent image having a positive charge is developed with a toner having a positive charge, a negative image (i.e., a reversal image) can be obtained.

As the developing method, known developing methods can be used. In addition, as the discharging methods, known discharging methods can be also used.

Figure 7:
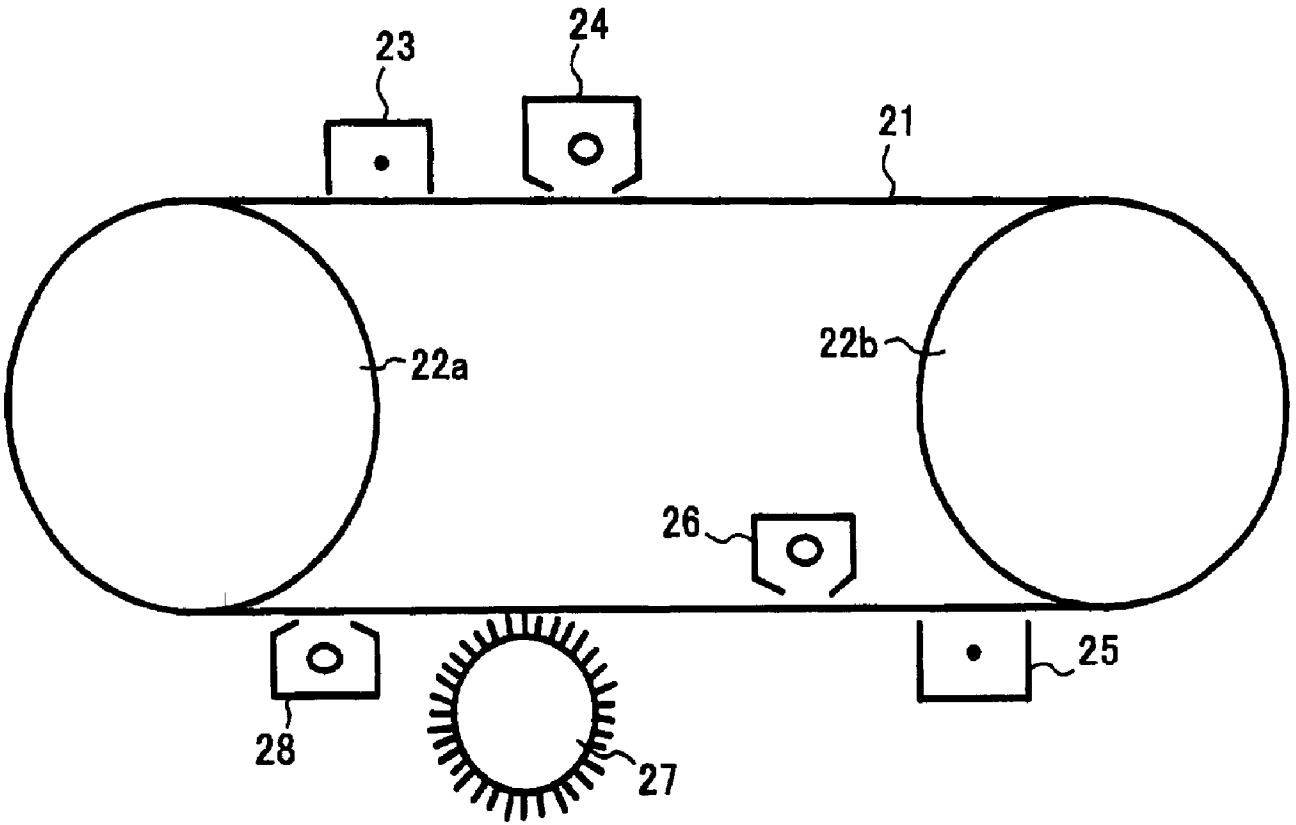
FIG. 7 is a schematic view illustrating another embodiment of the electrophotographic image forming method of the present invention.

FIG. 7 is a schematic view for explaining another embodiment of the electrophotographic apparatus and method of the present invention. A photoreceptor 21 includes at least a photosensitive layer and the most surface layer includes a filler. The photoreceptor is rotated by rollers 22*a* and 22*b*. Charging using a charger 23, imagewise exposure using an imagewise light irradiating device 24, developing using a developing unit (not shown), transferring using a transfer charger 25, pre-cleaning using a light source 26, cleaning using a cleaning brush 27 and discharging using a discharging light source 28 are repeatedly performed. In FIG. 7, the pre-cleaning light irradiating is performed from the side of the substrate of the photoreceptor 21. In this case, the substrate has to be light-transmissive.

The image forming apparatus of the present invention is not limited to the image forming units as shown in FIGS. 6 and 7. For example, although the pre-cleaning light irradiation is performed from the substrate side in FIG. 7, the pre-cleaning light irradiating operation can be performed from the photosensitive layer side of the photoreceptor. In addition, the light irradiation in the light image irradiating process and the discharging process may be performed from the substrate side of the photoreceptor As light irradiation processes, the imagewise irradiation process, pre-cleaning irradiation process, and discharging light irradiation are illustrated. In addition, a pre-transfer light irradiation and a preliminary light irradiation before the imagewise light irradiation, and other known light irradiation processes may also be performed on the photoreceptor.

Figure 8:
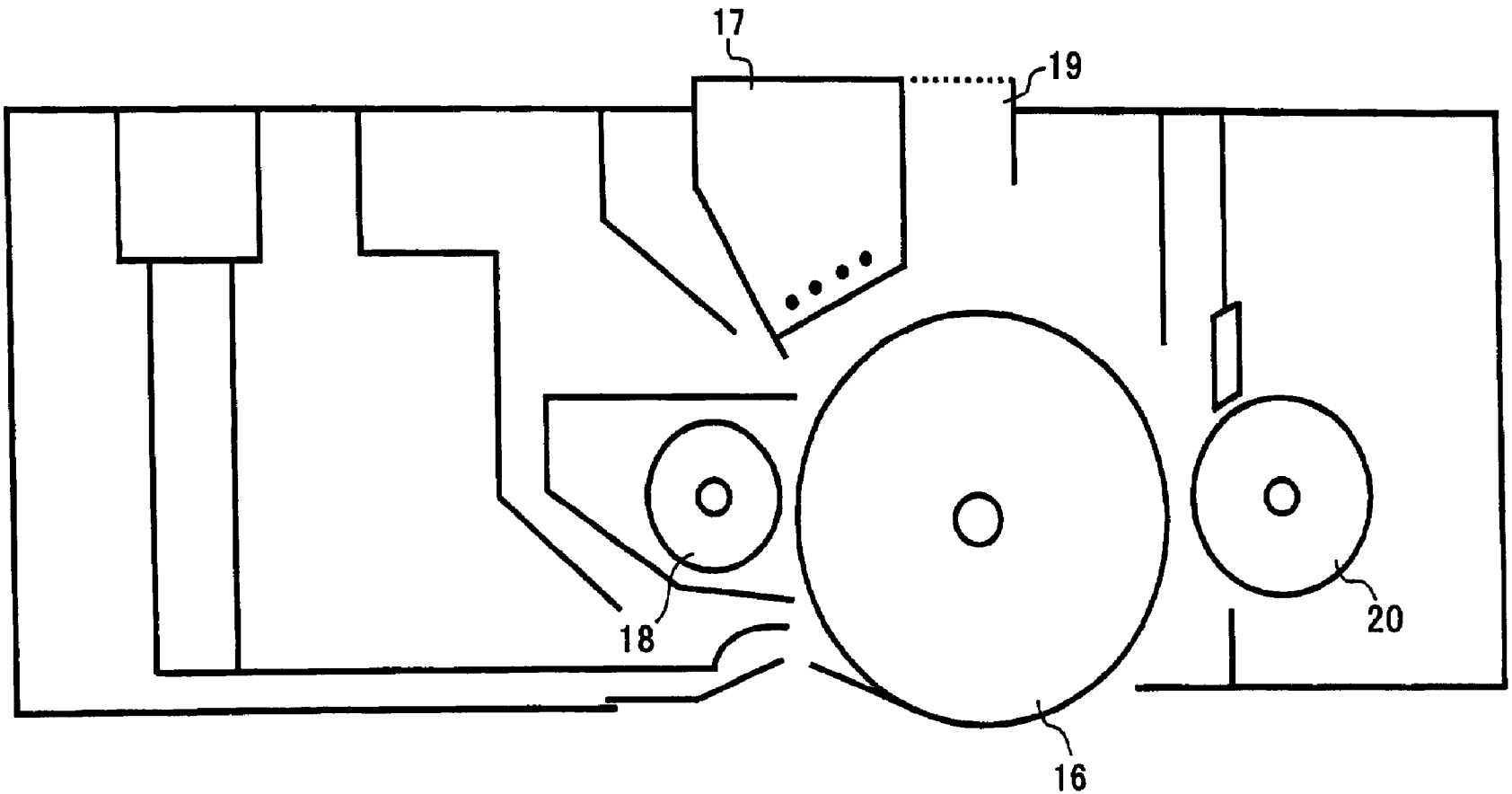
FIG. 8 is a schematic view illustrating an embodiment of the process cartridge of the present invention, for an electrophotographic image forming apparatus.

The above-mentioned image forming unit may be fixedly set in a copier, a facsimile or a printer. However, the image forming unit may be set therein as a process cartridge. The process cartridge means an image forming unit (or device) which includes a photoreceptor, a charger, an imagewise light irradiator, an image developer, an image transferer, a cleaner, and a discharger. Various process cartridges can be used in the present invention. FIG. 8 illustrates an embodiment of the process cartridge. In the process cartridge, a contact charger, an imagewise light irradiating device, a developing roller, a transfer roller, and a cleaning brush are arranged around a photoreceptor. The photoreceptor 16 has at least a photosensitive layer and the most surface layer includes a filler.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated in this order on an aluminium cylinder and dried to prepare an electrophotographic photoreceptor 1 having an undercoat layer of 3.5 μm thick, a CGL of 0.2 μm thick, a CTL of 23 μm thick and a protection layer of 5 μm thick.

| | |
|---|---|
| Undercoat layer coating liquid | |
| Titanium dioxide powder | 400 |
| Melamine resin | 65 |
| Alkyd resin | 120 |
| 2-butanone | 400 |
| CGL coating liquid | |
| Fluorenone bisazo pigment having the following formula | 12 |

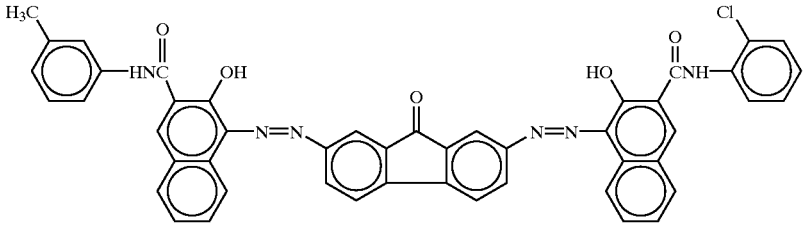

| | |
|---|---|
| Polyvinyl butyral | 5 |
| 2-butanone | 200 |
| Cyclohexanone | 400 |
| CTL coating liquid | |
| Polycarbonate resin (Z polyca from Teijin Chemicals Ltd.) | 10 |
| The amine compound example No. 3–4 | 10 |
| Tetrahydrofuran | 100 |

The thus prepared photoreceptor was equipped with a process cartridge for electrophotography and the cartridge was installed in a modified copier imagio MF2200 from Ricoh Company, ltd. having a scorotron type corona charger an imagewise light source of a LD having a wavelength of 655 nm, in which the photoreceptor has a dark portion potential of 800 (−V) to continuosly and repeatedly produce 100,000 copies totally. The initial images and the images after 100,000 copies were produced were evaluated. In addition, the initial bright portion potential of the photoreceptors and the bright portion potential thereof after 100,000 copies were produced were evaluated. The results are shown in Table 23.

Examples 2 to 36

The procedures of preparation and evaluation for the photoreceptor in Example 1 were repeated to prepare and evaluate photoreceptors 2 to 36 except for using other amine compound examples instead of the amine compound example No. 3–4. The results are shown in Tables 23 to 26.

TABLE 23

| | | | Initial | | After 100,000 copies | |
|---|---|---|---|---|---|---|
| Ex. No. | Photo-re-ceptor No. | Amine compound | Bright portion Potential (−V) | Image quality | Bright portion Potential (−V) | Image quality |
| 1 | 1 | 3-4 | 105 | Good | 125 | Good |
| 2 | 2 | 1-6 | 110 | Good | 145 | Image density deterio-rated (small) |
| 3 | 3 | 2-3 | 100 | Good | 130 | Good |
| 4 | 4 | 4-6 | 115 | Good | 125 | Good |

TABLE 23-continued

| | | | Initial | | After 100,000 copies | |
|---|---|---|---|---|---|---|
| Ex. No. | Photo-re-ceptor No. | Amine compound | Bright portion Potential (−V) | Image quality | Bright portion Potential (−V) | Image quality |
| 5 | 5 | 5-2 | 105 | Good | 115 | Good |
| 6 | 6 | 6-1 | 115 | Good | 125 | Good |

TABLE 24

| | | | Initial | | After 100,000 copies | |
|---|---|---|---|---|---|---|
| Ex. No. | Photo-re-ceptor No. | Amine compound | Bright portion Potential (−V) | Image quality | Bright portion Potential (−V) | Image quality |
| 7 | 7 | 8-1 | 100 | Good | 115 | Good |
| 8 | 8 | 8-6 | 110 | Good | 115 | Good |
| 9 | 9 | 9-1 | 100 | Good | 110 | Good |
| 10 | 10 | 9-3 | 115 | Good | 115 | Good |
| 11 | 11 | 10-2 | 105 | Good | 105 | Good |
| 12 | 12 | 10-4 | 115 | Good | 135 | Image density deterio-rated (small) |

TABLE 25

| Ex. No. | Photo-re-ceptor No. | Amine compound | Initial Bright portion Potential (−V) | Initial Image quality | After 100,000 copies Bright portion Potential (−V) | After 100,000 copies Image quality |
|---|---|---|---|---|---|---|
| 13 | 13 | 16-1 | 100 | Good | 125 | Good |
| 14 | 14 | 16-2 | 110 | Good | 135 | Good |
| 15 | 15 | 16-3 | 100 | Good | 140 | Good |
| 16 | 16 | 16-4 | 115 | Good | 125 | Good |
| 17 | 17 | 16-5 | 95 | Good | 155 | Image density deterio-rated (small) |
| 18 | 18 | 16-6 | 125 | Good | 125 | Good |
| 19 | 19 | 16-7 | 105 | Good | 130 | Good |
| 20 | 20 | 16-8 | 125 | Good | 165 | Image density deterio-rated (small) |
| 21 | 21 | 16-9 | 135 | Good | 145 | Image density deterio-rated (small) |
| 22 | 22 | 16-10 | 120 | Good | 150 | Good |
| 23 | 23 | 16-11 | 85 | Good | 165 | Image density deterio-rated (small) |

TABLE 26

| Ex. No. | Photo-re-ceptor No. | Amine compound | Initial Bright portion Potential (−V) | Initial Image quality | After 100,000 copies Bright portion Potential (−V) | After 100,000 copies Image quality |
|---|---|---|---|---|---|---|
| 24 | 24 | 7-2 | 135 | Good | 170 | Image density deterio-rated (small) |
| 25 | 25 | 11-2 | 120 | Good | 180 | Image density deterio-rated (small) |
| 26 | 26 | 12-4 | 130 | Good | 155 | Good |
| 27 | 27 | 13-4 | 110 | Good | 135 | Good |
| 28 | 28 | 14-1 | 115 | Good | 125 | Good |
| 29 | 29 | 14-11 | 95 | Good | 100 | Good |
| 30 | 30 | 15-6 | 120 | Good | 135 | Good |
| 31 | 31 | 17-3 | 110 | Good | 115 | Good |
| 32 | 32 | 18-4 | 130 | Good | 180 | Image density deterio-rated (small) |
| 33 | 33 | 19-1 | 120 | Good | 135 | Good |
| 34 | 34 | 20-1 | 85120 | Good | 125 | Good |
| 35 | 35 | 21-2 | 110 | Good | 120 | Good |
| 36 | 36 | 22-2 | 105 | Good | 125 | Good |

Example 37

The procedures of preparation and evaluation for the photoreceptor in Example 1 were repeated to prepare and evaluate photoreceptor 37 except for using a CTL coating liquid having the following formula. The results are shown in Table 27.

CTL Coating Liquid

| CTL coating liquid | |
|---|---|
| Polycarbonate resin (Z polyca from Teijin Chemicals Ltd.) | 10 |
| The amine compound example No. 3–4 | 10 |
| CTM having the following formula | 9 |
| Tetrahydrofuran | 100 |

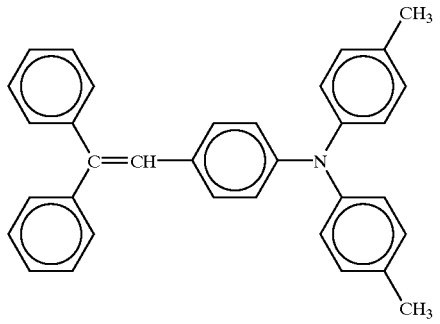

Examples 38 to 83

The procedures of preparation and evaluation for the photoreceptor in Example 37 were repeated to prepare and evaluate photoreceptors 38 to 83 except for using other amine compound examples instead of the amine compound example No. 3–4. The results are shown in Tables 27 and 28.

TABLE 27

| Ex. No. | Photo-re-ceptor No. | Amine compound | Initial Bright portion Potential (−V) | Initial Image quality | After 100,000 copies Bright portion Potential (−V) | After 100,000 copies Image quality |
|---|---|---|---|---|---|---|
| 37 | 37 | 3-4 | 105 | Good | 105 | Good |
| 38 | 38 | 1-2 | 100 | Good | 110 | Good |
| 39 | 39 | 2-4 | 100 | Good | 105 | Good |
| 40 | 40 | 4-3 | 110 | Good | 115 | Good |
| 41 | 41 | 5-1 | 110 | Good | 110 | Good |
| 42 | 42 | 6-3 | 100 | Good | 125 | Good |
| 43 | 43 | 8-1 | 100 | Good | 115 | Good |
| 44 | 44 | 8-6 | 100 | Good | 105 | Good |
| 45 | 45 | 9-1 | 100 | Good | 110 | Good |
| 46 | 46 | 9-3 | 105 | Good | 110 | Good |
| 47 | 47 | 10-2 | 100 | Good | 115 | Good |
| 48 | 48 | 10-4 | 115 | Good | 115 | Good |
| 49 | 49 | 14-1 | 100 | Good | 115 | Good |
| 50 | 50 | 14-2 | 105 | Good | 120 | Good |
| 51 | 51 | 14-3 | 110 | Good | 125 | Good |
| 52 | 52 | 14-4 | 110 | Good | 115 | Good |
| 53 | 53 | 14-5 | 125 | Good | 145 | Good |
| 54 | 54 | 14-6 | 110 | Good | 115 | Good |
| 55 | 55 | 14-7 | 100 | Good | 110 | Good |
| 56 | 56 | 14-8 | 120 | Good | 145 | Good |
| 57 | 57 | 14-9 | 135 | Good | 155 | Image density deterio- |

TABLE 27-continued

| Ex. No. | Photo-re-ceptor No. | Amine compound | Initial Bright portion Potential (−V) | Initial Image quality | After 100,000 copies Bright portion Potential (−V) | After 100,000 copies Image quality |
|---|---|---|---|---|---|---|
| | | | | | | rated (small) |
| 58 | 58 | 14-10 | 140 | Good | 150 | Good |
| 59 | 59 | 14-11 | 105 | Good | 160 | Image density deterio-rated (small) |

TABLE 28

| Ex. No. | Photo-re-ceptor No. | Amine compound | Initial Bright portion Potential (−V) | Initial Image quality | After 100,000 copies Bright portion Potential (−V) | After 100,000 copies Image quality |
|---|---|---|---|---|---|---|
| 60 | 60 | 16-1 | 100 | Good | 110 | Good |
| 61 | 61 | 16-2 | 105 | Good | 115 | Good |
| 62 | 62 | 16-3 | 100 | Good | 105 | Good |
| 63 | 63 | 16-4 | 110 | Good | 125 | Good |
| 64 | 64 | 16-5 | 110 | Good | 120 | Good |
| 65 | 65 | 16-6 | 95 | Good | 115 | Good |
| 66 | 66 | 16-7 | 115 | Good | 115 | Good |
| 67 | 67 | 16-8 | 120 | Good | 135 | Good |
| 68 | 68 | 16-9 | 100 | Good | 120 | Good |
| 69 | 69 | 16-10 | 115 | Good | 145 | Good |
| 70 | 70 | 16-11 | 95 | Good | 140 | Good |
| 71 | 71 | 7-2 | 100 | Good | 150 | Image density deterio-rated (small) |
| 72 | 72 | 11-2 | 110 | Good | 145 | Image density deterio-rated (small) |
| 73 | 73 | 12-4 | 105 | Good | 120 | Good |
| 74 | 74 | 13-4 | 90 | Good | 110 | Good |
| 75 | 75 | 14-1 | 100 | Good | 105 | Good |
| 76 | 76 | 14-11 | 95 | Good | 105 | Good |
| 77 | 77 | 15-6 | 100 | Good | 105 | Good |
| 78 | 78 | 17-3 | 105 | Good | 115 | Good |
| 79 | 79 | 18-4 | 110 | Good | 120 | Good |
| 80 | 80 | 19-1 | 110 | Good | 125 | Good |
| 81 | 81 | 20-1 | 100 | Good | 110 | Good |
| 82 | 82 | 21-2 | 105 | Good | 110 | Good |
| 83 | 83 | 22-2 | 110 | Good | 115 | Good |

Examples 84 to 87

The procedures of preparation and evaluation for the photoreceptor in Example 37 were repeated to prepare and evaluate photoreceptors 84 to 87 except for changing the amount of the amine compound and the CTM as follows. The results are shown in Table 29.

| | |
|---|---|
| Amine compound | 1 |
| CTM | 7 |

TABLE 29

| Ex. No. | Photo-re-ceptor No. | Amine compound | Initial Bright portion Potential (−V) | Initial Image quality | After 100,000 copies Bright portion Potential (−V) | After 100,000 copies Image quality |
|---|---|---|---|---|---|---|
| 84 | 84 | 3-4 | 115 | Good | 110 | Good |
| 85 | 85 | 8-1 | 105 | Good | 110 | Good |
| 86 | 86 | 14-1 | 105 | Good | 120 | Good |
| 87 | 87 | 16-1 | 105 | Good | 115 | Good |

Examples 88 to 91

The procedures of preparation and evaluation for the photoreceptor in Example 37 were repeated to prepare and evaluate photoreceptors 88 to 91 except for changing the amount of the amine compound and the CTM as follows. The results are shown in Table 30.

| | |
|---|---|
| Amine compound | 5 |
| CTM | 5 |

TABLE 30

| Ex. No. | Photo-re-ceptor No. | Amine compound | Initial Bright portion Potential (−V) | Initial Image quality | After 100,000 copies Bright portion Potential (−V) | After 100,000 copies Image quality |
|---|---|---|---|---|---|---|
| 88 | 88 | 3-4 | 100 | Good | 125 | Good |
| 89 | 89 | 8-1 | 105 | Good | 120 | Good |
| 90 | 90 | 14-1 | 130 | Good | 145 | Good |
| 91 | 91 | 16-1 | 110 | Good | 120 | Good |

Examples 92 to 95

The procedures of preparation and evaluation for the photoreceptor in Example 37 were repeated to prepare and evaluate photoreceptors 92 to 95 except for changing the CTM to a CTM having the following formula. The results are shown in Table 31.

TABLE 31

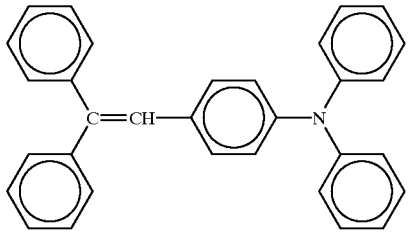

| Ex. No. | Photo-receptor No. | Amine Compound | Initial: Bright portion Potential (-V) | Initial: Image quality | After 100,000 copies: Bright portion Potential (-V) | After 100,000 copies: Image quality |
|---|---|---|---|---|---|---|
| 92 | 92 | 3-4 | 100 | Good | 115 | Good |
| 93 | 93 | 8-1 | 100 | Good | 110 | Good |
| 94 | 94 | 14-1 | 105 | Good | 125 | Good |
| 95 | 95 | 16-1 | 110 | Good | 135 | Good |

Examples 96 to 99

The procedures of preparation and evaluation for the photoreceptor in Example 37 were repeated to prepare and evaluate photoreceptors 96 to 99 except for changing the CTM to a CTM having the following formula. The results are shown in Table 32.

TABLE 32

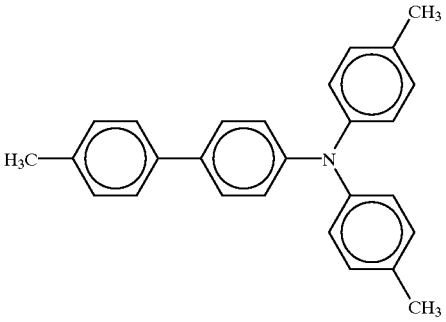

| Ex. No. | Photo-receptor No. | Amine Compound | Initial: Bright portion Potential (-V) | Initial: Image quality | After 100,000 copies: Bright portion Potential (-V) | After 100,000 copies: Image quality |
|---|---|---|---|---|---|---|
| 96 | 96 | 3-4 | 115 | Good | 115 | Good |
| 97 | 97 | 8-1 | 105 | Good | 110 | Good |
| 98 | 98 | 14-1 | 110 | Good | 130 | Good |
| 99 | 99 | 16-1 | 110 | Good | 130 | Good |

Examples 100 to 102

The procedures of preparation and evaluation for the photoreceptor in Example 37 were repeated to prepare and evaluate photoreceptors 100 to 102 except for changing the CTM and the binder resin to the following material. The results are shown in Table 33.

TABLE 33

Polymer CTM having the following formula 19

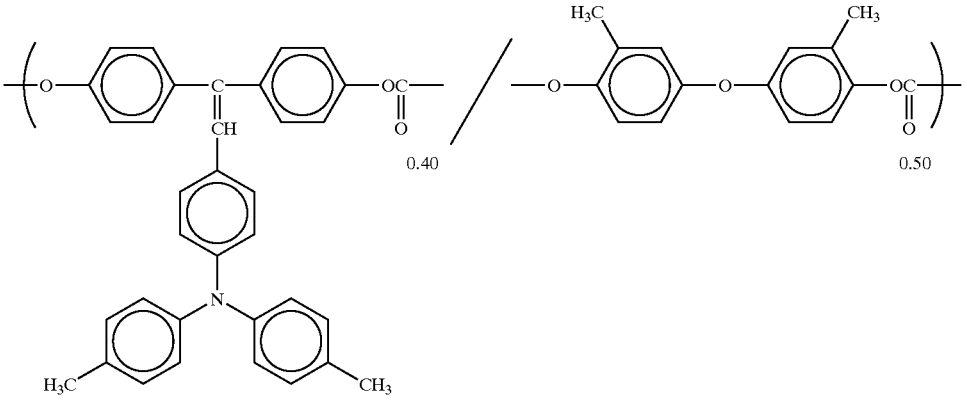

| Ex. No. | Photo-receptor No. | Amine Compound | Initial: Bright portion Potential (-V) | Initial: Image quality | After 100,000 copies: Bright portion Potential (-V) | After 100,000 copies: Image quality |
|---|---|---|---|---|---|---|
| 100 | 100 | 3-4 | 95 | Good | 120 | Good |
| 101 | 101 | 8-1 | 100 | Good | 125 | Good |
| 102 | 102 | 16-1 | 95 | Good | 115 | Good |

Examples 103 and 104

The procedures of preparation and evaluation for the photoreceptor in Example 37 were repeated to prepare and evaluate photoreceptors 103 and 104 except for changing the CTM and the binder resin to the following material. The results are shown in Table 34.

TABLE 34

Polymer CTM having the following formula 19

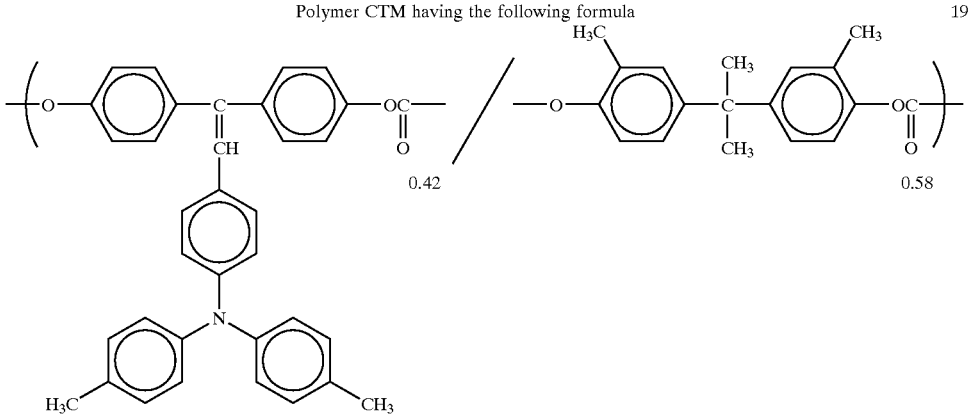

| Ex. No. | Photo-receptor No. | Amine Compound | Initial: Bright portion Potential (-V) | Initial: Image quality | After 100,000 copies: Bright portion Potential (-V) | After 100,000 copies: Image quality |
|---|---|---|---|---|---|---|
| 103 | 103 | 14-1 | 120 | Good | 140 | Good |
| 104 | 104 | 16-1 | 100 | Good | 120 | Good |

Examples 105 and 106

The procedures of preparation and evaluation for the photoreceptor in Example 37 were repeated to prepare and evaluate photoreceptors 105 and 106 except for changing the CTM and the binder resin to the following material. The results are shown in Table 35.

TABLE 35

Polymer CTM having the following formula 19

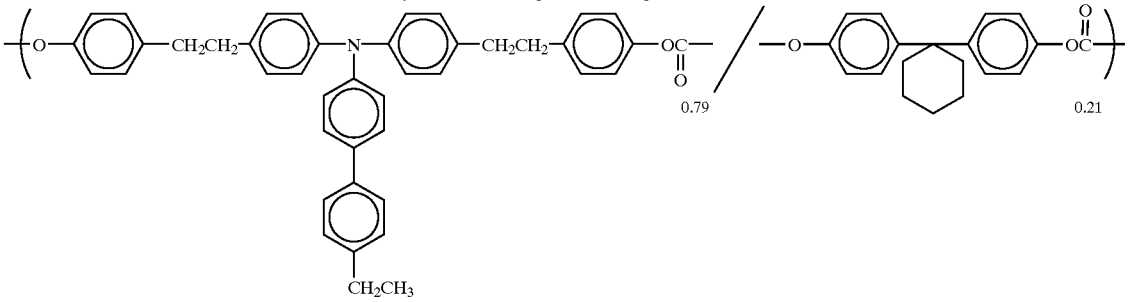

| Ex. No. | Photo-receptor No. | Amine Compound | Initial: Bright portion Potential (-V) | Initial: Image quality | After 100,000 copies: Bright portion Potential (-V) | After 100,000 copies: Image quality |
|---|---|---|---|---|---|---|
| 105 | 105 | 3-4 | 105 | Good | 105 | Good |
| 106 | 106 | 8-1 | 100 | Good | 105 | Good |

Examples 107 to 111

The procedures of preparation and evaluation for the photoreceptor in Example 37 were repeated to prepare and evaluate photoreceptors 107 to 111 except for changing the binder resin to the following material. The results are shown in Table 36.

TABLE 36

| Polyarylate resin (U polymer from Unitika Ltd.) | | | | | | |
|---|---|---|---|---|---|---|
| | | | Initial | | After 100,000 copies | |
| Ex. No. | Photo-receptor No. | Amine Compound | Bright portion Potential (-V) | Image quality | Bright portion Potential (-V) | Image quality |
| 107 | 107 | 3-4 | 110 | Good | 125 | Good |
| 108 | 108 | 8-1 | 110 | Good | 115 | Good |
| 109 | 109 | 14-1 | 95 | Good | 115 | Good |
| 110 | 110 | 16-1 | 105 | Good | 135 | Good |
| 111 | 111 | 3-1 | 110 | Good | 125 | Good |

Examples 112 to 114

The procedures of preparation and evaluation for the photoreceptor in Example 37 were repeated to prepare and evaluate photoreceptors 112 to 114 except for changing the CGL coating liquid and the CTL coating liquid to the following coating liquids. The results are shown in Table 37.

TABLE 37

Figure 9:
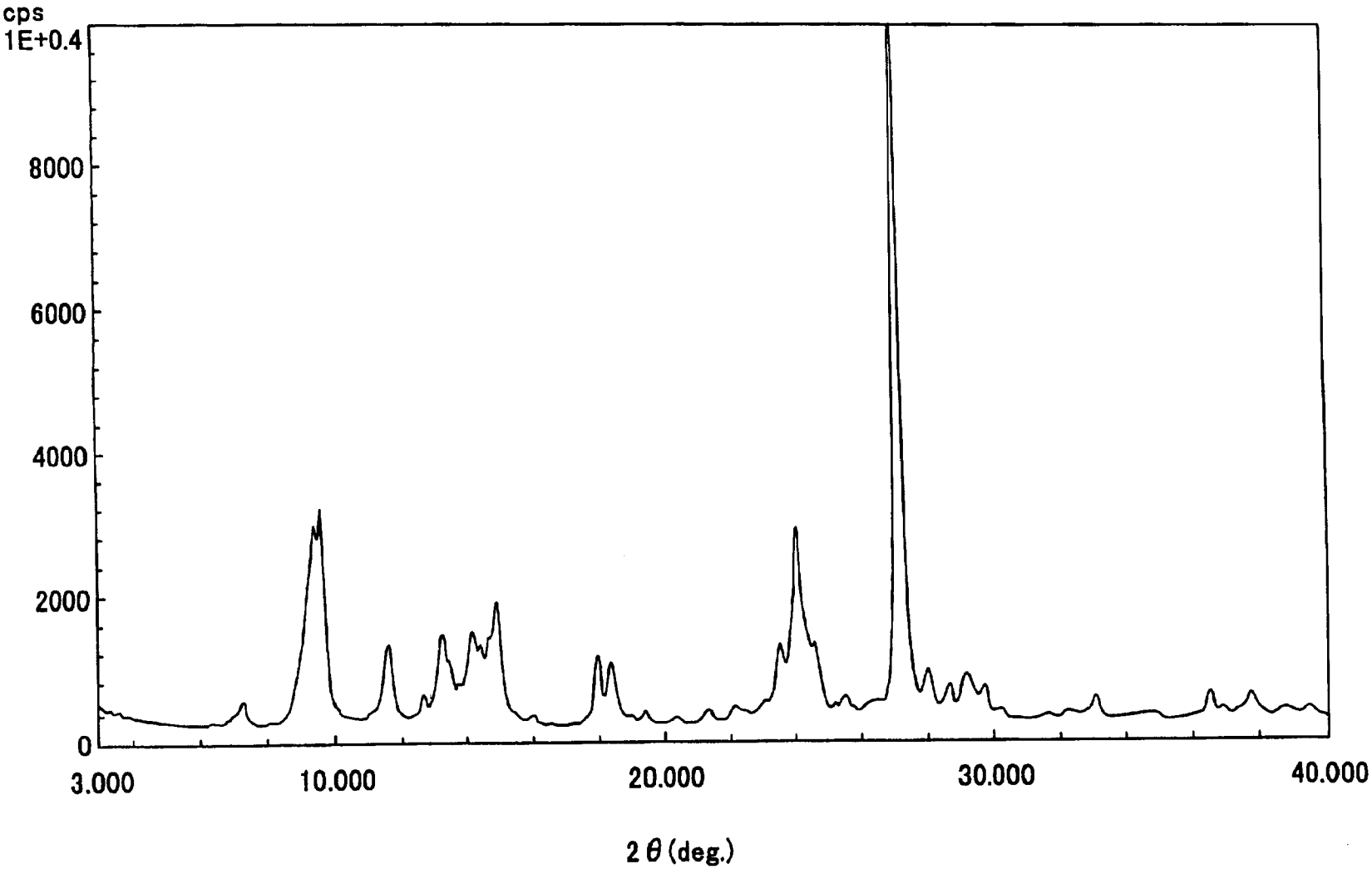
FIG. 9 is a diagram showing a XD spectrum of the phthalocyanine powder for the CGL of the photoreceptor of the present invention.

| | |
|---|---|
| CGL coating liquid | |
| Oxotitaniumphthalocyanine having the powder XD spectrum in FIG. 9 | 8 |
| Polyvinylbutyral | 5 |
| 2-butanone | 400 |
| CTL coating liquid | |
| Polycarbonate resin (C polyca) | 10 |
| The amine compound example No. 3–5 | |
| CTM having the following formula | 7 |

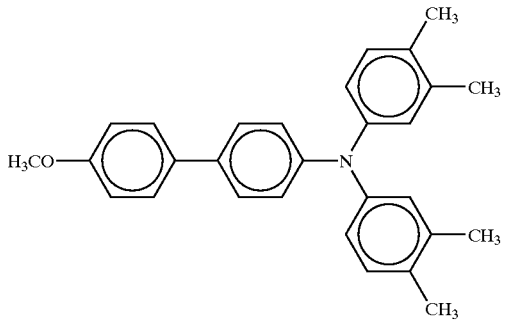

TABLE 37-continued

| Toluene | | | | | 70 | |
|---|---|---|---|---|---|---|
| | | | Initial | | After 100,000 copies | |
| Ex. No. | Photo-receptor No. | Amine Compound | Bright portion Potential (-V) | Image quality | Bright portion Potential (-V) | Image quality |
| 112 | 112 | 3-5 | 110 | Good | 140 | Good |
| 113 | 113 | 8-2 | 110 | Good | 120 | Good |
| 114 | 114 | 16-1 | 120 | Good | 140 | Good |

Examples 115 and 116

The procedures of preparation and evaluation for the photoreceptor in Example 112 were repeated to prepare and evaluate photoreceptors 115 and 116 except for changing the CTM to a material having the following formula. The results are shown in Table 38.

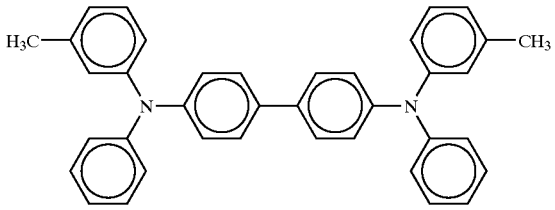

TABLE 38

| | | | Initial | | After 100,000 copies | |
|---|---|---|---|---|---|---|
| Ex. No. | Photo-re ceptor No. | Amine Compound | Bright portion Potential (-V) | Image quality | Bright portion Potential (-V) | Image quality |
| 115 | 115 | 14–12 | 115 | Good | 145 | Good |
| 116 | 116 | 16–12 | 120 | Good | 140 | Good |

Comparative Example 1

The procedures of preparation and evaluation for the photoreceptor in Example 37 were repeated to prepare and evaluate a comparative photoreceptor 1 except for changing the amine compound to a stilbene compound having the following formula. The results are shown in Table 39.

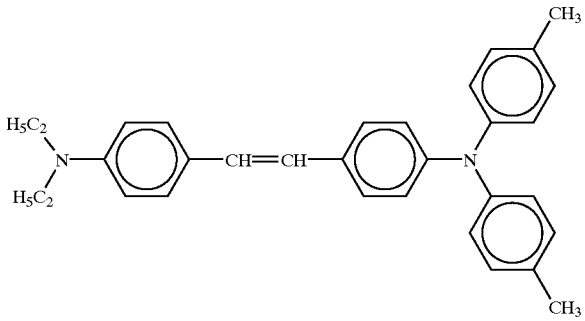

Comparative Example 2

The procedures of preparation and evaluation for the photoreceptor in Example 37 were repeated to prepare and evaluate a comparative photoreceptor 2 except that the amine compound was not included in the CTL coating liquid and the amount of the CTM was changed to 10 parts by weight. The results are shown in Table 39.

Comparative Example 3

The procedures of preparation and evaluation for the photoreceptor in Example88 were repeated to prepare and evaluate a comparative photoreceptor 3 except for changing the amine compound to a tetraphenylmethane compound having the following formula. The results are shown in Table 39.

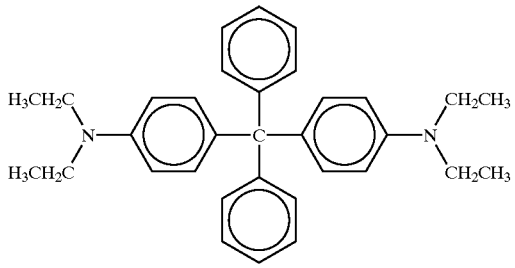

Comparative Example 4

The procedures of preparation and evaluation for the photoreceptor in Example 37 were repeated to prepare and evaluate a comparative photoreceptor 4 except for changing the amine compound to a hindered amine antioxidant having the following formula. The results are shown in Table 39.

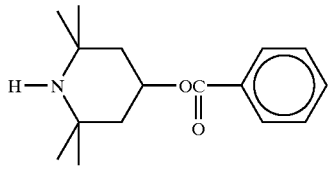

TABLE 39

| | | Initial | | After 100,000 copies | |
|---|---|---|---|---|---|
| Com. Ex. No. | Com. Photo-receptor No. | Bright portion Potential (-V) | Image quality | Bright portion Potential (-V) | Image quality |
| 1 | 1 | 320 | Image density deteriorated | 550 | Image density deteriorated (large), and not readable |
| 2 | 2 | 100 | Good | 135 | Image resolution deteriorated (middle) |
| 3 | 3 | 200 | Image density deteriorated, but image resolution was good | 285 | Image density deteriorated, (middle) but image resolution was good |
| 4 | 4 | 250 | Image density and resolution deteriorated | 480 | Image density deteriorated (large), and not readable |

As the above-mentioned results shows, it was found that a photoreceptor including the amine compound of the present invention can stably produce high quality images without increasing the bright portion potential even after 100,000 copies were produced. To the contrary, the comparative photoreceptors 1, 3 and 4 had very high bright portion potential from the beginning, produced low density and resolution images and the images after 10,000 copies were produced could not be readable because tone of the images largely deteriorated. In addition, the comparative photoreceptor 2 produced lower resolution images than those of the photoreceptor of the present invention due to a repeated use although having a small increase of the bright portion potential.

Examples 117 to 122 and Comparative Example 5

An image evaluation before and after the photoreceptors 1, 8, 11, 37, 84 and 116, and the comparative photoreceptor 2 were left in a desiccator having a NOx gas density of 50 ppm for 4 days was performed. The results are shown in Table 40

TABLE 40

| Example No. | Photoreceptor No. | Initial image quality | Image quality after left in the desiccator |
|---|---|---|---|
| 117 | 1 | Good | Good |
| 118 | 8 | Good | Good |
| 119 | 11 | Good | Good |
| 120 | 37 | Good | Good |
| 121 | 84 | Good | Good |
| 122 | 116 | Good | Good |
| Comparative Example 5 | Comparative Photoreceptor 2 | Good | Image resolution Deteriorated (large) |

As the results shows, it was found that a photoreceptor had a largely improved resistance against oxidized gas when the amine compound of the present invention is included in a surface thereof. In other words, the amine compound of the present invention largely prevented deterioration of image resolution of the resultant images. To the contrary, it was found that the comparative photoreceptor 2 had a good initial image quality, but that the image resolution largely deteriorated due to the oxidized gas.

This document claims priority and contains subject matter related to Japanese Patent Applications Nos. 2001-271060, 2002-188643, 2002-048616, 2002-163547, 2001-367085, 2001-338194, 2002-054889 and 2002-054911 filed on Sep. 6, 2001, Jun. 27, 2002, Feb. 25, 2002, Jun. 4, 2002, Nov. 30, 2001, Nov. 2, 2001, Feb. 28, 2002 and Feb. 28, 2002 respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor comprising:

an electroconductive substrate; and a photosensitive layer located overlying the electroconductive substrate, wherein the photosensitive layer compnses an amino compound having at least one aromatic group substituted with a dialkylamine, wherein the amino compound is at least one selected from the group consisting of the following formulae (1) to (22):

(1)

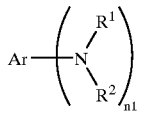

wherein $R^1$ and $R^2$ independently represent an alkyl group having 1 to 4 carbon atoms and optionally share bond connectivity to form a heterocyclic group including the nitrogen atom to which they are attached; n1 represents an integer of from 1 to 4; and Ar represents a substituted or unsubstituted aromatic ring group;

(2)

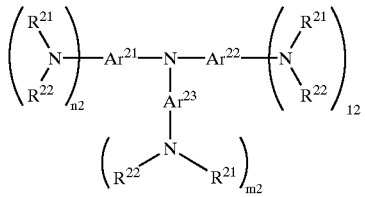

wherein $R^{21}$ and $R^{22}$ independently represent an alkyl group having 1 to 4 carbon atoms and optionally share bond connectivity to form a heterocyclic group including the nitrogen atom to which they are attached; l2, m2 and n2 independently represent 0 or an integer of from 1 to 3, wherein l2, m2 and n2 are not 0 at the same time; $Ar^{21}$, $A^{22}$ and $Ar^{23}$ independently represent a substituted or unsubstituted aromatic ring group; and each of combinations of $Ar^{21}$ and $Ar^{22}$, $Ar^{22}$ and $Ar^{23}$, and $Ar^{23}$ and $Ar^{21}$ optionally shares bond connectivity to form a heterocyclic group including the nitrogen atom to which they are attached;

(3)

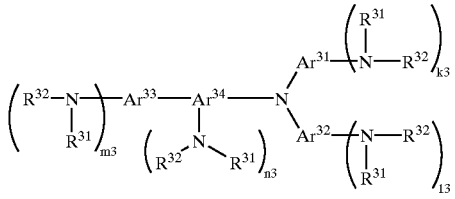

wherein $R^{31}$ and $R^{32}$ independently represent an alkyl group having 1 to 4 carbon atoms and optionally share bond connectivity to form a heterocyclic group including the nitrogen atom to which they are attached; k3, l3, m3 and n3 independently represent 0 or an integer of from 1 to 3, wherein k3, l3, m3 and n3 are not 0 at the same time; $Ar^{31}$, $Ar^{32}$, $Ar^{33}$ and $Ar^{34}$ independently represent a substituted or unsubstituted aromatic ring group; and each of combinations of $Ar^{31}$ and $Ar^{32}$, $Ar^{31}$ and $Ar^{34}$, and $Ar^{33}$ and $Ar^{34}$ shares bond connectivity to form a ring;

(4)

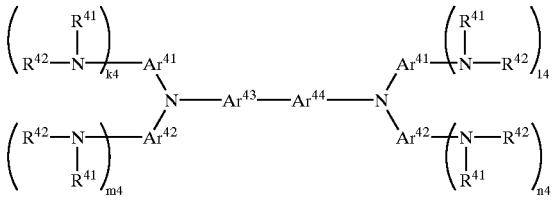

wherein $R^{41}$ and $R^{42}$ independently represent an alkyl group having 1 to 4 carbon atoms and optionally share bond connectivity to form a heterocyclic group including the nitrogen atom to which they are attached; k4, l4, m4 and n4 independently represent 0 or an integer of from 1 to 3, wherein k4, l4, m4 and n4 are not 0 at the same time; $Ar^{41}$, $Ar^{42}$, $Ar^{43}$ and $Ar^{44}$ independently represent a substituted or unsubstituted aromatic ring group; and each of combinations of $Ar^{41}$ and $Ar^{42}$, $Ar^{41}$ and $Ar^{43}$, and $Ar^{43}$ and $Ar^{44}$ optionally shares bond connectivity to form a ring;

(5)

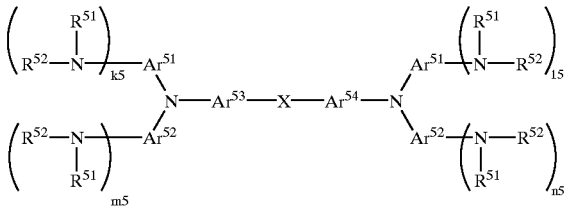

wherein $R^{51}$ and $R^{52}$ independently represent an alkyl group having 1 to 4 carbon atoms and optionally share bond connectivity to form a heterocyclic group including the nitrogen atom to which they are attached; k5, l5, m5 and n5 independently represent 0 or an integer of from 1 to 3, wherein k5, l5, m5 and n5 are not 0 at the same time; $Ar^{51}$, $Ar^{52}$, $Ar^{53}$ and $Ar^{54}$ independently represent a substituted or unsubstituted aromatic ring group; each of combinations of $Ar^{51}$ and $Ar^{52}$, $Ar^{51}$ and $Ar^{53}$, and $Ar^{51}$ and $Ar^{54}$ optionally shares bond connectivity to form a ring; and X represents a methylene group, a cyclohexylidine group, an oxygen atom or a sulfur atom;

(6)

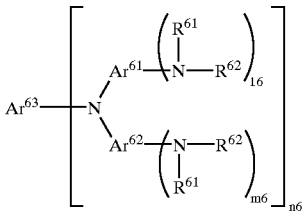

wherein $R^{61}$ and $R^{62}$ independently represent an alkyl group having 1 to 4 carbon atoms and optionally share bond connectivity to form a ring; l6 and m6 independently represent 0 or an integer of from 1 to 3, wherein l6 and m6 are not 0 at the same time; $Ar^{61}$, $Ar^{62}$ and $Ar^{63}$ independently represent a substituted or unsubstituted aromatic ring group; each of combinations of $Ar^{61}$ and $Ar^{62}$ and $Ar^{61}$ and $Ar^{63}$ optionally shares bond connectivity to form a ring; and n6 represents an integer of from 1 to 4;

(7)

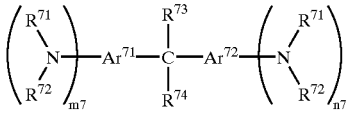

wherein $R^{71}$ and $R^{72}$ independently represent an alkyl group having 1 to 4 carbon atoms and optionally share bond connectivity to form a heterocyclic group including the nitrogen atom to which they are attached; m7 and n7 independently represent 0 or an integer of from 1 to 3, wherein m7 and n7 are not 0 at the same time; $R^{73}$ and $R^{74}$ independently represent a hydrogen atom, a substituted or unsubstituted alkyl group having 1 to 11 carbon atoms and a substituted or unsubstituted aromatic ring group; and $Ar^{71}$ and $Ar^{72}$ independently represent a substituted or unsubstituted aromatic ring group, wherein one of $Ar^{71}$, $Ar^{72}$, $R^{73}$ and $R^{74}$ is an aromatic heterocyclic group;

(8)

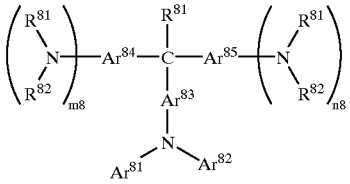

wherein $R^{81}$ and $R^{82}$ independently represent an alkyl group having 1 to 4 carbon atoms and optionally share bond connectivity to form a heterocyclic group including the nitrogen atom to which they are attached; m8 and n8 independently represent 0 or an integer of from 1 to 3, wherein m8 and n8 are not 0 at the same time; $R^{83}$ represents a hydrogen atom, a substituted or unsubstituted alkyl group having 1 to 11 carbon atoms or a substituted or unsubstituted aromatic ring group; $Ar^{81}$, $Ar^{82}$, $Ar^{83}$, $Ar^{84}$ and $Ar^{85}$ independently represent a substituted or unsubstituted aromatic ring group; and $Ar^{81}$ and $Ar^{82}$ or $Ar^{81}$ and $Ar^{83}$ optionally form a heterocyclic group including the nitrogen atom to which they are attached;

(9)

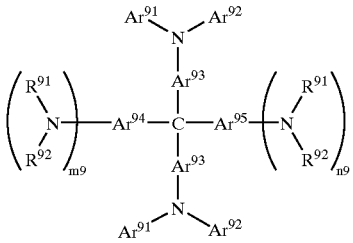

wherein $R^{91}$ and $R^{92}$ independently represent an alkyl group having 1 to 4 carbon atoms and optionally share bond connectivity to form a heterocyclic group including the nitrogen atom to which they are attached; m9 and n9 independently represent 0 or an integer of from 1 to 3, wherein m and n are not 0 at the same time; $Ar^{91}$, $Ar^{92}$, $Ar^{93}$, $Ar^{94}$ and $Ar^{95}$ independently represent a substituted or unsubstituted aromatic ring group; and $Ar^{91}$ and $Ar^{92}$ or $Ar^{91}$ and $Ar^{93}$ optionally form a heterocyclic group including the nitrogen atom to which they are attached;

(10)

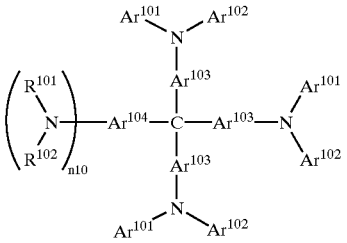

wherein $R^{101}$ and $R^{102}$ independently represent an alkyl group having 1 to 4 carbon atoms and optionally share bond connectivity to form a heterocyclic group including the nitrogen atom to which they are attached; n10 represents an integer of from 1 to 3; $Ar^{101}$, $Ar^{102}$, $Ar^{103}$ and $Ar^{104}$ independently represent a substituted or unsubstituted aromatic ring group; and $Ar^{101}$ and $Ar^{102}$ or $Ar^{101}$ and $Ar^{103}$ optionally form a heterocyclic group including the nitrogen atom to which they are attached;

(11)

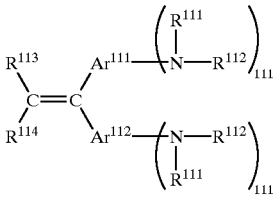

wherein $R^{111}$ and $R^{112}$ independently represent an alkyl group having 1 to 4 carbon atoms and optionally share bond connectivity to form a heterocyclic group including the nitrogen atom to which they are attached; l11 represents an integer of from 1 to 3; $Ar^{111}$ and $Ar^{112}$ independently represent a substituted or unsubstituted aromatic ring group; $R^{113}$ and $R^{114}$ independently represent a hydrogen atom, a substituted or unsubstituted alkyl group having 1 to 4 carbon atoms, a substituted or unsubstituted aromatic ring group or a group having the following formula:

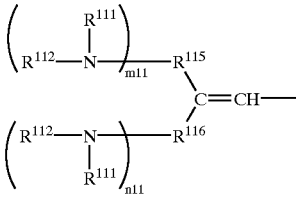

wherein $R^{111}$ and $R^{112}$ independently represent an alkyl group having 1 to 4 carbon atoms and optionally share bond connectivity to form a heterocyclic group including the nitrogen atom to which they are attached; m11 and n11 independently represent 0 or an integer of from 1 to 3; and $R^{115}$ and $R^{116}$ independently represent a hydrogen atom, a substituted or unsubstituted alkyl group having 1 to 4 carbon atoms or a substituted or unsubstituted aromatic ring group, and wherein each of combinations of $R^{113}$ and $R^{114}$, $R^{115}$ and $R^{116}$, and $Ar^{111}$ and $Ar^{112}$ optionally shares bond connectivity to form a ring;

(12)

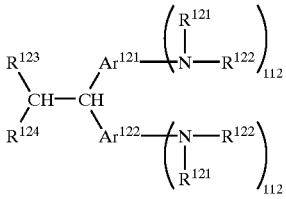

wherein $R^{121}$ and $R^{122}$ independently represent an alkyl group having 1 to 4 carbon atoms and optionally share bond connectivity to form a heterocyclic group including the nitrogen atom to which they are attached; l12 represents an integer of from 1 to 3; $Ar^{121}$ and $Ar^{122}$ independently represent a substituted or unsubstituted aromatic ring group; $R^{123}$ and $R^{124}$ independently represent a hydrogen atom, a substituted or unsubstituted alkyl group having 1 to 4 carbon atoms, a substituted or unsubstituted aromatic ring group or a group having the following formula;

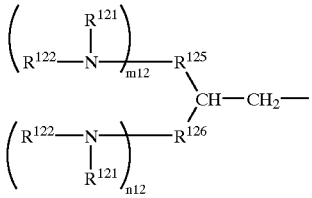

wherein $R^{121}$ and $R^{122}$ independently represent an alkyl group having 1 to 4 carbon atoms and optionally share bond connectivity to form a heterocyclic group including the nitrogen atom to which they are attached; $R^{123}$ and $R^{124}$ are not hydrogen atoms at the same time; m12 and n12 independently represent 0 or an integer of from 1 to 3; and $R^{125}$ and $R^{126}$ independently represent a hydrogen atom, a substituted or unsubstituted alkyl group having 1 to 4 carbon atoms or a substituted or unsubstituted aromatic ring group, and wherein each of combinations of $R^{123}$ and $R^{124}$, $R^{125}$ and $R^{126}$, and $Ar^{121}$ and $Ar^{122}$ optionally shares bond connectivity to form a ring;

(13)

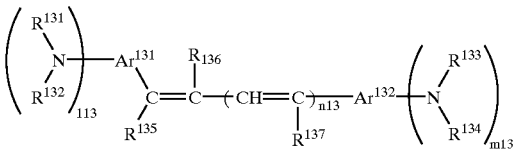

wherein $R^{131}$ and $R^{132}$ independently represent an alkyl group having 1 to 4 carbon atoms and optionally share bond connectivity to form a heterocyclic group including the nitrogen atom to which they are attached; $R^{133}$ and $R^{134}$ independently represent a substituted or unsubstituted alkyl group having 1 to 4 carbon atoms or a substituted or unsubstituted aromatic ring group; $R^{135}$, $R^{136}$ and $R^{137}$ independently represent a hydrogen atom, a substituted or unsubstituted alkyl group having 1 to 4 carbon atoms or a substituted or unsubstituted aromatic ring group; $Ar^{131}$ and $Ar^{132}$ independently represent a substituted or unsubstituted aromatic ring group; $R^{133}$ and $R^{134}$ or $Ar^{132}$ and $R^{134}$ optionally form a heterocyclic group including the nitrogen atom to which they are attached; $Ar^{131}$ and $R^{135}$ optionally form a ring; l13 represents an integer of from 1 to 3; m13 represents 0 or an integer of from 1 to 3; and n 13 represents 0 or 1;

(14)

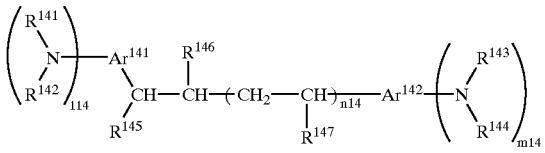

wherein $R^{141}$ and $R^{142}$ independently represent an alkyl group having 1 to 4 carbon atoms and optionally share bond connectivity to form a heterocyclic group including the nitrogen atom to which they are attached; $R^{143}$ and $R^{144}$ independently represent a substituted or unsubstituted alkyl group having 1 to 4 carbon atoms or a substituted or unsubstituted aromatic ring group; $R^{145}$, $R^{146}$ and $R^{147}$ independently represent a hydrogen atom, a substituted or unsubstituted alkyl group having 1 to 4 carbon atoms or a substituted or unsubstiluted aromatic ring group; $Ar^{141}$ and $Ar^{142}$ independently represent a substituted or unsubstituted aromatic ring group; $R^{143}$ and $R^{144}$ or $Ar^{142}$ and $R^{144}$ optionally form a heterocyclic group including the nitrogen atom to which they are attached; $Ar^{141}$ and $R^{145}$ optionally form a ring; l14 represents an integer of from 1 to 3; m14 represents 0 or an integer of from 1 to 3; and n14 represents 0 or 1;

(15)

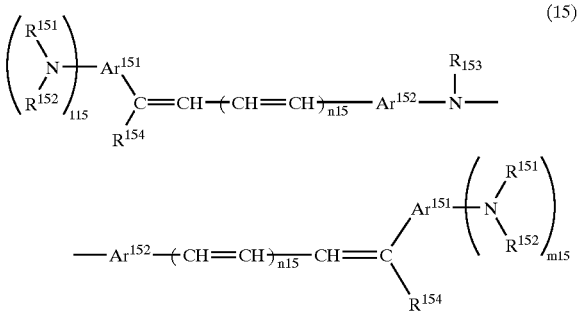

wherein $R^{151}$ and $R^{152}$ independently represent an alkyl group having 1 to 4 carbon atoms and optionally share bond connectivity to form a heterocyclic group including the nitrogen atom to which they are attached; l15 and m15 independently represent 0 or an integer of from 1 to 3, wherein l15 and m15 are not 0 at the same time; $R^{153}$ represents a substituted or unsubstituted alkyl group having 1 to 4 carbon atoms or a substituted or unsubstituted aromatic ring group; $R^{154}$ represents a hydrogen atom, a substituted or unsubstituted alkyl group having 1 to 4 carbon atoms or a substituted or unsubstituted aromatic ring group; $Ar^{151}$ and $Ar^{152}$ independently represent a substituted or unsubstituted aromatic ring group; $Ar^{151}$ and $R^{154}$, $Ar^{152}$ and $R^{153}$ or $Ar^{152}$ and another $Ar^{152}$ optionally form a ring; and n15 represents 0 or 1;

(16)

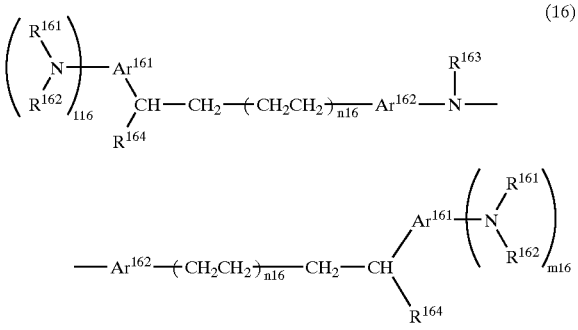

wherein $R^{161}$ and $R^{162}$ independently represent an alkyl group having 1 to 4 carbon atoms and optionally share bond connectivity to form a heterocyclic group including the nitrogen atom to which they are attached; l16 and m16 independently represent 0 or an integer of from 1 to 3, wherein l16 and m16 are not Oat the same time; $R^{163}$ represents a substituted or unsubstituted alkyl group having 1 to 4 carbon atoms or a substituted or unsubstituted aromatic ring group; $R^{164}$ represents a hydrogen atom, a substituted or unsubstituted alkyl group having 1 to 4 carbon atoms or a substituted or unsubstituted aromatic ring group; $Ar^{161}$ and $Ar^{162}$ independently represent a substituted or unsubstituted aromatic ring group; $Ar^{161}$ and $R^{164}$, $Ar^{162}$ and $R^{163}$ or $Ar^{162}$ and another $Ar^{162}$ optionally form a ring; and n16 represents 0 or 1;

(17)

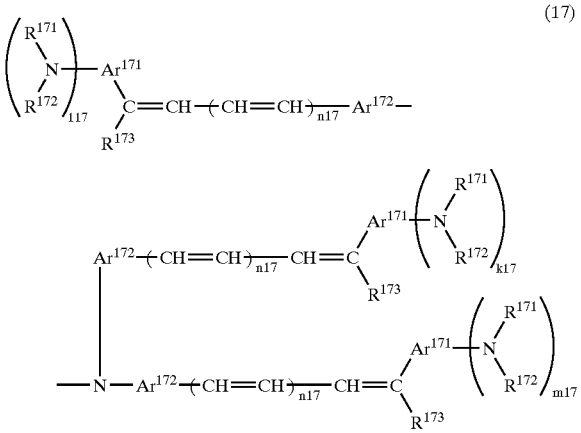

wherein $R^{171}$ and $R^{172}$ independently represent an alkyl group having 1 to 4 carbon atoms and optionally share bond connectivity to form a heterocyclic group including the nitrogen atom to which they are attached; k17, l17 and m17 independently represent 0 or an integer of from 1 to 3, wherein k17, l17 and m17 are not Oat the same time; $R^{173}$ represents a hydrogen atom, a substituted or unsubstituted alkyl group having 1 to 4 carbon atoms or a substituted or unsubstituted aromatic ring group; $Ar^{171}$ and $Ar^{172}$ independently represent a substituted or unsubstituted aromatic ring group; $Ar^{171}$ and $R^{174}$, $Ar^{172}$ and $R^{173}$ or $Ar^{172}$ and another $Ar^{172}$ optionally form a ring; and n17 represents 0 or 1;

(18)

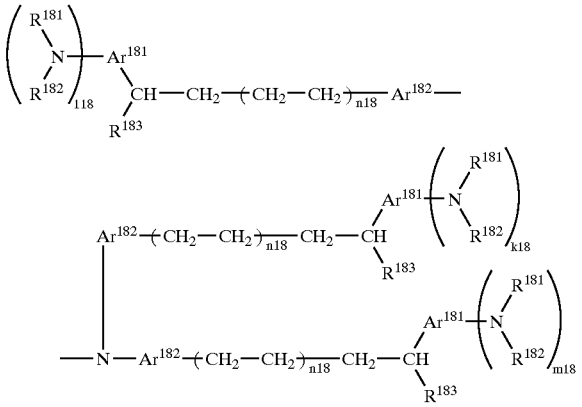

wherein $R^{181}$ and $R^{182}$ independently represent an alkyl group having 1 to 4 carbon atoms and optionally share bond connectivity to form a heterocyclic group including the nitrogen atom to which they are attached; k18, l18 and m18 independently represent 0 or an integer of from 1 to 3, wherein k18, l18 and m18 are not 0 at the same time; $R^{183}$ represents a hydrogen atom, a substituted or unsubstituted alkyl group having 1 to 4 carbon atoms or a substituted or unsubstituted aromatic ring group; $Ar^{181}$ and $Ar^{182}$ represent a substituted or unsubstituted aromatic ring group; $Ar^{181}$ and $R^{184}$, $Ar^{182}$ and $R^{183}$ or $Ar^{182}$ and another $Ar^{182}$ optionally form a ring; and n18 represents 0 or 1;

(19)

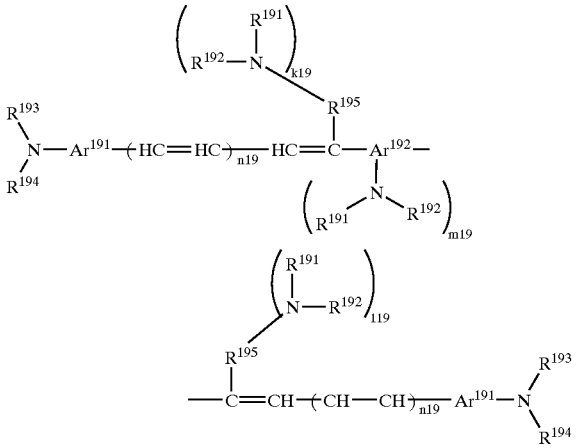

wherein $R^{191}$ and $R^{192}$ independently represent an alkyl group having 1 to 4 carbon atoms and optionally share bond connectivity to form a heterocyclic group including the nitrogen atom to which they are attached; $R^{193}$ and $R^{194}$ independently represent a substituted or unsubstituted alkyl group having 1 to 4 carbon atoms or a substituted or unsubstituted aromatic ring group; $R^{195}$ represents a hydrogen atom, a substituted or unsubstituted alkyl group having 1 to 4 carbon atoms or a substituted or unsubstituted aromatic ring group; $Ar^{191}$ and $Ar^{192}$ independently represent a substituted or unsubstituteci aromatic group; $R^{193}$ and $R^{194}$ or $Ar^{191}$ and $R^{194}$ optionally form a heterocyclic group including the nitrogen atom to which they are attached ; k19, l19 and m19 independently represent 0 or an integer of from 1 to 3; n19 represents 1 or 2; and $R^{193}$ and $R^{194}$ independently represent an alkyl group having 1 to 4 carbon atoms when k19, l19 and m19 are 0 at the same time, and $R^{193}$ and $R^{194}$ optionally share bond connectivity to form a heterocyclic group including the nitrogen atom to which they are attached;

(20)

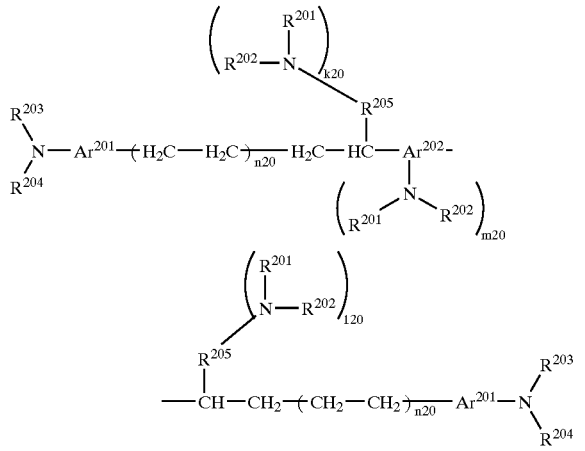

wherein $R^{201}$ and $R^{202}$ independently represent an alkyl group having 1 to 4 carbon atoms and optionally share bond connectivity to form a heterocyclic group including the nitrogen atom to which they are attached; $R^{203}$ and $R^{204}$ independently represent a substituted or unsubstituted alkyl group having 1 to 4 carbon atoms or a substituted or unsubstituted aromatic ring group; $R^{205}$ represents a hydrogen atom, a substituted or unsubstituted alkyl group having 1 to 4 carbon atoms or a substituted or unsubstituted aromatic ring group; $Ar^{201}$ and $Ar^{202}$ independently represent a substituted or unsubstituted aromatic ring group; $R^{203}$ and $R^{204}$ or $Ar^{201}$ and $R^{204}$ optionally form a heterocyclic group including the nitrogen atom to which they are attached; m20 represents 0 or an integer of from 1 to 4; n20 represents 1 or 2; and $R^{203}$ and $R^{204}$ independently represent an alkyl group having 1 to 4 carbon atoms when m20 is 0, and $R^{203}$ and $R^{204}$ optionally share bond connectivity to form a heterocyclic group including the nitrogen atom to which they are attached;

(21)

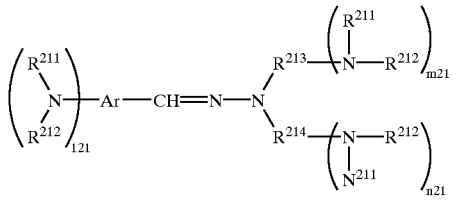

wherein $R^{211}$ and $R^{212}$ independently represent an alkyl group having 1 to 4 carbon atoms and optionally share bond connectivity to form a heterocyclic group including the nitrogen atom to which they are attached; Ar represents a substituted or unsubstituted aromatic ring group; $R^{213}$ and $R^{214}$ independently represent a hydrogen atom, a substituted or unsubstituted alkyl group having 1 to 4 carbon atoms or a substituted or unsubstituted aromatic ring group; and l21, m21 and n21 independently represent 0 or an integer of from 1 to 3, and are not 0 at the same time;

(22)

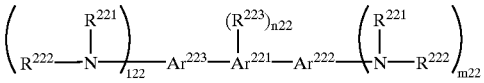

wherein $R^{221}$ and $R^{222}$ independently represent an alkyl group having 1 to 4 carbon atoms and optionally share bond connectivity to form a heterocyclic group including the nitrogen atom to which they are attached; $Ar^{221}$, $Ar^{222}$ and $Ar^{223}$ independently represent a substituted or unsubstituted aromatic ring group; $R^{223}$ represents a hydrogen atom, a substituted or unsubstituted alkyl group having 1 to 4 carbon atoms or a substituted or unsubstituted aromatic ring group; l22 and m22 independently represent 0 or an integer of from 1 to 3, and are not 0 at the same time; and n22 represents an integer of from 1 to 3.

2. The electrophotographic photoreceptor of claim 1, wherein an outermost portion of the photosensitive layer comprises a filler.

3. The electrophotographic photoreceptor of claim 1, wherein the photosensitive layer further comprises a charge transport material.

4. The electrophotographic photoreceptor of claim 3, wherein the charge transport material is a charge transport material having a formula selected from the group consisting of the following formulae (23) and (24):

(23)

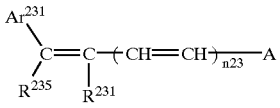

wherein n23 is 0 or 1; $R^{231}$ represents a hydrogen atom, an ailcyl group or an unsubstituted phenyl group; $Ar^{231}$ represents a substituted or unsubstituted aryl group; $R^{235}$ represents an alkyl group including a substituted alkyl group or a substituted or unsubstituted aryl group; and A represents 9-anthryl group, a substituted or unsubstituted carbazolyl group or a group having the following formulae:

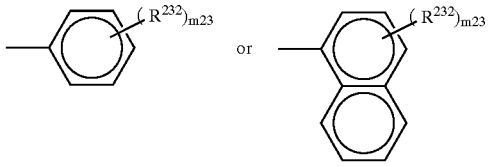

wherein m23 is an integer of from 1 to 3; $R^{232}$ rep resents a hydrogen atom, an alkyl group, an alkoxy group, a halogen atom or a group having the following formula:

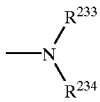

wherein $R^{233}$ and $R^{234}$ independently represent a substituted or unsubstituted aryl group; $R^{233}$ and $R^{234}$ optionally form a ring, and wherein each $R^{232}$ is optionally the same or different from each other when m23 is not less than 2, and A and $R^{231}$ option ally form a ring when n23 is 0; and (24)

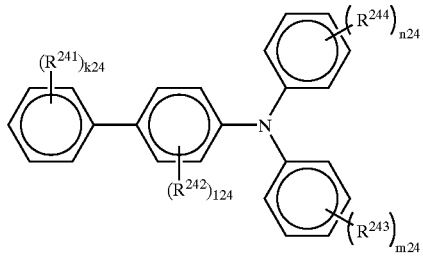

wherein $R^{241}$, $R^{243}$ and $R^{244}$ independently represent a hydrogen atom, an amino group, an alkoxy group, a thioalkoxy group, an aryloxy group, a methylenedioxy group, a substituted or unsubstituted alkyl group, a halogen atom or a substituted or unsubstituted aryl group; $R^{242}$ represents a hydrogen atom, an alkoxy group, a substituted or unsubstituted alkyl group or a halogen atom; and k24, l24, m24 and n24 are independently an integer of from 1 to 4, and $R^{241}$, $R^{242}$, $R^{243}$ and $R^{244}$ are optionally the same or different from the others when k24, l24, m24, and n24 are an integer of from 2 to 4.

5. The electrophotographic photoreceptor of claim 1, wherein the photosensitive layer further comprises a charge transport polymer material.

6. The electrophotographic photoreceptor of claim 5, wherein the charge transport polymer material is a charge transport polymer material having a formula selected from the group consisting of the following formulae (25) and (26):

(25)

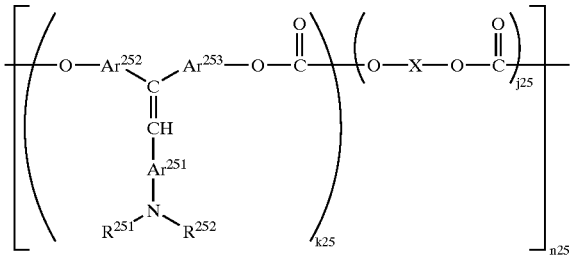

wherein, $R^{251}$ and $R^{252}$ repres tituted or unsubstituted aromatic ring group; $Ar^{251}$, $Ar^{252}$ and $Ar^{253}$ independently represent an aromatic ring group; k25 is a number of from 0.1 to 1.0 and j25 is a number of from 0 to 0.9; n25 represents a repeating number and is an integer of from 5 to 5,000; and X represents a divalent aliphatic group, a divalent alicyclic group or a divalent group having the following formula:

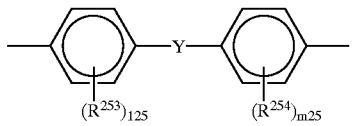

wherein, $R^{253}$ and $R^{254}$ independently represent a substituted or unsubstituted alkyl group, a substituted or unsubstituted aryl group, or a halogen atom; l25 and m25 represent 0 or an integer of from 1 to 4; and Y represents a direct bonding, a linear alkylene group, a branched alkylene group, a cyclic alkylene group, —O—, —S—, —SO—, —SO2-, —CO—, —CO—O-Z-O—CO— (Z represents a divalent aliphatic group), or a group having the following formula:

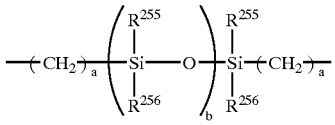

wherein, a is an integer of from 1 to 20; b is an integer of from 1 to 2,000; and $R^{255}$ and $R^{256}$ independently represent a substituted or unsubstituted alkyl group, or a substituted or unsubstituted aryl group, and wherein $R^{253}$, $R^{254}$, $R^{255}$ and $R^{256}$ are optionally the same or different from the others; and

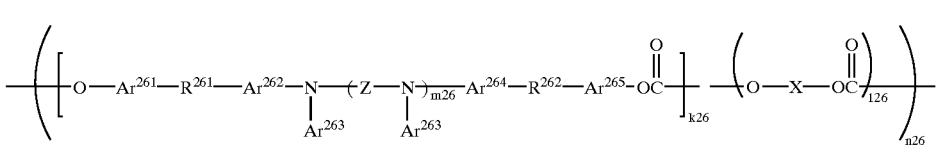

(26)

wherein $Ar^{261}$, $A^{262}$, $Ar^{263}$, $Ar^{264}$ and $Ar^{265}$ represent a substituted or unsubstituted aromatic ring group; Z represents an aromatic ring group or —$Ar^{266}$-Za-$Ar^{266}$—; $Ar^{266}$ represents a substituted or unsubstituted aromatic ring group, wherein Za represents O,S or an alkylene group; $R^{261}$ and $R^{262}$ represent a linear alkylene group or a branched alkylene group; m26 is 0 or 1; and X is the same as that of formula (25); k26 is a number of from 0.1 to 1.0; l26 is a number of from 0 to 0.9; and n26 represents a repeating number and is an integer of from 5 to 5,000.

7. An electrophotographic photoreceptor comprising:

an electroconductive substrate;

a photosensitive layer; and a protection layer, wherein the protection layer comprises:

a filler;

an organic compound having an acid value of from 10 to 400 mgKOH/g; and an amino compound having at least one aromatic group substituted with a dialkylamine;

wherein the amino compound is at least one selected from the group consisting of the formulae (1) to (22) of claim 1.

8. The electrophotographic photoreceptor of claim 7, wherein the protection layer further comprises a charge transport material.

9. The electrophotographic photoreceptor of claim 7, wherein the organic compound having an acid value of from 10 to 400 mgKOH/g is a polycarboxylic acid.

10. The electrophotographic photoreceptor of claim 7, wherein the organic compound having an acid value of from 10 to 400 mgKOH/g is selected from the group consisting of polyester resins, acrylic resins, copolymers including at least one of a polyester unit and an acrylic unit, and mixtures thereof.

11. The electrophotographic photoreceptor of claim 7, wherein the organic compound having an acid value of from 10 to 400 mgKOH/g comprises an organic fatty acid.

12. The electrophotographic photoreceptor of claim 7, wherein the filler comprises an inorganic pigment.

13. The electrophotographic photoreceptor of claim 12, wherein the inorganic pigment comprises a metal oxide.

14. The electrophotographic photoreceptor of claim 12, wherein the inorganic pigment has a pH not less than 5.

15. The electrophotographic photoreceptor of claim 12, wherein the inorganic pigment has a dielectric constant not less than 5.

16. The electrophotographic photoreceptor of claim 7, wherein the filler has an average primary particle diameter of from 0.01 to 0.5 $\mu$m.

17. The electrophotographic photoreceptor of claim 7, wherein the protection layer further comprises a binder resin, wherein the binder resin is selected from the group consisting of polycarbonate resins, polyarylate resins and mixtures thereof.

18. The electrophotographic photoreceptor of claim 7, wherein the protection layer further comprises an antioxidant, wherein the antioxidant is a compound selected from the group consisting of hydroquinone compounds and hindered amine compounds.

19. An image forming method comprising:

charging an electrophotographic photoreceptor; and irradiating the electrophotographic photoreceptor with light to form an electrostatic latent image thereon, wherein the electrophotographic photoreceptor is the electrophotographic photoreceptor according to claim 1.

20. The image forming method of claim 19, wherein the light irradiating is performed by using a laser diode or a light emitting diode.

21. An image forming method comprising:

charging an electrophotographic photoreceptor; and irradiating the electrophotographic photoreceptor with light to form an electrostatic latent image thereon, wherein the electrophotographic photoreceptor is the electrophotographic photoreceptor according to claim 7.

22. The image forming method of claim 21, wherein the light irradiating is performed by using a laser diode or a light emitting diode.

23. An image forming apparatus comprising:

a charger configured to charge an electrophotographic photoreceptor; and an irradiator configured to irradiate the electrophotographic photoreceptor with light, wherein the electrophotographic photoreceptor is the electrophotographic photoreceptor according to claim 1.

24. The image forming apparatus of claim 23, wherein the irradiator comprises a laser diode or a light emitting diode.

25. An image forming apparatus comprising:

a charger configured to charge an electrophotographic photoreceptor; and an irradiator configured to irradiate the electrophotographic photoreceptor with light, wherein the electrophotographic photoreceptor is the electrophotographic photoreceptor according to claim 7.

26. The image forming apparatus of claim 25, wherein the irradiator comprises a laser diode or a light emitting diode.

27. A process cartridge comprising:

an electrophotographic photoreceptor; and at least one of a charger;

an irradiator;

an image developer;

an image transferer;

a cleaner; and a discharger, wherein the electrophotographic photoreceptor is the electrophotographic photoreceptor according to claim 1.

28. A process cartridge comprising:

an electrophotographic photoreceptor; and at least one of a charger;

an irradiator;

an image developer;

an image transferer;

a cleaner; and a discharger, wherein the electrophotographic photoreceptor is the electrophotographic photoreceptor according to claim 7.

29. The electrophotographic photoreceptor of claim 1, comprising at least one amino compound selected from the group consisting of:

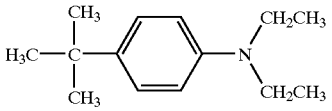

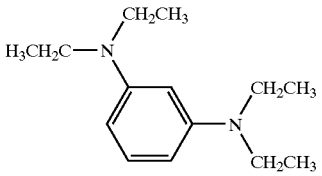

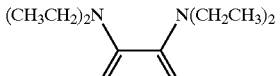

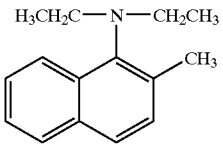

-continued

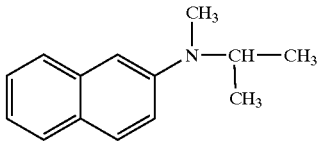

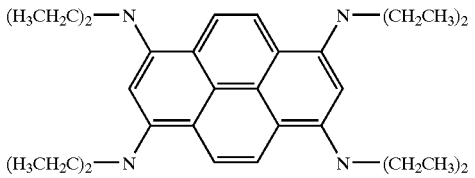

and

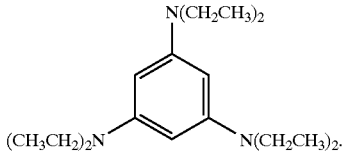

30. The electrophotographic photoreceptor of claim 1, comprising at least one amino compound selected from the group consisting of:

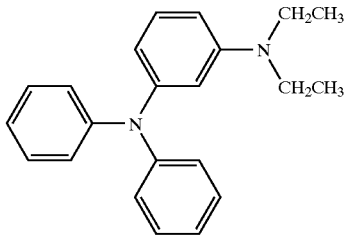

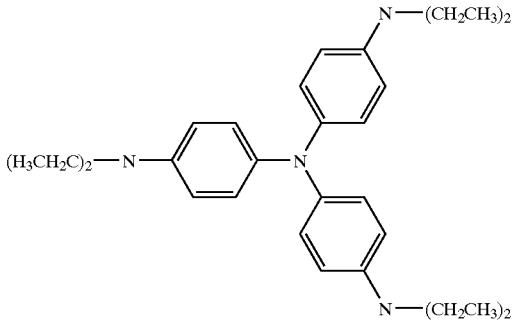

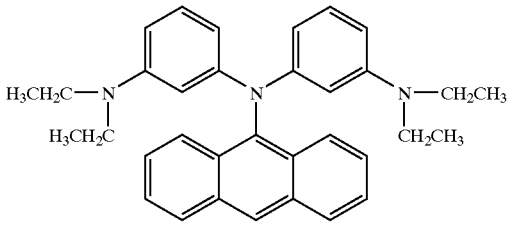

-continued
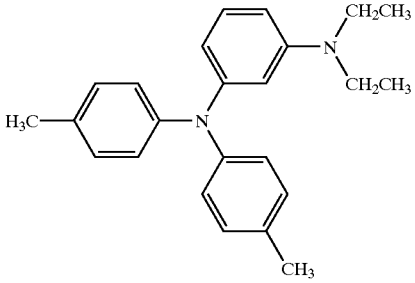
and
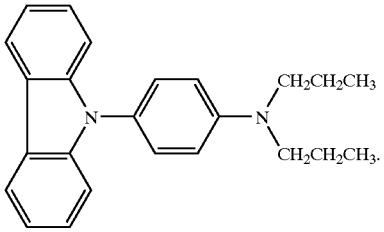
31. The electrophotographic photoreceptor of claim 1, comprising at least one amino compound selected from the group consisting of:
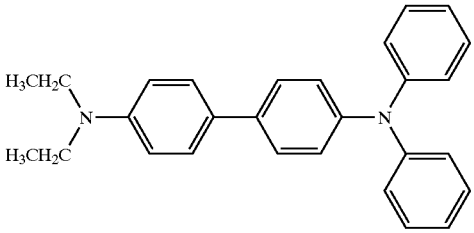
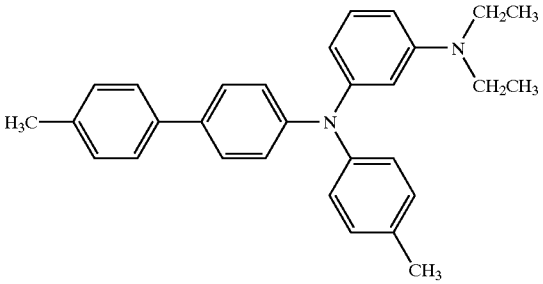
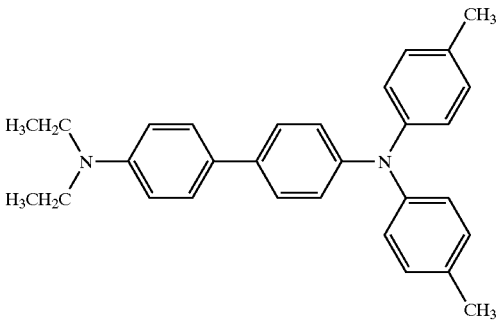
-continued
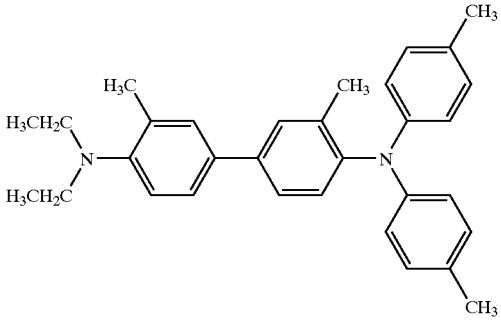
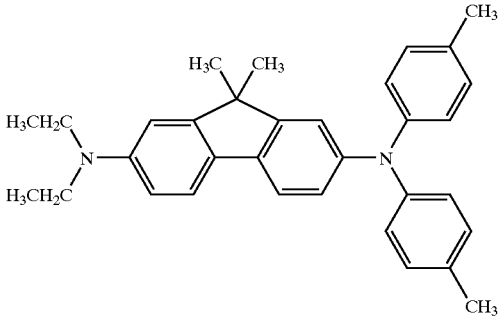
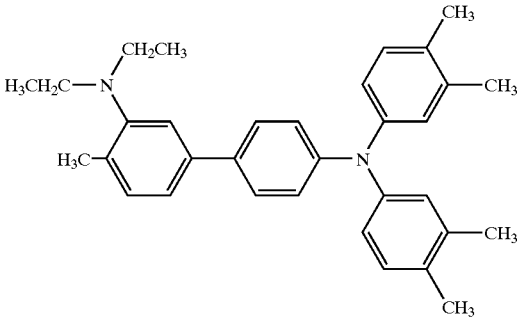
and
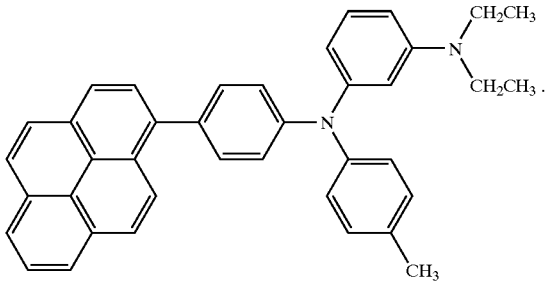
32. The electrophotographic photoreceptor of claim 1, comprising at least one amino compound selected from the group consisting of:
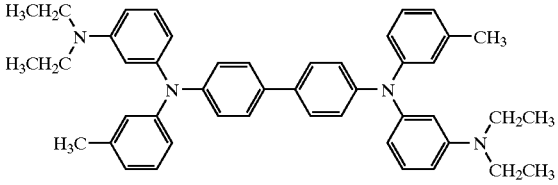

-continued

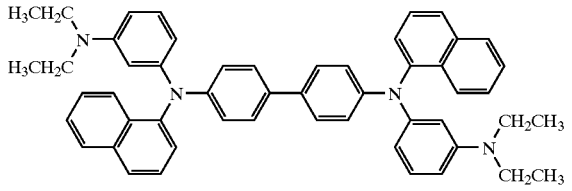

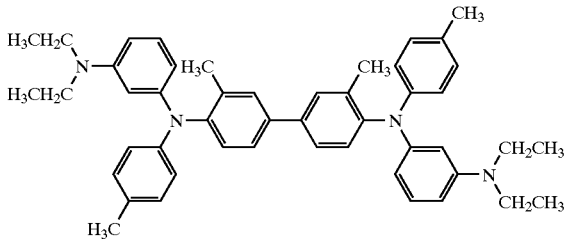

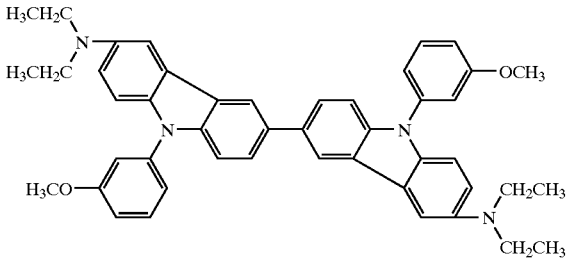

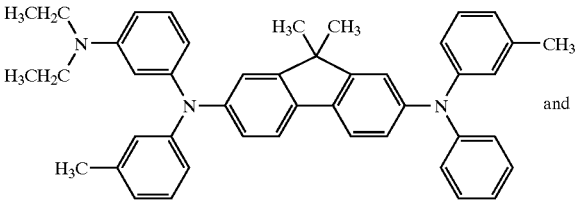

and

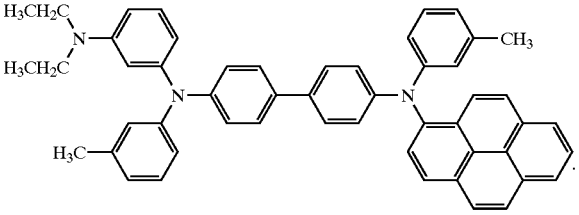

33. The electrophotographic photoreceptor of claim 1, comprising at least one amino compound selected from the group consisting of:

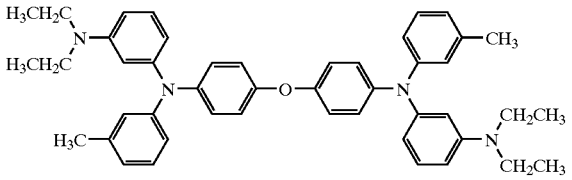

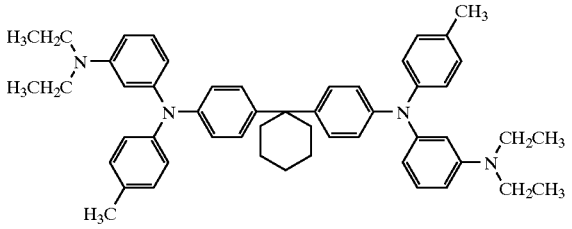

-continued

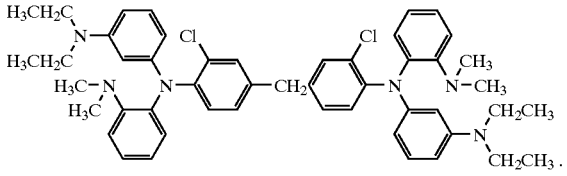

34. The electrophotographic photoreceptor of claim 1, comprising at least one amino compound selected from the group consisting of:

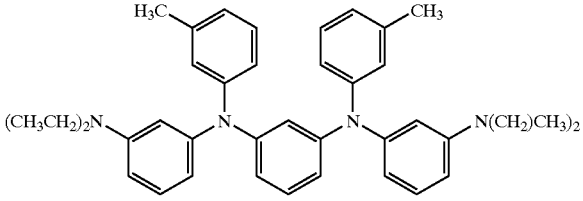

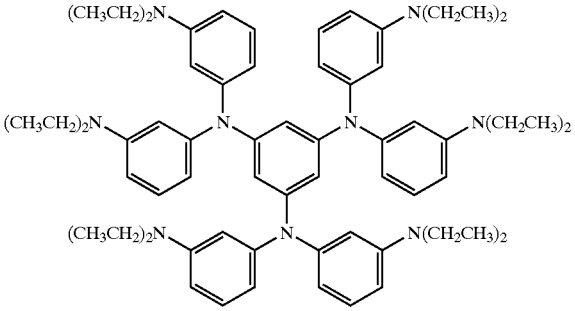

and

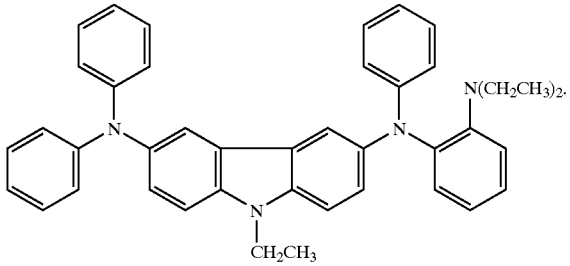

35. The electrophotographic photoreceptor of claim 1, comprising at least one amino compound selected from the group consisting of:

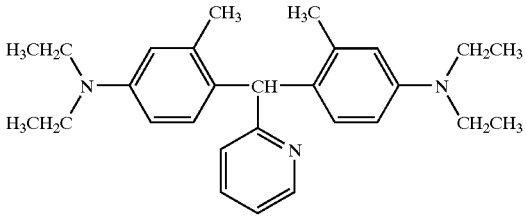

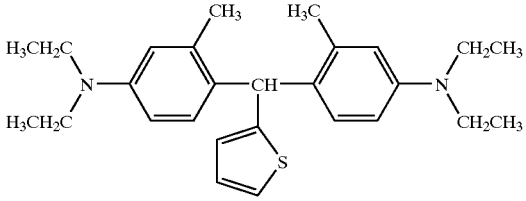

-continued
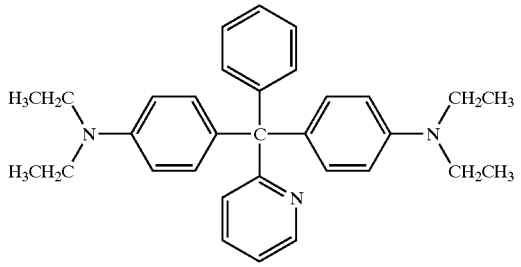
and
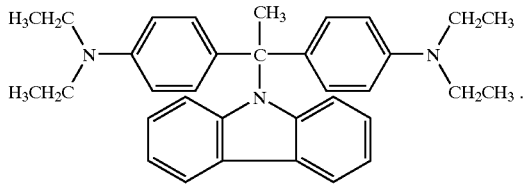
36. The electrophotographic photoreceptor of claim 1, comprising at least one amino compound selected from the group consisting of:
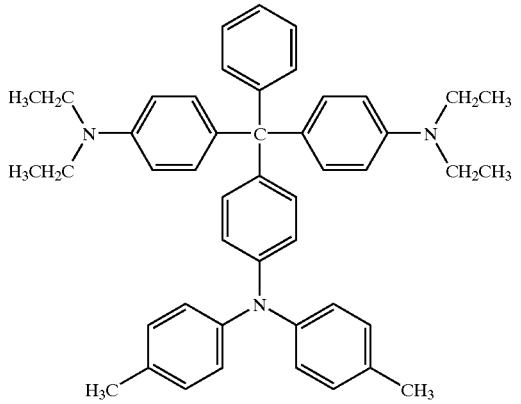
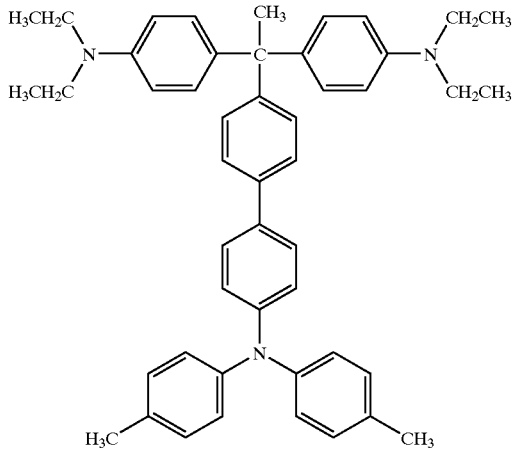
-continued
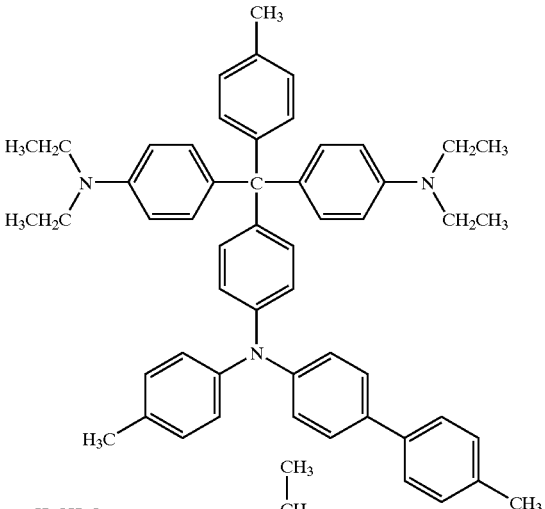
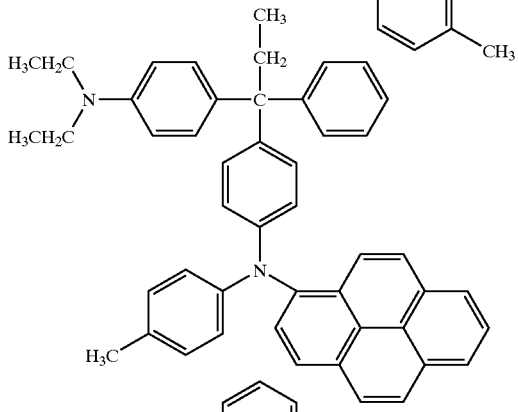
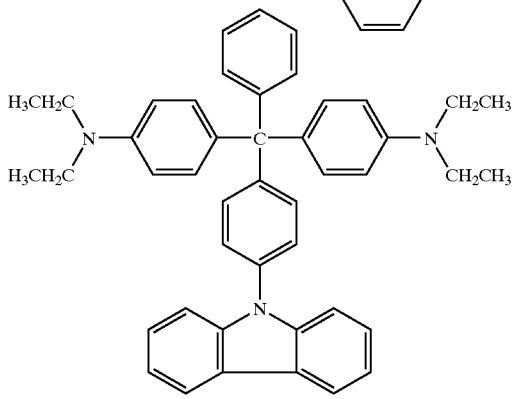
and
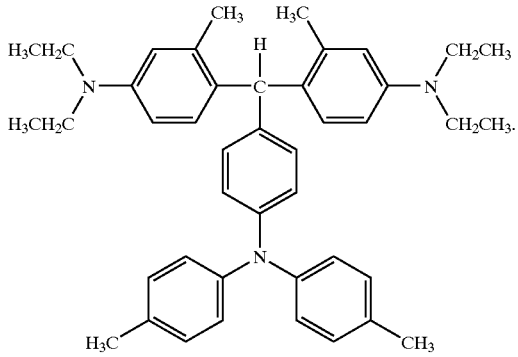
37. The electrophotographic photoreceptor of claim 1, comprising at least one amino compound selected from the group consisting of:

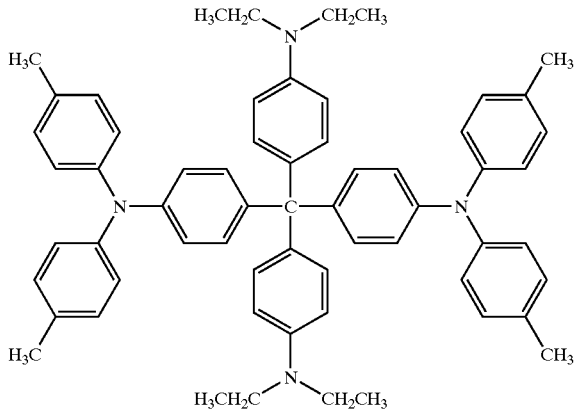
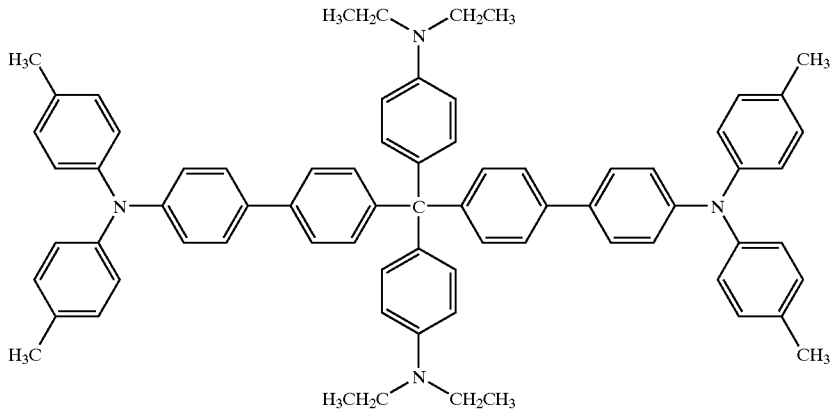
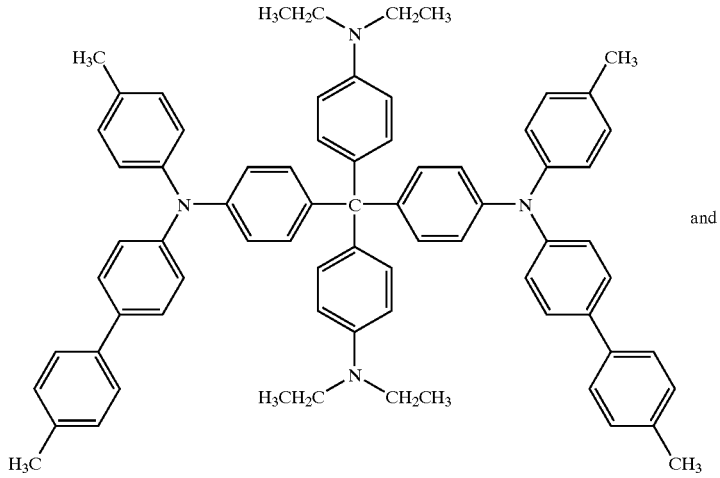
and

-continued
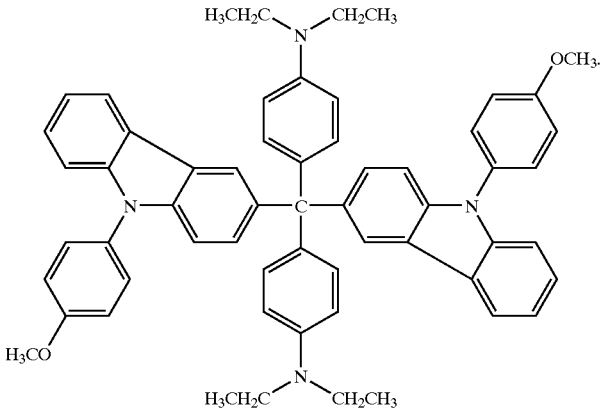
38. The electrophotographic photoreceptor of claim 1, comprising at least one amino compound selected from the group consisting of:
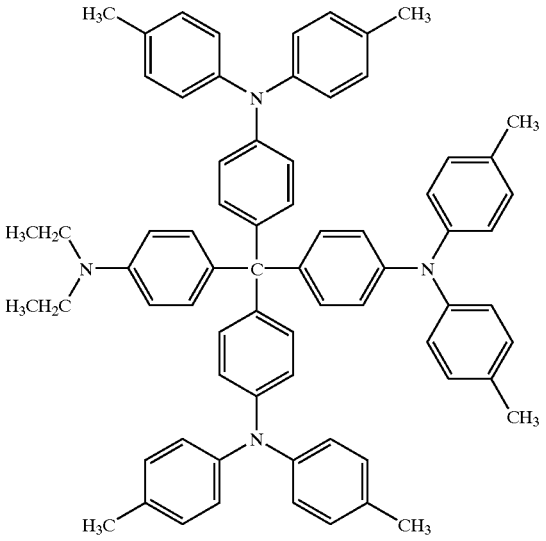
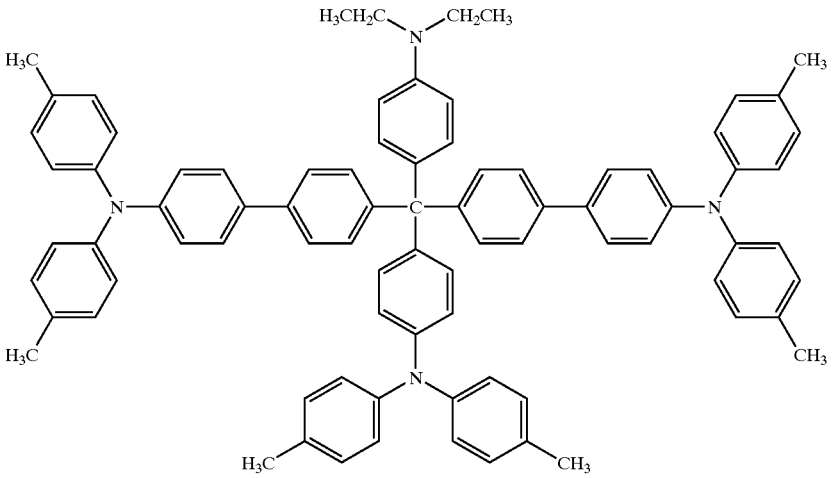

-continued
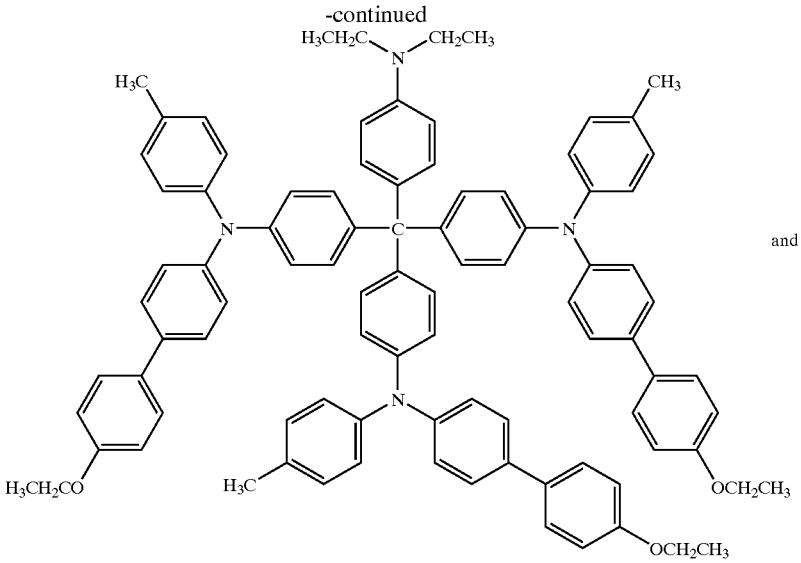
and
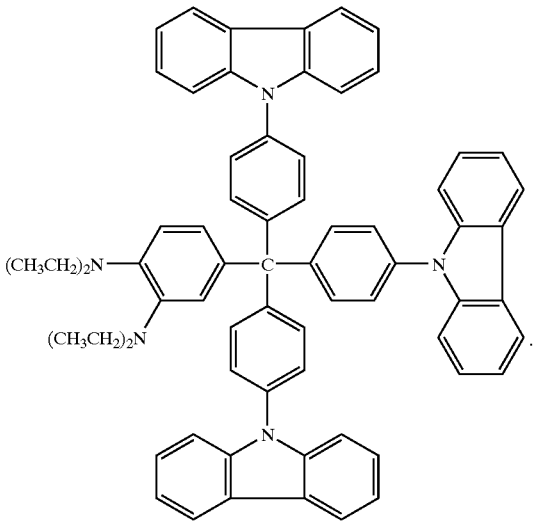
39. The electrophotographic photoreceptor of claim 1, comprising at least one amino compound selected from the group consisting of:
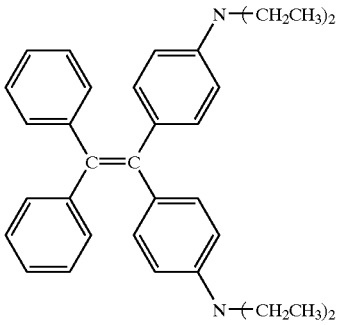
-continued
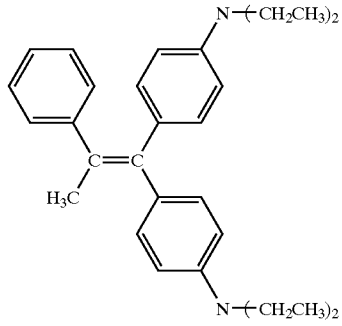

-continued
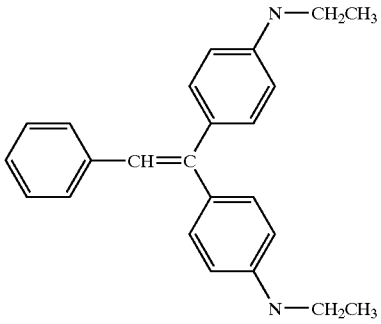
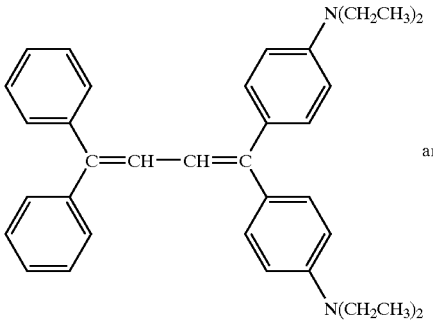
and
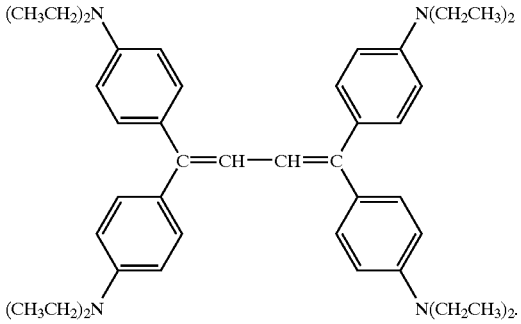
40. The electrophotbgraphic photoreceptor of claim 1, comprising at least one amino compound selected from the group consisting:
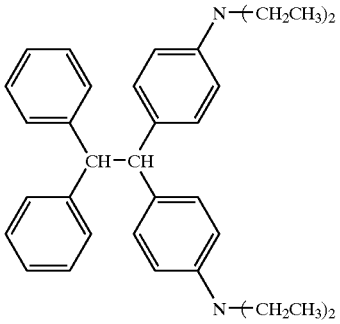
-continued
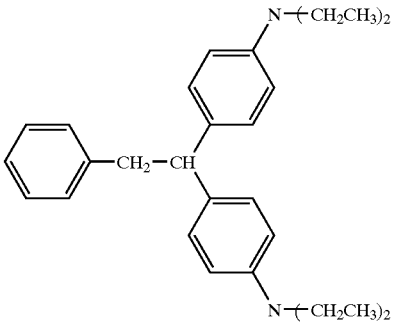
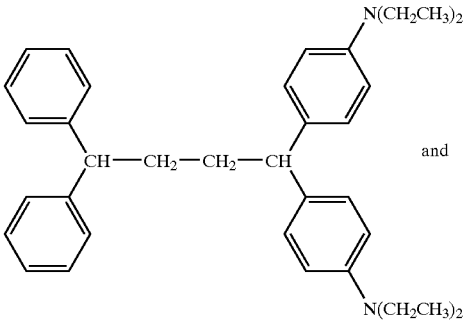
and
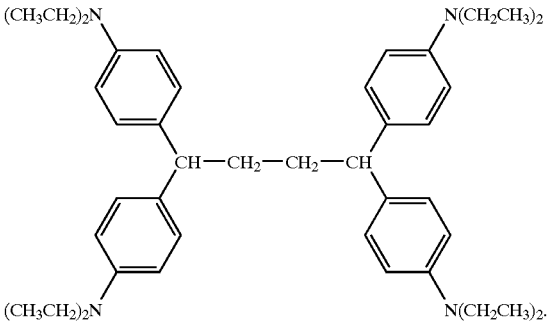
41. The electrophotographic photoreceptor of claim 1, comprising at least one amino compound selected from the group consisting:
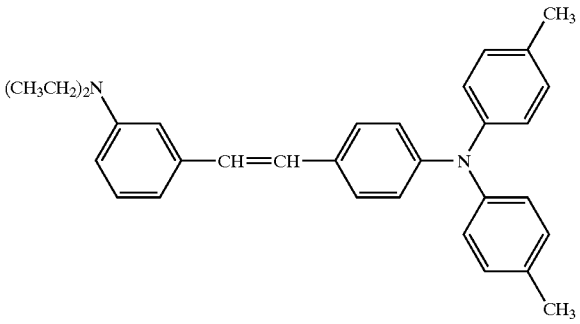

-continued
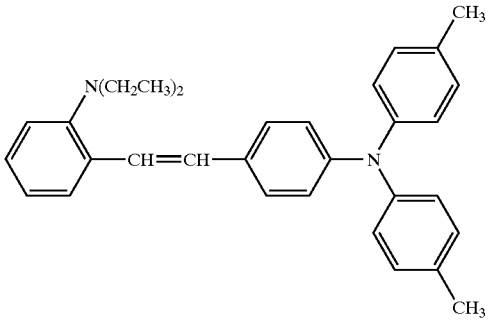
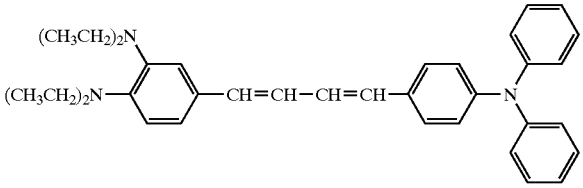
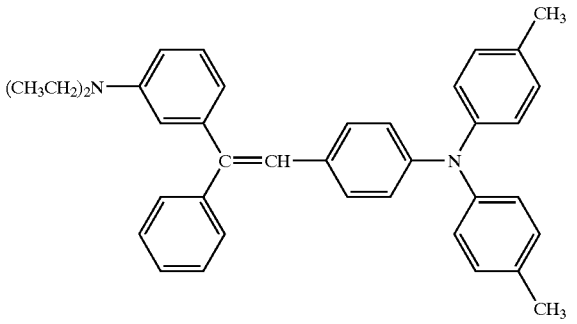
-continued
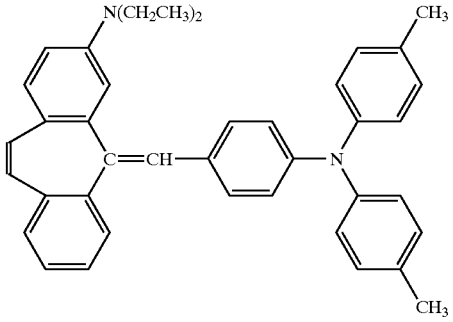
and
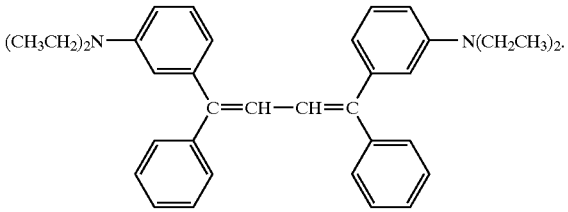
42. The electrophotographic photoreceptor of claim 1, comprising at least one amino compound selected from the group consisting:
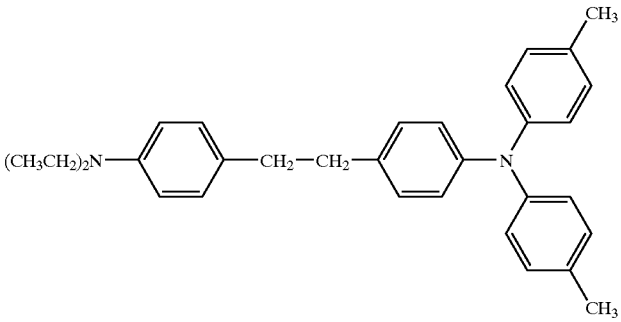
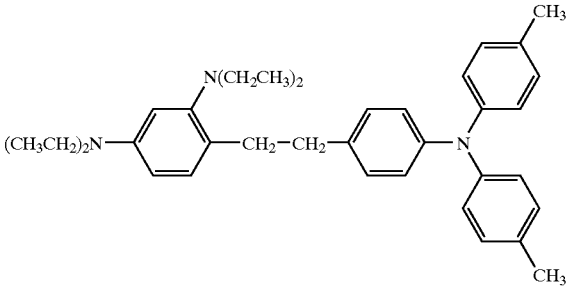

-continued
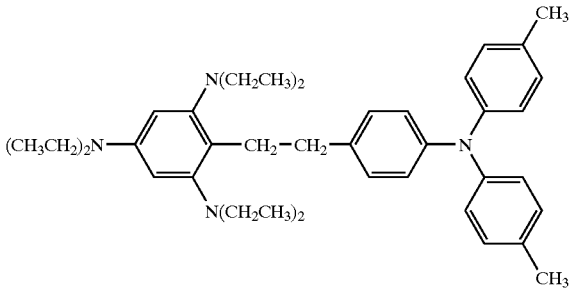
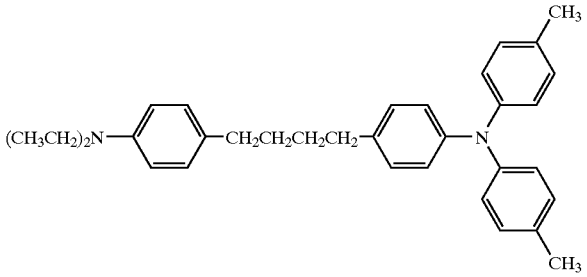
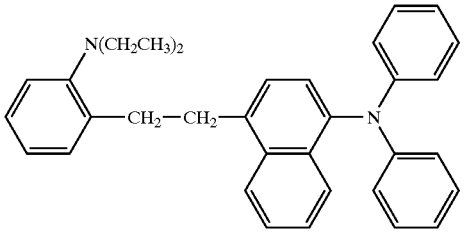
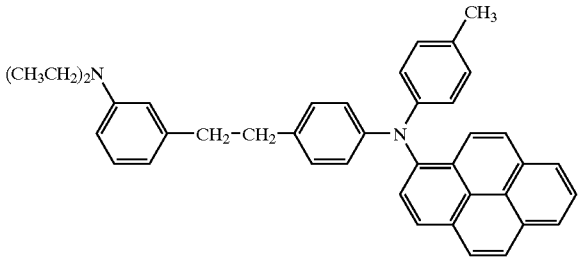
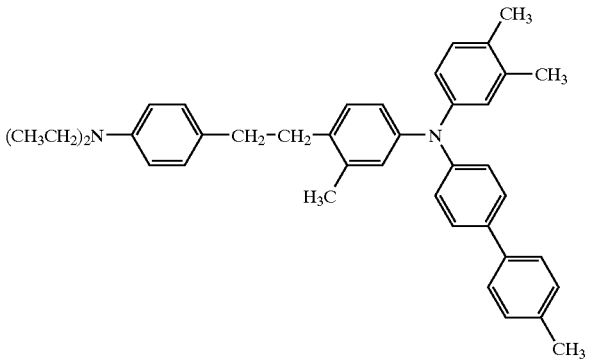
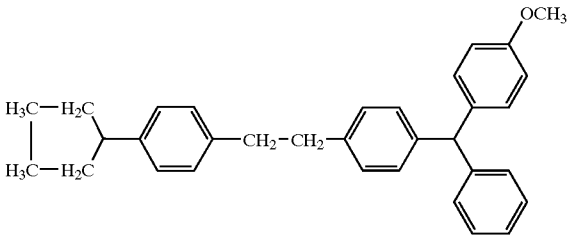

-continued
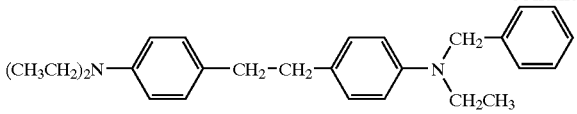
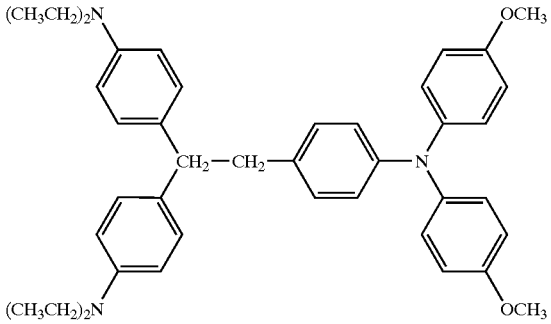
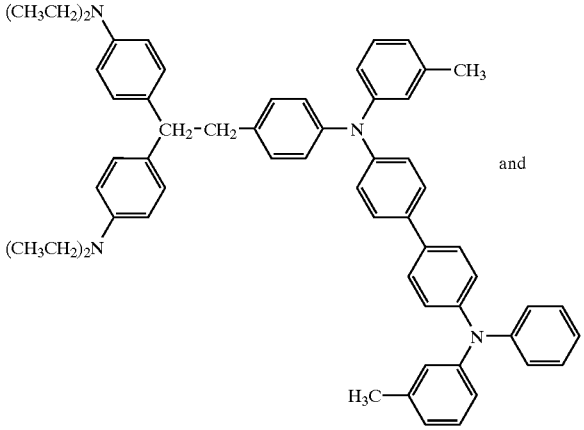
and
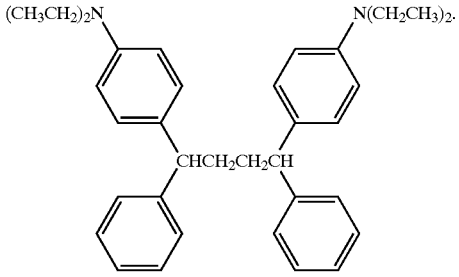
43. The electrophotographic photoreceptor of claim 1, comprising at least one amino compound selected from the group consisting:
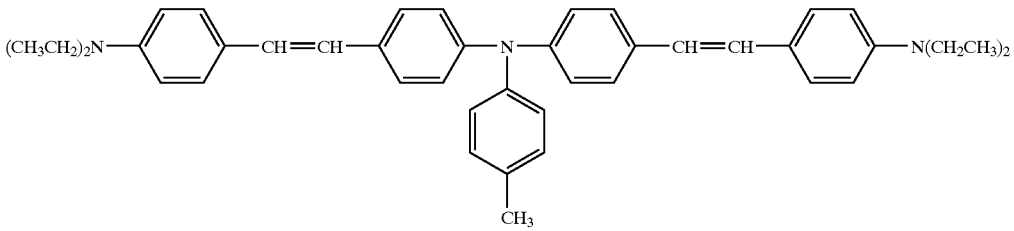

-continued
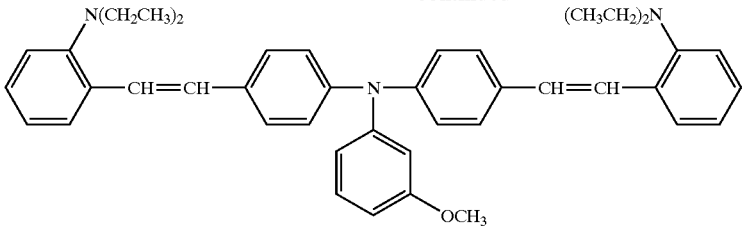
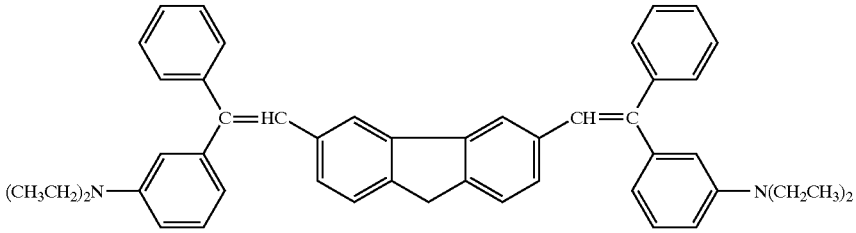
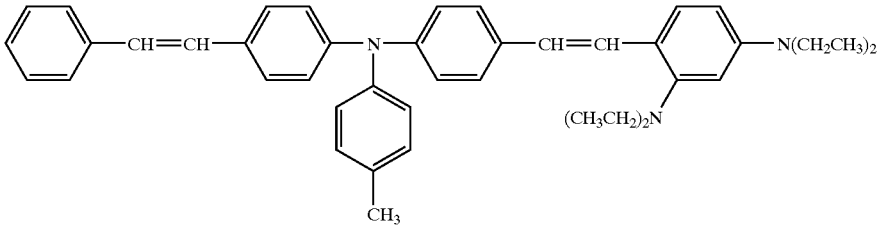
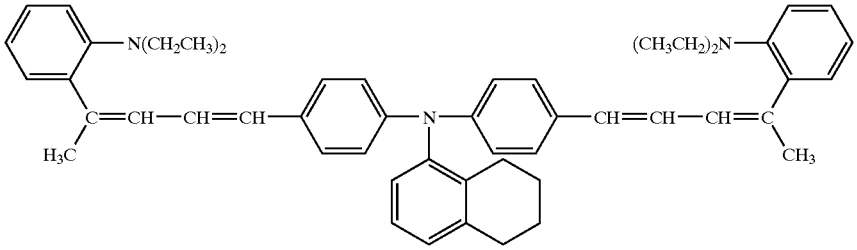
and
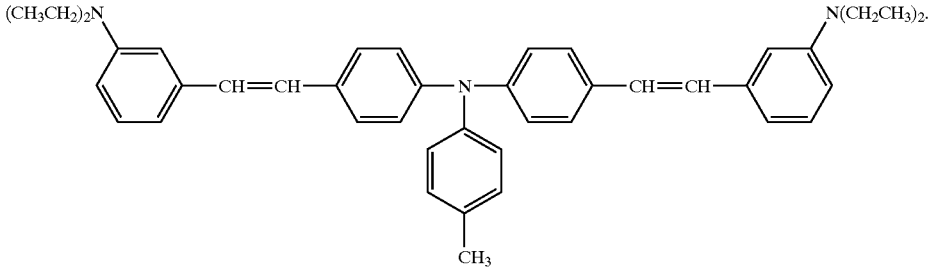
44. The electrophotographic photoreceptor of claim 1, comprising at least one amino compound selected from the group consisting:
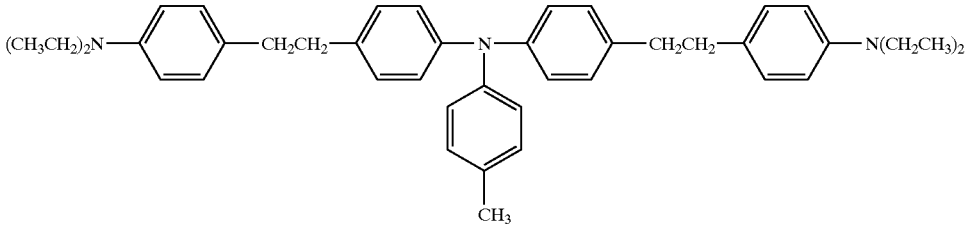

-continued
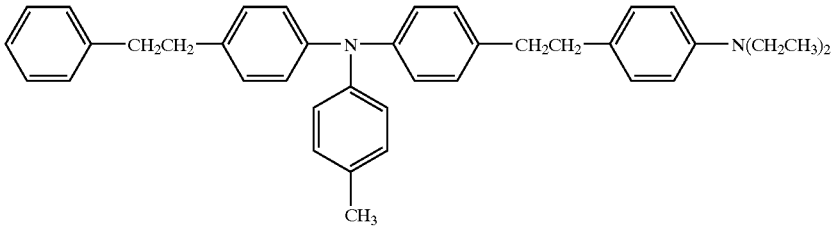
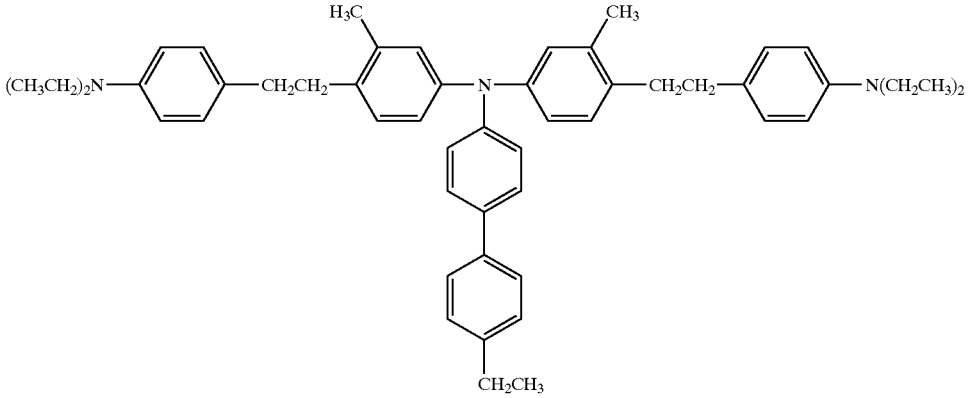
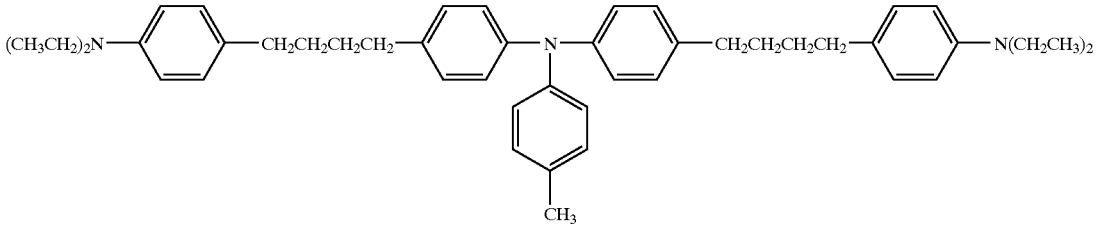
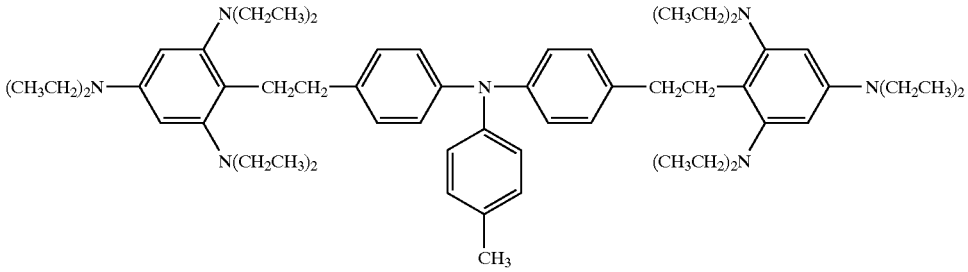
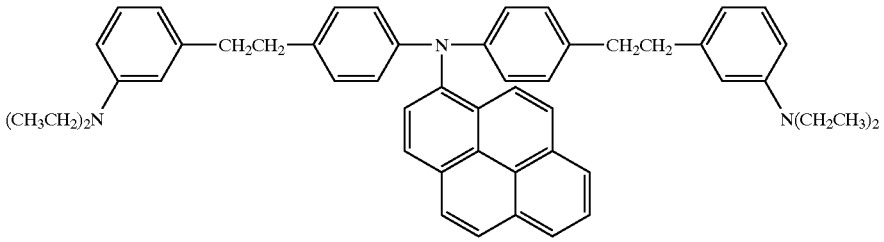
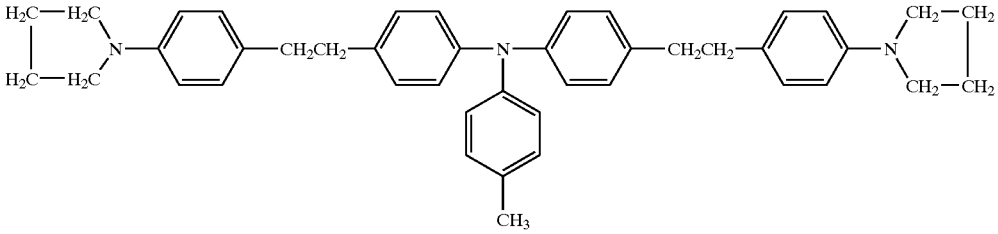

-continued
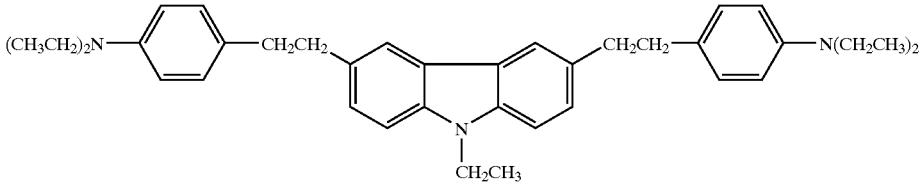
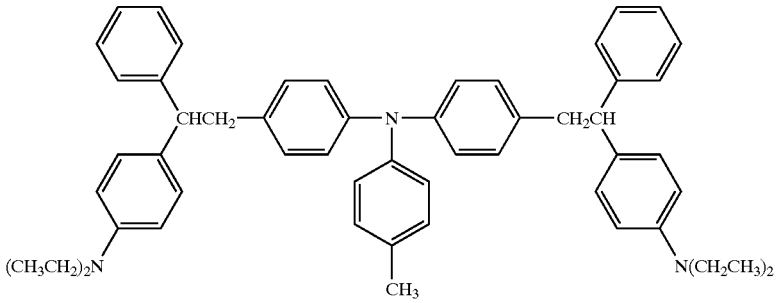
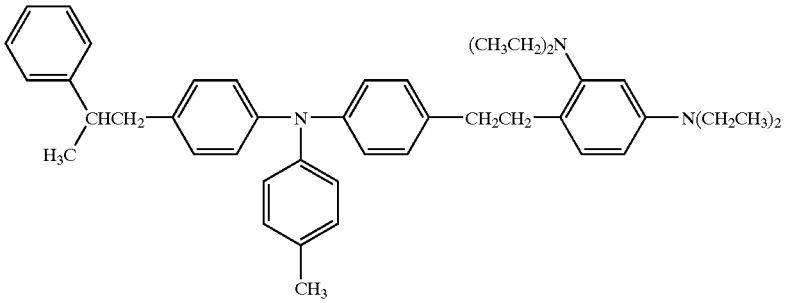
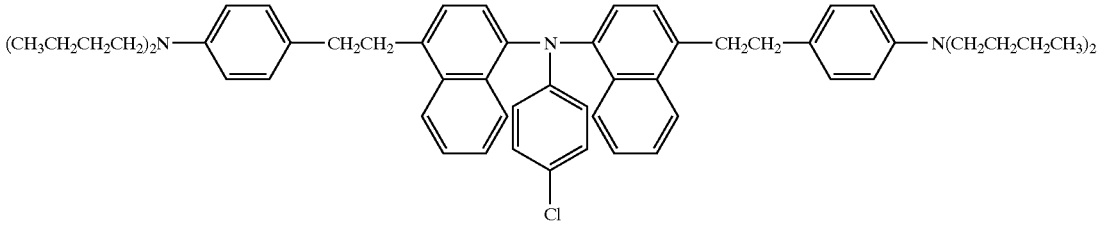
and
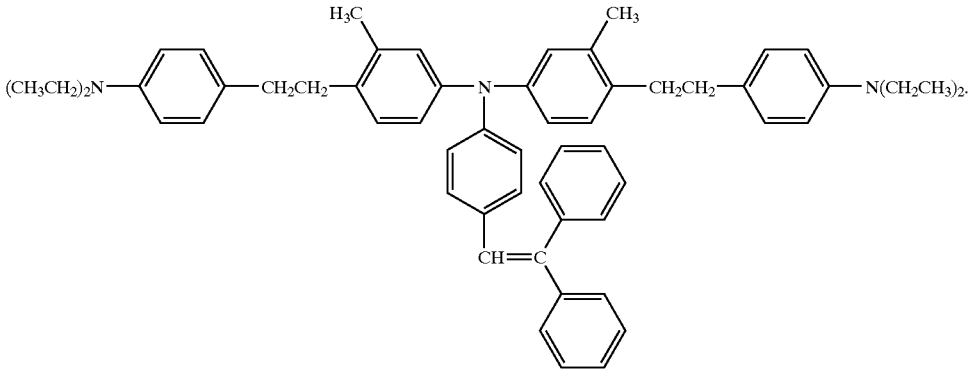

45. The electrophotographic photoreceptor of claim 1, comprising at least one amino compound selected from the group consisting:
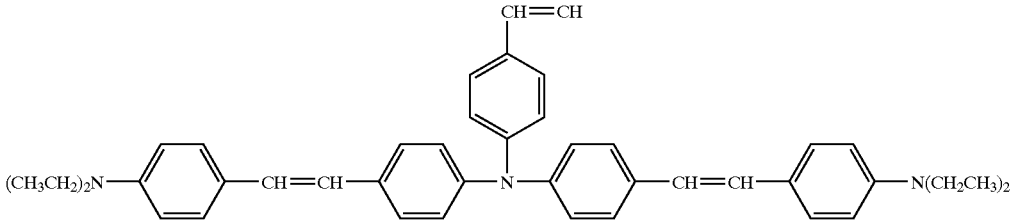
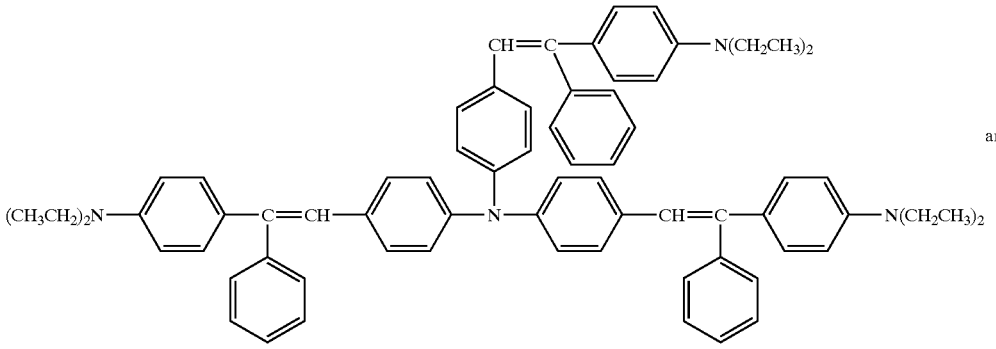
and
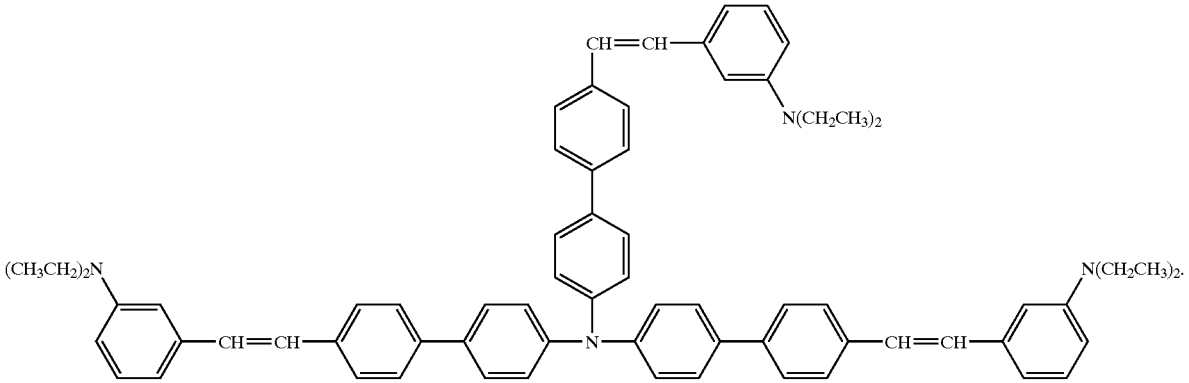
46. The electrophotographic photoreceptor of claim 1, comprising at least one amino compound selected from the group consisting:
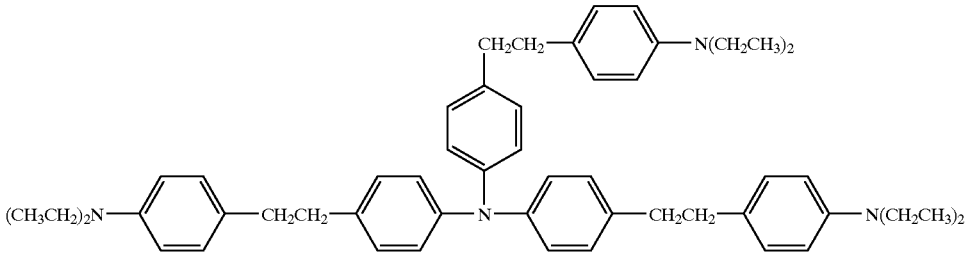

-continued
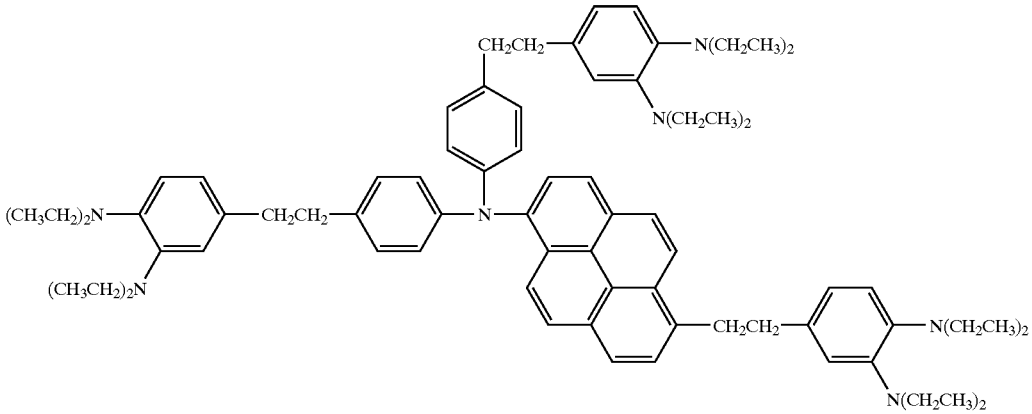
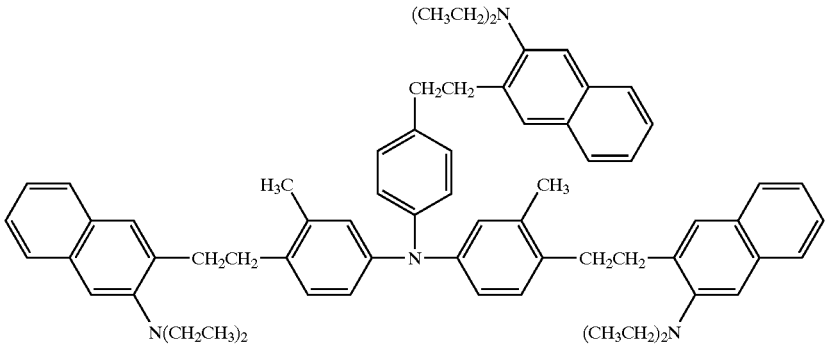
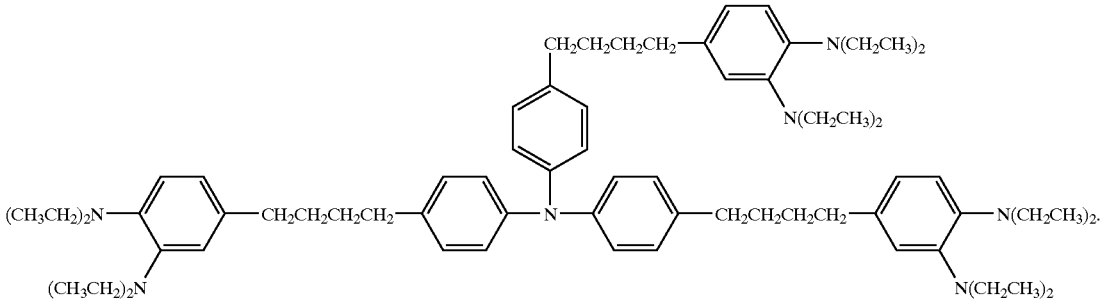
47. The electrophotographic photoreceptor of claim 1, comprising at least one amino compound selected from the group consisting:
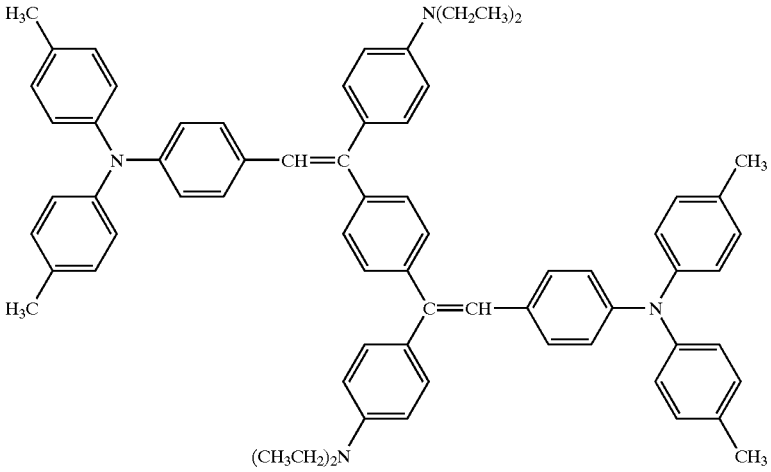

-continued
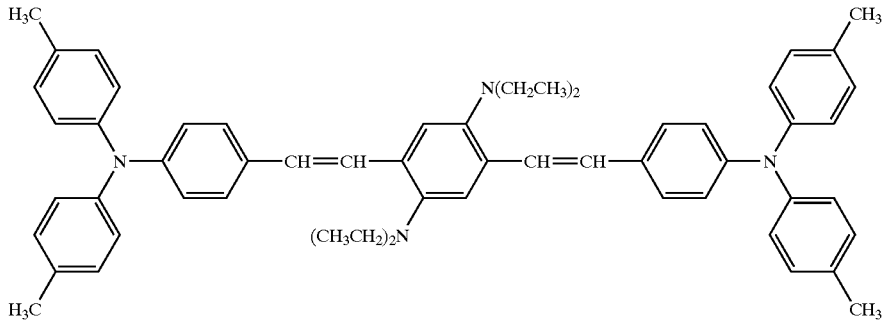
and
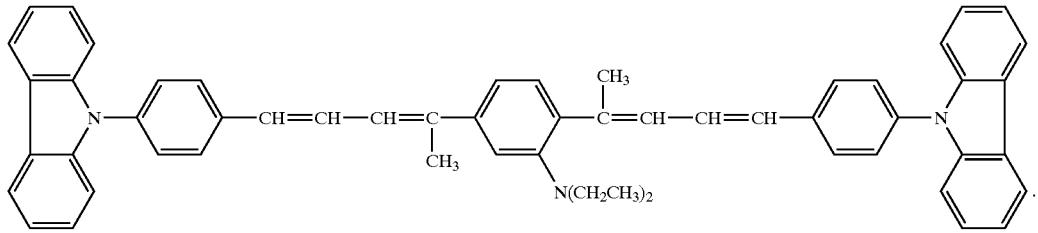
48. The electrophotographic photoreceptor of claim 1, comprising at least one amino compound selected from the group consisting:
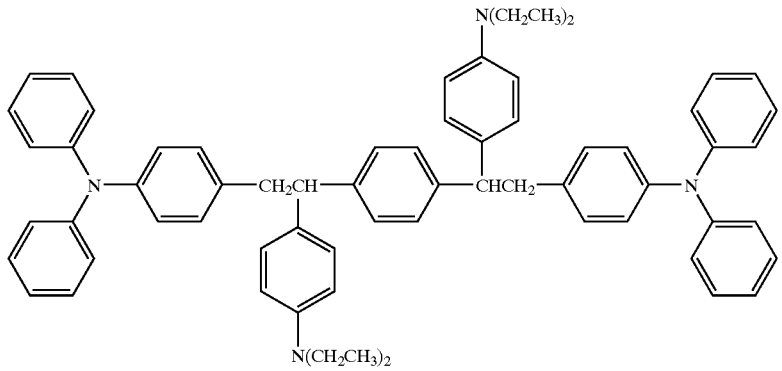
and
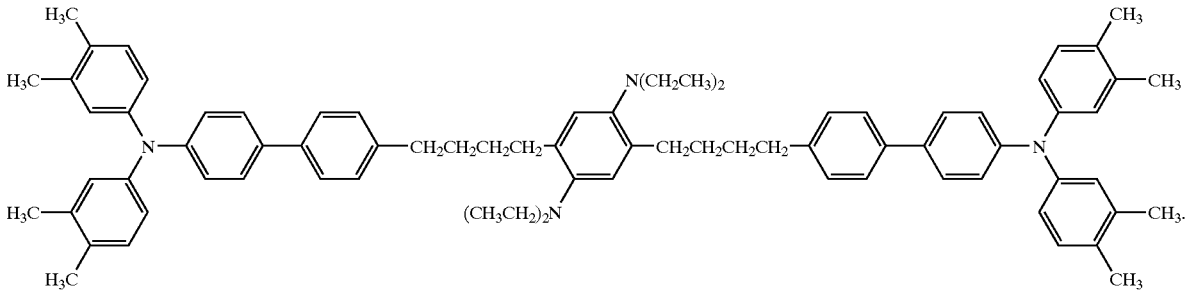

49. The electrophotographic photoreceptor of claim 1, comprising at least one amino compound selected from the group consisting:
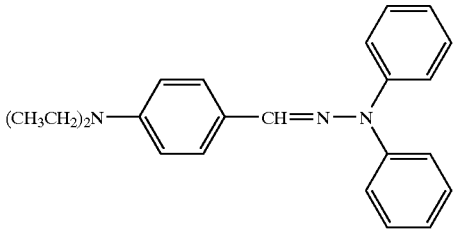
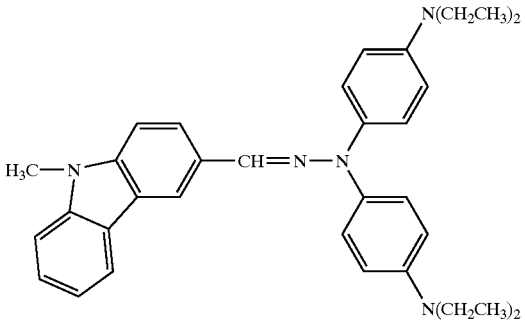
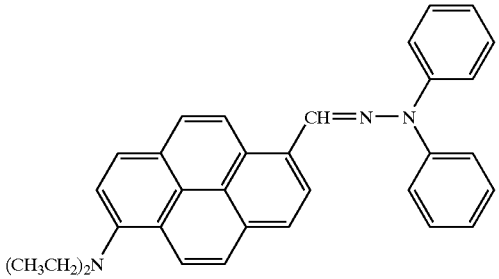
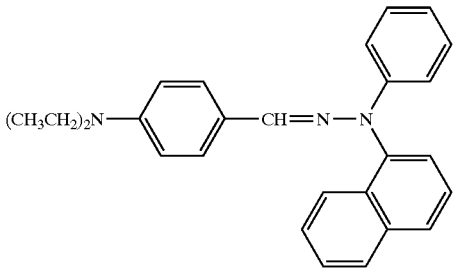
-continued
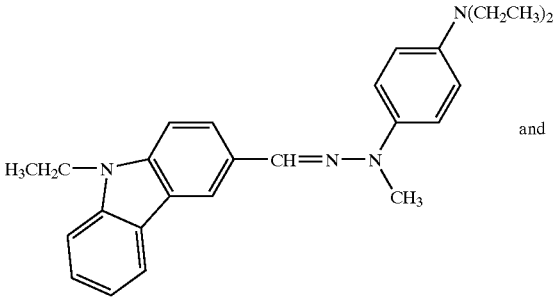
and
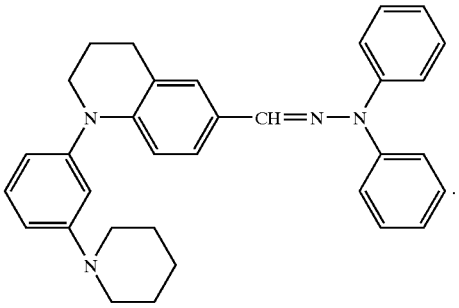
50. The electrophotographic photoreceptor of claim 1, comprising at least one amino compound selected from the group consisting:
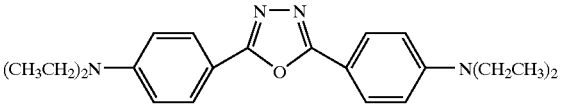
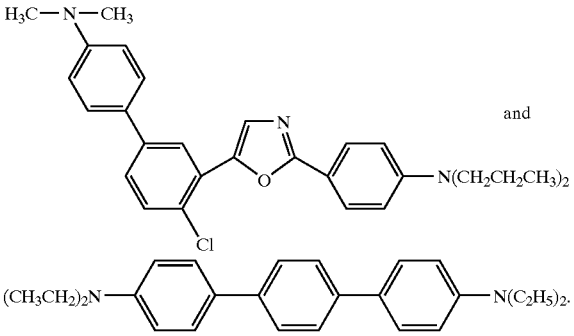
and
* * * * *

UNITED STATES PATENT AND TRADEMARK OFFICE

CERTIFICATE OF CORRECTION

PATENT NO. : 6,861,188 B2
DATED : March 1, 2005
INVENTOR(S) : Ikegami et al.

It is certified that error appears in the above-identified patent and that said Letters Patent is hereby corrected as shown below:

Title page,
Item [30], Foreign Application Priority Data, should read:

-- [30] Foreign Application Priority Data
Sep. 6, 2001 (JP) ..... 2001-271060
Nov. 2, 2001 (JP) ..... 2001-338194
Nov. 30, 2001 (JP) ..... 2001-367085
Feb. 25, 2002 (JP) ..... 2002-048616
Feb. 28, 2002 (JP) ..... 2002-054889
Feb 28, 2002 (JP) ..... 2002-054911
Jun. 4, 2002 (JP) ..... 2002-163547
Jun. 27, 2002 (JP) ..... 2002-188643 --

Signed and Sealed this

Seventh Day of June, 2005

JON W. DUDAS
*Director of the United States Patent and Trademark Office*